US009381756B2

(12) United States Patent
Yamaguchi et al.

(10) Patent No.: US 9,381,756 B2
(45) **Date of Patent: *Jul. 5, 2016**

(54) TAPE CASSETTE

(71) Applicant: Brother Kogyo Kabushiki Kaisha, Nagoya-shi, Aichi-ken (JP)

(72) Inventors: Koshiro Yamaguchi, Kakamigahara (JP); Akira Sago, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/643,865

(22) Filed: Mar. 10, 2015

(65) Prior Publication Data

US 2015/0183246 A1 Jul. 2, 2015

Related U.S. Application Data

(63) Continuation of application No. 13/240,216, filed on Sep. 22, 2011, now Pat. No. 9,011,028, which is a continuation of application No. PCT/JP2009/071568, filed on Dec. 25, 2009.

(30) Foreign Application Priority Data

| | | |
|---|---|---|
| Mar. 31, 2009 | (JP) | 2009086172 |
| Mar. 31, 2009 | (JP) | 2009086184 |
| Mar. 31, 2009 | (JP) | 2009086201 |
| Mar. 31, 2009 | (JP) | 2009086222 |

(51) Int. Cl.

| | |
|---|---|
| ***B41J 35/28*** | (2006.01) |
| ***B41J 32/00*** | (2006.01) |
| ***B41J 15/04*** | (2006.01) |

(52) U.S. Cl.

CPC ..... *B41J 15/044* (2013.01)

(58) Field of Classification Search

CPC ..... B41J 32/00; B41J 35/28; B41J 15/044
USPC ..... 400/196, 207
See application file for complete search history.

(56) References Cited

U.S. PATENT DOCUMENTS

| | | | |
|---|---|---|---|
| 3,901,372 | A | 8/1975 | Denley |
| 4,127,883 | A | 11/1978 | Mestdagh |

(Continued)

FOREIGN PATENT DOCUMENTS

| | | |
|---|---|---|
| CH | 121073 | 6/1927 |
| CH | 136498 | 11/1929 |

(Continued)

OTHER PUBLICATIONS

Mar. 5, 2010 (PCT) International Search Report in International Application No. PCT/JP2009/007088.

(Continued)

*Primary Examiner* — Nguyen Ha
*Assistant Examiner* — 'Wyn' Ha
(74) *Attorney, Agent, or Firm* — Banner & Witcoff, Ltd.

(57) ABSTRACT

A tape cassette includes a cassette case, a tape roll, a tape feed roller, and a head insertion portion. The cassette case has a top face, a bottom face, a front face, a rear face, a pair of side faces and a connecting face. The pair of side faces includes a left side face and a right side face that are opposed to each other. The tape feed roller is provided on a right side of the left side face and is provided in a front left corner portion. The head insertion portion is configured such that a head of a printer is inserted thereinto. The head insertion portion is an opening that is formed on a right side of the tape feed roller and extends from the bottom face toward the top face. At least one third line passes through the head insertion portion.

12 Claims, 30 Drawing Sheets

(56) References Cited

U.S. PATENT DOCUMENTS

| | | | |
|---|---|---|---|
| 4,226,547 | A | 10/1980 | Bradshaw et al. |
| 4,360,278 | A | 11/1982 | Paque |
| D267,330 | S | 12/1982 | Worrell |
| 4,391,539 | A | 7/1983 | Connoy |
| 4,402,619 | A | 9/1983 | Paque et al. |
| 4,557,617 | A | 12/1985 | Richardson et al. |
| 4,567,488 | A | 1/1986 | Moriguchi et al. |
| 4,678,353 | A | 7/1987 | Richardson et al. |
| 4,725,155 | A | 2/1988 | Kittel et al. |
| 4,773,775 | A | 9/1988 | Bradshaw et al. |
| 4,815,871 | A | 3/1989 | McGourty et al. |
| 4,815,874 | A | 3/1989 | Richardson et al. |
| 4,815,875 | A | 3/1989 | Richardson et al. |
| 4,832,514 | A | 5/1989 | Basile |
| 4,844,636 | A | 7/1989 | Paque |
| 4,880,325 | A | 11/1989 | Ueda et al. |
| 4,892,425 | A | 1/1990 | Shimizu et al. |
| D307,296 | S | 4/1990 | Ivarson et al. |
| 4,915,516 | A | 4/1990 | Shimizu et al. |
| 4,917,514 | A | 4/1990 | Richardson et al. |
| D307,918 | S | 5/1990 | Goda |
| 4,927,278 | A | 5/1990 | Kuzuya et al. |
| 4,930,913 | A | 6/1990 | Basile |
| D311,416 | S | 10/1990 | Richardson et al. |
| 4,966,476 | A | 10/1990 | Kuzuya et al. |
| 4,983,058 | A | 1/1991 | Nagae |
| 5,022,771 | A | 6/1991 | Paque |
| D319,070 | S | 8/1991 | Lavander |
| D320,391 | S | 10/1991 | Paque |
| 5,056,940 | A | 10/1991 | Basile |
| 5,078,523 | A | 1/1992 | McGourty et al. |
| 5,104,247 | A | 4/1992 | Ohshima |
| 5,111,216 | A | 5/1992 | Richardson et al. |
| 5,188,469 | A | 2/1993 | Nagao et al. |
| 5,193,919 | A | 3/1993 | Godo et al. |
| 5,195,835 | A | 3/1993 | Collins |
| 5,203,951 | A | 4/1993 | Hattori et al. |
| 5,223,939 | A | 6/1993 | Imaizumi et al. |
| 5,227,477 | A | 7/1993 | Auerbach et al. |
| 5,239,437 | A | 8/1993 | Hoge et al. |
| D342,275 | S | 12/1993 | Cooper |
| RE34,521 | E | 1/1994 | Shimizu et al. |
| 5,277,503 | A | 1/1994 | Nagao |
| 5,318,370 | A | 6/1994 | Nehowig |
| 5,348,406 | A | 9/1994 | Yoshiaki et al. |
| 5,350,243 | A | 9/1994 | Ichinomiya et al. |
| D352,305 | S | 11/1994 | Cooper |
| 5,374,132 | A | 12/1994 | Kimura |
| D356,333 | S | 3/1995 | Pearce et al. |
| 5,395,173 | A | 3/1995 | Ueno et al. |
| 5,399,033 | A | 3/1995 | Putman |
| D357,497 | S | 4/1995 | Gray et al. |
| 5,411,339 | A | 5/1995 | Bahrabadi et al. |
| 5,419,648 | A | 5/1995 | Nagao et al. |
| D359,303 | S | 6/1995 | Gray et al. |
| 5,424,757 | A | 6/1995 | Thom |
| 5,429,443 | A | 7/1995 | Kobayashi et al. |
| 5,431,504 | A | 7/1995 | Beadman et al. |
| 5,435,657 | A | 7/1995 | Pearce et al. |
| 5,466,076 | A | 11/1995 | Kobayashi et al. |
| 5,492,282 | A | 2/1996 | Okuchi et al. |
| 5,492,420 | A | 2/1996 | Nunokawa et al. |
| 5,494,362 | A | 2/1996 | Kobayashi et al. |
| 5,506,736 | A | 4/1996 | Ota |
| 5,511,891 | A | 4/1996 | Nehowig et al. |
| 5,518,328 | A | 5/1996 | Okuchi et al. |
| D372,044 | S | 7/1996 | Ware et al. |
| 5,533,818 | A | 7/1996 | Bahrabadi |
| 5,536,092 | A | 7/1996 | Yamaguchi |
| 5,538,352 | A | 7/1996 | Sugiura |
| 5,540,510 | A | 7/1996 | Sims et al. |
| 5,541,796 | A | 7/1996 | Sawada |
| 5,553,952 | A | 9/1996 | Umbach |
| 5,564,843 | A | 10/1996 | Kawaguchi |
| 5,593,237 | A | 1/1997 | Nozaki et al. |
| 5,595,447 | A | 1/1997 | Takayama et al. |
| 5,599,119 | A | 2/1997 | Nunokawa et al. |
| 5,605,404 | A | 2/1997 | Nunokawa et al. |
| 5,620,268 | A | 4/1997 | Yamaguchi et al. |
| 5,634,728 | A | 6/1997 | Nunokawa et al. |
| 5,653,542 | A | 8/1997 | Sugimoto et al. |
| 5,658,083 | A | 8/1997 | Day et al. |
| 5,659,441 | A | 8/1997 | Eckberg et al. |
| 5,709,486 | A | 1/1998 | Day |
| 5,727,888 | A | 3/1998 | Sugimoto et al. |
| 5,730,536 | A | 3/1998 | Yamaguchi |
| 5,739,839 | A | 4/1998 | Iwai et al. |
| 5,752,777 | A | 5/1998 | Nunokawa et al. |
| 5,765,954 | A | 6/1998 | Nunokawa et al. |
| 5,771,803 | A | 6/1998 | Takami |
| 5,795,086 | A | 8/1998 | Watanabe et al. |
| 5,813,773 | A | 9/1998 | Kawai |
| 5,813,779 | A | 9/1998 | Palmer et al. |
| 5,823,689 | A | 10/1998 | Nehowig et al. |
| 5,825,724 | A | 10/1998 | Matsumoto et al. |
| 5,826,995 | A | 10/1998 | Day et al. |
| 5,857,788 | A | 1/1999 | Gutsell et al. |
| 5,860,752 | A | 1/1999 | Watanabe et al. |
| 5,887,993 | A | 3/1999 | Nunokawa et al. |
| 5,961,225 | A | 10/1999 | Nunokawa et al. |
| 5,964,539 | A | 10/1999 | Yamaguchi et al. |
| 5,967,678 | A | 10/1999 | Nunokawa et al. |
| 5,997,194 | A | 12/1999 | Nunokawa et al. |
| 6,012,860 | A | 1/2000 | Nunokawa et al. |
| 6,042,280 | A | 3/2000 | Yamaguchi et al. |
| 6,048,118 | A | 4/2000 | Martinez et al. |
| 6,050,672 | A | 4/2000 | Matsuhashi |
| 6,050,734 | A | 4/2000 | Watanabe et al. |
| 6,059,469 | A | 5/2000 | Hirumi |
| 6,106,171 | A | 8/2000 | Nunokawa et al. |
| 6,116,796 | A | 9/2000 | Yamaguchi et al. |
| 6,132,120 | A | 10/2000 | Yamaguchi et al. |
| 6,146,034 | A | 11/2000 | Watanabe et al. |
| 6,149,325 | A | 11/2000 | Nunokawa et al. |
| 6,160,679 | A | 12/2000 | Maekawa et al. |
| 6,167,696 | B1 | 1/2001 | Maaseidvaag et al. |
| 6,168,328 | B1 | 1/2001 | Ueda et al. |
| 6,190,065 | B1 | 2/2001 | Brzuskiewicz |
| 6,190,069 | B1 | 2/2001 | Yamaguchi et al. |
| 6,196,740 | B1 | 3/2001 | Yamaguchi et al. |
| 6,227,477 | B1 | 5/2001 | Komatsuzaki et al. |
| 6,232,993 | B1 | 5/2001 | Kobayashi et al. |
| 6,270,269 | B1 | 8/2001 | Watanabe et al. |
| 6,317,156 | B1 | 11/2001 | Nagasaki et al. |
| 6,334,724 | B2 | 1/2002 | Yamaguchi et al. |
| 6,406,202 | B1 | 6/2002 | Unno et al. |
| 6,419,648 | B1 | 7/2002 | Vitek et al. |
| 6,429,443 | B1 | 8/2002 | Mankos et al. |
| 6,435,744 | B1 | 8/2002 | Dunn et al. |
| 6,476,838 | B1 | 11/2002 | Italiano |
| 6,485,206 | B1 | 11/2002 | Takahashi |
| 6,520,696 | B2 | 2/2003 | Huss et al. |
| 6,644,876 | B2 | 11/2003 | Carriere et al. |
| D486,853 | S | 2/2004 | Wilken et al. |
| 6,709,179 | B2 | 3/2004 | Yamaguchi et al. |
| 6,910,819 | B2 | 6/2005 | Carriere et al. |
| 6,929,415 | B2 | 8/2005 | Wilken |
| 6,955,318 | B2 | 10/2005 | Nonomura |
| D519,522 | S | 4/2006 | Lee |
| 7,070,347 | B2 | 7/2006 | Carriere et al. |
| 7,070,348 | B2 | 7/2006 | Sugimoto et al. |
| 7,097,372 | B1 | 8/2006 | Heyse et al. |
| 7,121,751 | B2 | 10/2006 | Harada et al. |
| 7,128,483 | B2 | 10/2006 | Harada et al. |
| D534,203 | S | 12/2006 | Harada et al. |
| 7,201,522 | B2 | 4/2007 | Bandholz et al. |
| D542,334 | S | 5/2007 | Harada et al. |
| 7,232,268 | B2 | 6/2007 | Sugimoto et al. |
| 7,287,715 | B2 | 10/2007 | Ban |
| 7,296,941 | B2 | 11/2007 | Suzuki et al. |
| 7,357,585 | B2 | 4/2008 | Kurashina |
| 7,404,684 | B2 | 7/2008 | Sugimoto et al. |
| D579,942 | S | 11/2008 | Terry et al. |
| 7,503,714 | B2 | 3/2009 | Yamamoto et al. |

(56) References Cited

U.S. PATENT DOCUMENTS

| | | | |
|---|---|---|---|
| 7,841,790 | B2 | 11/2010 | Yamaguchi et al. |
| 7,942,594 | B2 | 5/2011 | Kumazaki et al. |
| 7,965,308 | B2 | 6/2011 | Jauert et al. |
| 8,045,288 | B2 | 10/2011 | Ota et al. |
| 8,109,684 | B2 | 2/2012 | Yamaguchi |
| 8,162,553 | B2 | 4/2012 | Vandermeulen |
| 8,164,609 | B2 | 4/2012 | Liu et al. |
| 8,382,389 | B2 | 2/2013 | Yamaguchi et al. |
| D681,727 | S | 5/2013 | Van Den Broecke |
| 8,529,142 | B2 | 9/2013 | Tanaka |
| 8,540,444 | B2 | 9/2013 | Vandermeulen et al. |
| 8,562,228 | B2 | 10/2013 | Yamaguchi et al. |
| 8,641,304 | B2 | 2/2014 | Yamaguchi et al. |
| 8,734,035 | B2 | 5/2014 | Suva et al. |
| 8,740,482 | B2 | 6/2014 | Yamaguchi et al. |
| 8,757,907 | B2 | 6/2014 | Yamaguchi et al. |
| 8,764,326 | B2 | 7/2014 | Yamaguchi et al. |
| 8,770,877 | B2 | 7/2014 | Yamaguchi et al. |
| 2002/0006303 | A1 | 1/2002 | Yamaguchi et al. |
| 2002/0012558 | A1 | 1/2002 | Huss et al. |
| 2002/0047063 | A1 | 4/2002 | Kaneda et al. |
| 2002/0135938 | A1 | 9/2002 | Hiraguchi et al. |
| 2003/0081978 | A1 | 5/2003 | Carriere et al. |
| 2004/0056143 | A1 | 3/2004 | Nonomura |
| 2004/0062586 | A1 | 4/2004 | Harada et al. |
| 2004/0233269 | A1 | 11/2004 | Tsubota |
| 2004/0265027 | A1 | 12/2004 | Hine et al. |
| 2005/0036816 | A1 | 2/2005 | Carriere et al. |
| 2005/0152732 | A1 | 7/2005 | Bandholz et al. |
| 2005/0172981 | A1 | 8/2005 | Byun |
| 2006/0008608 | A1* | 1/2006 | Kurashina ..... B41J 3/4075 428/43 |
| 2006/0088802 | A1 | 4/2006 | Akaiwa |
| 2006/0182921 | A1 | 8/2006 | Hioki et al. |
| 2006/0193669 | A1 | 8/2006 | Takada et al. |
| 2006/0204304 | A1 | 9/2006 | Hioki et al. |
| 2006/0216099 | A1 | 9/2006 | Sakano et al. |
| 2006/0216100 | A1 | 9/2006 | Minoya et al. |
| 2006/0233582 | A1 | 10/2006 | Horiuchi |
| 2006/0238600 | A1 | 10/2006 | Vandermeulen et al. |
| 2006/0239743 | A1 | 10/2006 | Naito |
| 2007/0009302 | A1 | 1/2007 | Vandermeulen |
| 2007/0009306 | A1 | 1/2007 | Harada et al. |
| 2007/0031171 | A1 | 2/2007 | Heyse et al. |
| 2007/0041772 | A1 | 2/2007 | Harada et al. |
| 2007/0070168 | A1 | 3/2007 | Mindler et al. |
| 2007/0098473 | A1 | 5/2007 | Heyse et al. |
| 2007/0172293 | A1 | 7/2007 | Vandermeulen |
| 2007/0212149 | A1 | 9/2007 | Ota et al. |
| 2007/0231041 | A1 | 10/2007 | Ueda et al. |
| 2007/0237562 | A1 | 10/2007 | Kato et al. |
| 2007/0264070 | A1 | 11/2007 | Loo et al. |
| 2008/0003043 | A1* | 1/2008 | Fukui ..... B32D 1/021 400/615.2 |
| 2008/0050160 | A1 | 2/2008 | Yamaguchi et al. |
| 2008/0056793 | A1 | 3/2008 | Yokoyama |
| 2008/0080922 | A1 | 4/2008 | Vandermeulen |
| 2008/0181703 | A1 | 7/2008 | Ito et al. |
| 2008/0181708 | A1 | 7/2008 | Yamaguchi et al. |
| 2008/0226373 | A1 | 9/2008 | Yamaguchi et al. |
| 2008/0232886 | A1 | 9/2008 | Kato et al. |
| 2008/0310904 | A1 | 12/2008 | Yamaguchi et al. |
| 2009/0016795 | A1 | 1/2009 | Caveney et al. |
| 2009/0190988 | A1* | 7/2009 | Vereecken ..... B41J 3/4075 400/208 |
| 2009/0202283 | A1 | 8/2009 | Kumazaki et al. |
| 2009/0285617 | A1 | 11/2009 | Vandermeulen |
| 2010/0119281 | A1 | 5/2010 | Ford et al. |
| 2010/0166475 | A1 | 7/2010 | Yamaguchi et al. |
| 2010/0166478 | A1 | 7/2010 | Yamaguchi et al. |
| 2010/0166479 | A1 | 7/2010 | Yamaguchi et al. |
| 2010/0232862 | A1 | 9/2010 | Vandermeulen |
| 2010/0247208 | A1 | 9/2010 | Yamaguchi et al. |
| 2010/0247209 | A1 | 9/2010 | Yamaguchi et al. |
| 2010/0247210 | A1 | 9/2010 | Yamaguchi et al. |
| 2010/0272492 | A1 | 10/2010 | Van Britsom et al. |
| 2011/0058884 | A1 | 3/2011 | Kato et al. |
| 2012/0008999 | A1 | 1/2012 | Yamaguchi et al. |
| 2012/0027485 | A1 | 2/2012 | Suva et al. |
| 2012/0027486 | A1 | 2/2012 | Suva et al. |
| 2012/0027487 | A1 | 2/2012 | Suva et al. |
| 2012/0057917 | A1 | 3/2012 | Van Britsom et al. |
| 2012/0080550 | A1 | 4/2012 | Yamaguchi et al. |
| 2012/0170959 | A1 | 7/2012 | Vandermeulen et al. |
| 2012/0188325 | A1 | 7/2012 | Yamaguchi et al. |
| 2012/0189366 | A1 | 7/2012 | Yamaguchi et al. |
| 2012/0201588 | A1 | 8/2012 | Yamaguchi et al. |
| 2014/0205350 | A1 | 7/2014 | Yamaguchi et al. |
| 2014/0218458 | A1 | 8/2014 | Suva et al. |

FOREIGN PATENT DOCUMENTS

| | | | |
|---|---|---|---|
| CN | 1119146 | A | 3/1996 |
| CN | 1146954 | A | 4/1997 |
| CN | 1148547 | A | 4/1997 |
| CN | 1148548 | A | 4/1997 |
| CN | 1166155 | A | 11/1997 |
| CN | 1289293 | A | 3/2001 |
| CN | 1085151 | C | 5/2002 |
| CN | 1376115 | A | 10/2002 |
| CN | 1397431 | A | 2/2003 |
| CN | 1415482 | A | 5/2003 |
| CN | 1415484 | A | 5/2003 |
| CN | 1415485 | A | 5/2003 |
| CN | 1469811 | A | 1/2004 |
| CN | 1493462 | A | 5/2004 |
| CN | 1636755 | A | 7/2005 |
| CN | 1642746 | A | 7/2005 |
| CN | 1663807 | A | 9/2005 |
| CN | 1744994 | A | 3/2006 |
| CN | 1762720 | A | 4/2006 |
| CN | 1799850 | A | 7/2006 |
| CN | 1799851 | A | 7/2006 |
| CN | 1820940 | A | 8/2006 |
| CN | 1827386 | A | 9/2006 |
| CN | 1835867 | A | 9/2006 |
| CN | 1865012 | A | 11/2006 |
| CN | 1914045 | | 2/2007 |
| CN | 1990261 | A | 7/2007 |
| CN | 1331684 | C | 8/2007 |
| CN | 101028771 | | 9/2007 |
| CN | 101039807 | A | 9/2007 |
| CN | 101060985 | A | 10/2007 |
| CN | 101128324 | A | 2/2008 |
| CN | 101229724 | A | 7/2008 |
| CN | 101264701 | A | 9/2008 |
| CN | 101264702 | A | 9/2008 |
| CN | 101310989 | A | 11/2008 |
| CN | 101327696 | A | 12/2008 |
| CN | 101356061 | A | 1/2009 |
| CN | 101516628 | A | 8/2009 |
| CN | 101758676 | A | 6/2010 |
| CN | 102616025 | A | 8/2012 |
| CN | 202895934 | U | 4/2013 |
| EP | 214466 | A2 | 3/1987 |
| EP | 0329369 | A2 | 8/1989 |
| EP | 0511602 | A1 | 11/1992 |
| EP | 0555954 | A2 | 8/1993 |
| EP | 0629509 | A2 | 12/1994 |
| EP | 0635375 | A2 | 1/1995 |
| EP | 0644506 | A2 | 3/1995 |
| EP | 0684143 | A2 | 11/1995 |
| EP | 734878 | A2 | 10/1996 |
| EP | 0760291 | A2 | 3/1997 |
| EP | 0863021 | B1 | 9/1998 |
| EP | 0644506 | B1 | 4/1999 |
| EP | 1199179 | A1 | 4/2002 |
| EP | 1284196 | A2 | 2/2003 |
| EP | 1502758 | A1 | 2/2005 |
| EP | 1516739 | A1 | 3/2005 |
| EP | 1552949 | A1 | 7/2005 |
| EP | 1700705 | A1 | 9/2006 |
| EP | 1707395 | A1 | 10/2006 |
| EP | 2236303 | A1 | 10/2010 |

(56) References Cited

FOREIGN PATENT DOCUMENTS

| | | | |
|---|---|---|---|
| EP | 2236304 | A1 | 10/2010 |
| EP | 2448762 | B1 | 9/2013 |
| JP | S56-20944 | U | 2/1981 |
| JP | S58-139415 | U | 9/1983 |
| JP | S58-220783 | A | 12/1983 |
| JP | S59-78879 | A | 5/1984 |
| JP | S60-99692 | U | 7/1985 |
| JP | S61-179776 | A | 8/1986 |
| JP | S62-173944 | U | 11/1987 |
| JP | S63-81063 | U | 5/1988 |
| JP | S63-166557 | A | 7/1988 |
| JP | S63-203348 | A | 8/1988 |
| JP | S63-254085 | A | 10/1988 |
| JP | H01-195088 | A | 8/1989 |
| JP | H01-146945 | U | 10/1989 |
| JP | H02-56664 | U | 4/1990 |
| JP | H02-56665 | U | 4/1990 |
| JP | H02-56666 | U | 4/1990 |
| JP | H02-147272 | A | 6/1990 |
| JP | H03-14865 | A | 1/1991 |
| JP | H03-63155 | | 3/1991 |
| JP | H03-93584 | A | 4/1991 |
| JP | H03-151261 | A | 6/1991 |
| JP | H03-118672 | U | 12/1991 |
| JP | H03-120680 | U | 12/1991 |
| JP | H11-263055 | U | 12/1991 |
| JP | H04-16113 | U | 2/1992 |
| JP | H04-37575 | A | 2/1992 |
| JP | H04-133756 | A | 5/1992 |
| JP | H04-168086 | A | 6/1992 |
| JP | H05-16342 | U | 3/1993 |
| JP | H05-18853 | U | 3/1993 |
| JP | H05-63067 | A | 3/1993 |
| JP | H05-104840 | A | 4/1993 |
| JP | H05-155067 | A | 6/1993 |
| JP | H05-54225 | U | 7/1993 |
| JP | H05-78565 | U | 10/1993 |
| JP | H05-80765 | U | 11/1993 |
| JP | H05-294051 | A | 11/1993 |
| JP | H05-301435 | A | 11/1993 |
| JP | H06-12053 | U | 2/1994 |
| JP | H06-52560 | A | 2/1994 |
| JP | H06-21953 | U | 3/1994 |
| JP | H06-122239 | A | 5/1994 |
| JP | H06-122249 | A | 5/1994 |
| JP | H06-124406 | A | 5/1994 |
| JP | H06-127094 | A | 5/1994 |
| JP | H06-152907 | A | 5/1994 |
| JP | H06-53560 | U | 7/1994 |
| JP | H06-191081 | A | 7/1994 |
| JP | H06183117 | A | 7/1994 |
| JP | H06-210889 | A | 8/1994 |
| JP | H06-255145 | A | 9/1994 |
| JP | H06-74348 | U | 10/1994 |
| JP | H06-328800 | A | 11/1994 |
| JP | H07-1782 | | 1/1995 |
| JP | H07-1805 | A | 1/1995 |
| JP | H07-9743 | A | 1/1995 |
| JP | H07-25122 | A | 1/1995 |
| JP | H07-25123 | A | 1/1995 |
| JP | H07-47737 | A | 2/1995 |
| JP | H07-20725 | | 3/1995 |
| JP | H07-61009 | A | 3/1995 |
| JP | H07-68814 | A | 3/1995 |
| JP | H07-68877 | A | 3/1995 |
| JP | H07-69497 | A | 3/1995 |
| JP | H07-89115 | A | 4/1995 |
| JP | H07-89196 | A | 4/1995 |
| JP | H07-101133 | A | 4/1995 |
| JP | H07-108702 | A | 4/1995 |
| JP | H07-108730 | A | 4/1995 |
| JP | H07-137327 | A | 5/1995 |
| JP | H07-40456 | U | 7/1995 |
| JP | H07-214876 | A | 8/1995 |
| JP | H07-237314 | A | 9/1995 |
| JP | H07-251539 | A | 10/1995 |
| JP | H07-276695 | A | 10/1995 |
| JP | H07-290803 | A | 11/1995 |
| JP | H07-314862 | A | 12/1995 |
| JP | H07-314864 | A | 12/1995 |
| JP | H07-314865 | A | 12/1995 |
| JP | H07-314866 | A | 12/1995 |
| JP | H08-25768 | A | 1/1996 |
| JP | H08-39909 | A | 2/1996 |
| JP | H08-058211 | A | 3/1996 |
| JP | H08-118738 | A | 5/1996 |
| JP | H08-165035 | A | 6/1996 |
| JP | H08-216461 | A | 8/1996 |
| JP | H08-252964 | A | 10/1996 |
| JP | H08-267839 | A | 10/1996 |
| JP | H08-290618 | A | 11/1996 |
| JP | H09-39347 | | 2/1997 |
| JP | 2596263 | B2 | 4/1997 |
| JP | H09-109533 | A | 4/1997 |
| JP | H09-118044 | A | 5/1997 |
| JP | H09-123579 | A | 5/1997 |
| JP | H09-134557 | A | 5/1997 |
| JP | H09-141986 | A | 6/1997 |
| JP | H09-141997 | A | 6/1997 |
| JP | H09-188049 | A | 7/1997 |
| JP | H09-188050 | A | 7/1997 |
| JP | H09-240158 | A | 9/1997 |
| JP | H10-56604 | A | 2/1998 |
| JP | H10-181063 | A | 7/1998 |
| JP | H10-301701 | A | 11/1998 |
| JP | H11-78188 | A | 3/1999 |
| JP | H11-78189 | A | 3/1999 |
| JP | H11-91144 | A | 4/1999 |
| JP | H11-105351 | A | 4/1999 |
| JP | H11-129563 | A | 5/1999 |
| JP | H11-263056 | A | 9/1999 |
| JP | 2000-006481 | A | 1/2000 |
| JP | 2000-006501 | A | 1/2000 |
| JP | 2998617 | B2 | 1/2000 |
| JP | 2000025251 | A | 1/2000 |
| JP | 2000-043337 | A | 2/2000 |
| JP | 2000043336 | A | 2/2000 |
| JP | 2000-076372 | A | 3/2000 |
| JP | 2000085224 | A | 3/2000 |
| JP | 3031439 | B2 | 4/2000 |
| JP | 2000103129 | A | 4/2000 |
| JP | 2000103131 | A | 4/2000 |
| JP | 2000135843 | A | 5/2000 |
| JP | 2000198258 | A | 7/2000 |
| JP | 2000-211193 | A | 8/2000 |
| JP | 2000-229750 | A | 8/2000 |
| JP | 2001011594 | A | 1/2001 |
| JP | 2001048389 | A | 2/2001 |
| JP | 2001088359 | A | 4/2001 |
| JP | 2001121797 | A | 5/2001 |
| JP | 3207860 | B2 | 9/2001 |
| JP | 2001310540 | A | 11/2001 |
| JP | 2001319447 | A | 11/2001 |
| JP | 2002-053248 | A | 2/2002 |
| JP | 2002042441 | A | 2/2002 |
| JP | 3266736 | B2 | 3/2002 |
| JP | 3266739 | B2 | 3/2002 |
| JP | 2002-103762 | A | 4/2002 |
| JP | 2002104568 | A | 4/2002 |
| JP | 2002-166606 | A | 6/2002 |
| JP | 2002-167084 | A | 6/2002 |
| JP | 2002166605 | A | 6/2002 |
| JP | 2002179300 | A | 6/2002 |
| JP | 2002192769 | A | 7/2002 |
| JP | 2002308481 | A | 10/2002 |
| JP | 2002308518 | A | 10/2002 |
| JP | 3357128 | B2 | 12/2002 |
| JP | 2002367333 | A | 12/2002 |
| JP | 2003-011454 | A | 1/2003 |
| JP | 2003-026164 | A | 1/2003 |
| JP | 2003-506235 | A | 2/2003 |
| JP | 3378622 | B2 | 2/2003 |
| JP | 2003048337 | A | 2/2003 |
| JP | 2003-072127 | A | 3/2003 |

(56) References Cited

FOREIGN PATENT DOCUMENTS

| | | | |
|---|---|---|---|
| JP | 2003145902 | A | 5/2003 |
| JP | 3426983 | B2 | 7/2003 |
| JP | 2003-251904 | A | 9/2003 |
| JP | 2003251902 | A | 9/2003 |
| JP | 2003285522 | A | 10/2003 |
| JP | 2004-018077 | A | 1/2004 |
| JP | 2004-155150 | A | 6/2004 |
| JP | 3543659 | B2 | 7/2004 |
| JP | 2004-255656 | A | 9/2004 |
| JP | 3564848 | B2 | 9/2004 |
| JP | 3567469 | B2 | 9/2004 |
| JP | 2004291591 | A | 10/2004 |
| JP | 20044323241 | A | 11/2004 |
| JP | 3106187 | U | 12/2004 |
| JP | 2005-059504 | A | 3/2005 |
| JP | 2005088597 | A | 4/2005 |
| JP | 2005-178206 | A | 7/2005 |
| JP | 2005231203 | A | 9/2005 |
| JP | 2005-298031 | A | 10/2005 |
| JP | 2005280008 | A | 10/2005 |
| JP | 2005297348 | A | 10/2005 |
| JP | 2006021432 | A | 1/2006 |
| JP | 2006096030 | A | 4/2006 |
| JP | 2006142835 | A | 6/2006 |
| JP | 2006168974 | A | 6/2006 |
| JP | 2006182034 | A | 7/2006 |
| JP | 2006-240310 | A | 9/2006 |
| JP | 2006248059 | A | 9/2006 |
| JP | 2006-264337 | A | 10/2006 |
| JP | 2006272895 | A | 10/2006 |
| JP | 2006272977 | A | 10/2006 |
| JP | 2006289991 | A | 10/2006 |
| JP | 2007111863 | A | 5/2007 |
| JP | 2007196654 | A | 8/2007 |
| JP | 2007-268815 | A | 10/2007 |
| JP | 4003068 | B2 | 11/2007 |
| JP | 2007296863 | A | 11/2007 |
| JP | 2008044180 | A | 2/2008 |
| JP | 4061507 | B2 | 3/2008 |
| JP | 2008080668 | A | 4/2008 |
| JP | 2008083432 | A | 4/2008 |
| JP | 2008094103 | A | 4/2008 |
| JP | 2008509823 | A | 4/2008 |
| JP | 2008-213462 | A | 9/2008 |
| JP | 2008-229855 | A | 10/2008 |
| JP | 2008254384 | A | 10/2008 |
| JP | 2008-279678 | A | 11/2008 |
| JP | 2008265180 | A | 11/2008 |
| JP | 2008265278 | A | 11/2008 |
| JP | 2008-307703 | A | 12/2008 |
| JP | 2009001020 | A | 1/2009 |
| JP | 2009028976 | A | 2/2009 |
| JP | 2009509812 | A | 3/2009 |
| JP | 2009184832 | A | 8/2009 |
| JP | 2009-214431 | A | 9/2009 |
| JP | 2010-234697 | A | 10/2010 |
| JP | 2011-011407 | A | 1/2011 |
| JP | 2011011401 | A | 1/2011 |
| JP | 2011110843 | A | 6/2011 |
| JP | 2011110845 | A | 6/2011 |
| JP | 2011110848 | A | 6/2011 |
| WO | 0032401 | A1 | 6/2000 |
| WO | 0110649 | A1 | 2/2001 |
| WO | 0232680 | A1 | 4/2002 |
| WO | 03080350 | A1 | 10/2003 |
| WO | 2005101306 | A1 | 10/2005 |
| WO | 20060013466 | A2 | 2/2006 |
| WO | 2006024913 | A2 | 3/2006 |
| WO | 2006033431 | A1 | 3/2006 |
| WO | 2006033432 | A1 | 3/2006 |
| WO | 2006090842 | A1 | 8/2006 |
| WO | 2009107534 | A1 | 9/2009 |
| WO | 2010-113782 | A1 | 10/2010 |
| WO | 2010113445 | A1 | 10/2010 |

OTHER PUBLICATIONS

Mar. 16, 2010 (PCT) International Search Report and Written Opinion issued in International Application No. PCT/ JP2009/071812.
Mar. 16, 2010 (PCT) International Search Report in International Application No. PCT/JP2010/050253.
Mar. 23, 2010 (PCT) International Search Report in International Application No. PCT/JP2009/070971.
Mar. 23, 2010 (PCT) International Search Report in International Application No. PCT/JP2009/071568.
May 20, 2010 (PCT) International Search Report in International Application No. PCT/JP2009/007085.
May 20, 2010 (PCT) International Search Report in International Application No. PCT/JP2009/007086.
May 20, 2010 (PCT) International Search Report in International Application No. PCT/JP2009/007087.
May 21, 2010 (PCT) International Search Report in International Application No. PCT/JP2009/007089.
May 21, 2010 Extended European Search Report in European Patent Application No. 09180351.
May 21, 2010 Extended European Search Report in European Patent Application No. 09180354.
Jun. 22, 2010 (PCT) International Search Report in International Application No. PCT/JP2010/055305.
Jun. 22, 2010 (PCT) International Search Report in International Application No. PCT/JP2010/055310.
Jun. 22, 2010 (PCT) International Search Report in International Application No. PCT/JP2010/055311.
Jun. 22, 2010 (PCT) International Search Report in International Application No. PCT/JP2010/055324.
Jun. 22, 2010 (PCT) International Search Report in International Application No. PCT/JP2010/055326.
Jun. 28, 2010 (PCT) International Search Report in International Application No. PCT/JP2010/002170.
Jul. 2, 2010 Extended European Search Report in European Patent Application No. 10157994.
Jul. 12, 2010 Extended European Search Report in European Patent Application No. 10158024.
Jul. 30, 2010 (PCT) International Search Report in International Application No. PCT/JP2010/002165.
Jul. 30, 2010 (PCT) International Search Report in International Application No. PCT/JP2010/002169.
Aug. 3, 2010 (PCT) International Search Report in International Application No. PCT/JP2010/002154.
Aug. 3, 2010 (PCT) International Search Report in International Application No. PCT/JP2010/002161.
Aug. 24, 2010 (PCT) International Search Report in International Application No. PCT/JP2010/004076.
Oct. 12, 2010 Extended European Search Report in European Patent Application No. 10155348.
Dec. 3, 2010 Extended European Search Report in European Patent Application No. 10175769.
Oct. 11, 2011 (JP) Office Action issued in Japanese Patent Application No. 2008-331634.
Oct. 11, 2011 (JP) Office Action issued in Japanese Patent Application No. 2009-088227.
Oct. 11, 2011 (JP) Office Action issued in Japanese Patent Application No. 2009-088238.
Oct. 11, 2011 (JP) Office Action issued in Japanese Patent Application No. 2009-088441.
Oct. 11, 2011 (JP) Office Action issued in Japanese Patent Application No. 2009-088460.
Oct. 11, 2011 (JP) Office Action issued in Japanese Patent Application No. 2009-088440.
Nov. 15, 2011 (JP) Office Action issued in Japanese Patent Application No. 2009-088241.
Nov. 15, 2011 (PCT) International Preliminary Report on Patentability issued in PCT/JP2009/071568.
Nov. 15, 2011 (PCT) International Preliminary Report on Patentability issued in PCT/JP2010/050253.
Nov. 15, 2011 (PCT) International Preliminary Report on Patentability issued in PCT/JP2010/055324.-

(56) References Cited

OTHER PUBLICATIONS

Nov. 15, 2011 (PCT) International Preliminary Report on Patentability issued in PCT/JP2010/055326.
Jan. 17, 2012 (JP) Office Action issued in Japanese Patent Application No. 2009-088456.
Feb. 14, 2010 (PCT) International Preliminary Report on Patentability in International Application No. PCT/JP2010/055305.
Feb. 14, 2012 (PCT) International Preliminary Report on Patentability in International Application No. PCT/JP2010/055311.
Jul. 3, 2012 (US) Office Action issued in U.S. Appl. No. 12/732,404.
Mar. 8, 2012 (US) Office Action issued in U.S. Appl. No. 12/732,247.
Mar. 9, 2012 (US) Office Action issued in U.S. Appl. No. 12/732,257.
Mar. 26, 2012 (US) Office Action issued in U.S. Appl. No. 12/732,457.
Mar. 27, 2012 (JP) Office Action issued in Japanese Patent Application No. 2008-331638.
Jul. 3, 2012 (JP) Office Action issued in Japanese Patent Application No. 2008-331639.
Mar. 27, 2012 (JP) Office Action issued in Japanese Patent Application No. 2009-156405.
Mar. 27, 2012 (JP) Office Action issued in Japanese Patent Application No. 2009-156406.
Mar. 27, 2012 (JP) Office Action issued in Japanese Patent Application No. 2009-156407.
Mar. 27, 2012 (JP) Office Action issued in Japanese Patent Application No. 2009-270221.
Apr. 13, 2015—(CN) Notification of Third Office Action—App 201210071810.7—Eng. Tran.
Apr. 9, 2015—(TW) Office Action—App 099132598—Eng. Tran.
May 26, 2015—(CN) Office Action—App 201310659625.4.
Aug. 6, 2015—(CN) Office Action—App 201410046812A—Eng Tran.
Aug. 11, 2015—(Au) Patent Examination Report 1—App 2014221250.
Aug. 13, 2015—(US) Final Office Action—U.S. Appl. No. 13/431,371.
Aug. 25, 2015—(US) Final Office Action—U.S. Appl. No. 14/226,402.
Sep. 1, 2015—(US) Notice of Allowance—U.S. Appl. No. 14/226,259.
Sep. 8, 2015—(JP) Office Action—App 2014-210427—Eng Tran.
Sep. 8, 2015—(US) Notice of Allowance—U.S. Appl. No. 14/141,673.
Sep. 9, 2015—(US) Final Office Action—U.S. Appl. No. 14/226,386.
Sep. 24, 2014—(JP) Notification of Rejection—App 2013-142488—Eng Tran.
Sep. 24, 2014—(US) Notice of Allowance—U.S. Appl. No. 13/431,277.
Sep. 25, 2014—(US) Non-Final Office Action—U.S. Appl. No. 14/226,424.
Jan. 3, 2014 (AU) Office Action issued in Australian Patent Application No. 2010231426.
Jan. 17, 2014 (CN) Office Action issued in Chinese Patent Application No. 201210071810.7.
Jan. 22, 2014 (CN) Office Action issued in Chinese Patent Application No. 201010274378.2.
Feb. 5, 2014 (EP) Extended European Search Report issued in European Patent Application No. 09852818.5.
Mar. 10, 2014 (US) Non-Final Office Action issued in U.S. Appl. No. 13/430,080.
Mar. 13, 2014 (CN) Office Action issued in Chinese Application No. 201010150928.
Mar. 25, 2014 (US) Non-Final Office Action issued in U.S. Appl. No. 13/431,371.
Mar. 25, 2014 (US) Final Office Action issued in U.S. Appl. No. 12/732,457.
Mar. 27, 2014 (US) Notice of Allowance issued in U.S. Appl. No. 13/240,266.
Apr. 1, 2014 (JP) Office Action issued in Japanese Patent Application No. 2013-035990.
Apr. 2, 2014 (CN) Office Action issued in Chinese Patent Application No. 201210070968.
Apr. 10, 2014 (CN) Office Action issued in Chinese Application No. 201010150109.
Apr. 11, 2014 (US) Notice of Allowance issued in U.S. Appl. No. 12/644,572.
Apr. 14, 2014 (AU) Office Action issued in Australian Patent Application No. 2009332345.
Apr. 17, 2014 (RU) Office Action issued in Russian Patent Application No. 2011143817.
Apr. 25, 2014 (MX) Mexican Office Action issued in Mexican Application No. MX/a/2011/013553.
May 6, 2014 (CN) Chinese Office Action issued in Chinese Application No. 201010150878.5.
May 6, 2014 (CN) Chinese Office Action issued in Chinese Application No. 20101050087.2.
May 6, 2014 (US) Notice of Allowance issued in U.S. Appl. No. 13/934,512.
May 9, 2014 (VN) Office Action issued in Vietnamese Patent Application No. 1-2011-02491.
May 13, 2014 (CN) Chinese Office Action issued in Chinese Application No. 201080013339.5.
May 21, 2014 (EP) Extended European Search Report issued in European Application No. 10758552.3.
May 22, 2014 (US) Non-Final Office Action issued in U.S. Appl. No. 14/226,256.
Jun. 2, 2014 (AU) Office action issued in Australian Patent Application No. 2010231425.
Jun. 10, 2014 (JP) Japanese Office Action issued Japanese Application No. 2013-142488.
Jun. 20, 2014 (CN) Office action issued in Chinese Patent Application No. 201210070147.
Jun. 24, 2014 (JP) Japanese Office Action issued Japanese Application No. 2013-153250.
Jun. 24, 2014 (JP) Japanese Office Action issued Japanese Application No. 2013-153340.
Jun. 27, 2014 (AU) Office Action issued in Australian Patent Application No. 2010231426.
Jul. 7, 2014 (US) Final Office Action issued in U.S. Appl. No. 13/430,080.
Jul. 8, 2014 (CA) Office Action issued in Canadian Patent Application No. 2,755,882.
Jul. 8, 2014 (JP) Office Action issued in Japanese Patent Application No. 2013-153421.
Jul. 8, 2014 (JP) Office Action issued in Japanese Patent Application No. 2013-153495.
Jul. 18, 2014 (US) Office Action in Application No. 13431350.
Dec. 15, 2014—(US) Notice of Allowance—U.S. Appl. No. 13/240,216.
Dec. 15, 2014—(US) Non-Final Office Action—U.S. Appl. No. 14/226,259.
Jan. 2, 2015—(US) Non-Final Office Action—U.S. Appl. No. 14/226,262.
Jan. 5, 2015—(US) Non-final Office Action—U.S. Appl. No. 14/226,201.
Feb. 6, 2015—(EP) Extended Search Report—App. 14189221.6.
Jan. 23, 2015 (AU) Office Action in Application No. 2010231426.
Mar. 6, 2015 (AU) Office Action in Application No. 2010231425.
Mar. 10, 2015 (JP) Office Action in Application No. 2014-095027.
Mar. 12, 2015 (EP) Search Report in Application No. 14156840.2.
Feb. 19, 2014 (CA) Office Action in Application No. 2755885.
Mar. 2, 2015 (TW) Office Action in Application No. 101110368.
Apr. 10, 2014—(US) Non-Final Office Action—U.S. Appl. No. 13/430,080.
Apr. 9, 2015—(US) Notice of Allowance—U.S. Appl. No. 13/431,277.
Mar. 13, 2015 (US) Notice of Allowance in U.S. Appl. No. 14/226,165.
Mar. 23, 2015 (US) Notice of Allowance in U.S. Appl. No. 13/934,512.
Apr. 15, 2014—(US) Notice of Allowance—U.S. Appl. No. 13/240,266.

(56) References Cited

OTHER PUBLICATIONS

Apr. 9, 2015—(US) Non-Final Office Action—U.S. Appl. No. 14/641,681.
Apr. 17, 2015—(US) Final Office Action—U.S. Appl. No. 14/226,367.
Apr. 21, 2015—(US) Final Office Action—U.S. Appl. No. 14/226,428.
May 1, 2015—(US) Notice of Allowance—U.S. Appl. No. 12/644,572.
May 6, 2015—(US) Final Office Action—U.S. Appl. No. 14/226,259.
May 6, 2015—(US) Final Office Action—U.S. Appl. No. 14/226,373.
Apr. 20, 2014 (AU) Office Action in Application No. 2010231426.
Apr. 7, 2014 (TW) Office Action in Application No. 99132600.
Apr. 2, 2015 (EP) Office Action in Application No. 10711776.4.
Jun. 25, 2015—(US) Non-Final Office Action—U.S. Appl. No. 13/431,350.
May 29, 2015—(MY) Substantive Examination Adverse Report—App. PI 2013702520—Eng Tran.
Jun. 1, 2015—(CN) Notification of First Office Action—App 201310717842.4—Eng Tran.
Jun. 1, 2015—(CN) Notification of First Office Action—App 201310717871.0—Eng Tran.
Jul. 7, 2015—(US) Notice of Allowance—U.S. Appl. No. 14/141,673.
Jul. 16, 2015—(US) Non-Final Office Action—U.S. Appl. No. 14/226,417.
Jun. 19, 2015 (CN) Notification of First Office Action—App 201310659875.8—Eng Tran.
Aug. 4, 2015—(US) Notice of Allowance—U.S. Appl. No. 14/141,576.
Jul. 31, 2015—(US) Final Office Action—U.S. Appl. No. 14/226,411.
Apr. 2, 2013 (JP) Office Action issued in Japanese Patent Application No. 2009-156357.
Apr. 2, 2013 (JP) Office Action issued in Japanese Patent Application No. 2009-156371.
Apr. 2, 2013 (JP) Office Action issued in Japanese Patent Application No. 2009-156398.
Apr. 2, 2013 (JP) Office Action issued in Japanese Patent Application No. 2009-156403.
Apr. 2, 2013 (JP) Office Action issued in Japanese Patent Application No. 2009-270325.
Apr. 8, 2013 (EP) European Search Report issued in European Patent Application No. 09852278.2.
Apr. 15, 2013 (CN) Office Action issued in Chinese Patent Application No. 201080013099.9.
Apr. 19, 2013 (CN) Office Action issued in Chinese Patent Application No. 200910262678.6.
Apr. 23, 2013 (JP) Office Action issued in Japanese Patent Application No. 2010-73748.
Apr. 23, 2013 (JP) Office Action issued in Japanese Patent Application No. 2010-73750.
Apr. 23, 2013 (US) Office Action in Application No. 13430080.
Apr. 26, 2013 (CN)Office Action issued in Chinese Patent Application No. 200910262676.7.
Apr. 26, 2013 (US) Office Action in U.S. Appl. No. 13/755,174.
May 2, 2013 (CN) Office Action issued in Chinese Patent Application No. 200910262677.1.
May 2, 2013 (CN) Office Action issued in Chinese Patent Application No. 200910262679.0.
May 2, 2013 (CN) Office Action issued in Chinese Patent Application No. 200910262680.3.
May 7, 2013 (US) Office Action in U.S. Appl. No. 12/732,404.
May 14, 2013 (JP) Office Action issued in Japanese Patent Application No. 2010-073747.
May 14, 2013 (US) Office Action in U.S. Appl. No. 13/431,350.
May 14, 2013 (US) Office Action in U.S. Appl. No. 13/431,371.
May 21, 2013 (JP) Office Action issued in Japanese Patent Application No. 2009-154698.
May 21, 2013 (JP) Office Action issued in Japanese Patent Application No. 2009-154699.
May 21, 2013 (JP) Office Action issued in Japanese Patent Application No. 2010-073749.
May 21, 2013 (JP) Office Action issued in Japanese Patent Application No. 2010-073755.
May 21, 2013 (US) Office Action in U.S. Appl. No. 12/732,257.
May 21, 2013 (US) Office Action in U.S. Appl. No. 12/732,828.
May 22, 2013 (US) Office Action in U.S. Appl. No. 12/644,413.
May 22, 2013 (US) Office Action in U.S. Appl. No. 12/873,633.
May 28, 2013 (JP) Office Action issued in Japanese Patent Application No. 2010-073751.
May 30, 2013 (US) Office Action in U.S. Appl. No. 12/732,247.
Jun. 4, 2013 (CN) Office Action issued in Chinese Patent Application No. 200980161443.6.
Jun. 4, 2013 (JP) Office Action issued in Japanese Patent Application No. 2010-073754.
Jun. 19, 2013 (US) Office Action in U.S. Appl. No. 12/644,373.
Jul. 2, 2013 (JP) Office Action issued in Japanese Patent Application No. 2009-156281.
Jul. 2, 2013 (JP) Office Action issued in Japanese Patent Application No. 2009-156350.
Jul. 10, 2013 (NZ) (Office Action issued in New Zealand Patent Application No. 596044.
Jul. 16, 2013 (US) Office Action issued in U.S. Appl. No. 12/817,556.
Aug. 1, 2013 (US) Office Action in U.S. Appl. No. 12/732,747.
Aug. 7, 2013 (CN) Office Action issued in Chinese Patent Application No. 200910262675.2.
Aug. 9, 2013 (US) Office Action in U.S. Appl. No. 13/431,350.
Aug. 22, 2013 (CN) Office Action issued in Chinese Patent Application No. 201080013339.5.
Aug. 27, 2013 (US) Office Action in U.S. Appl. No. 12/644,451.
Aug. 27, 2013 (US) Office Action in U.S. Appl. No. 12/644,572.
Sep. 3, 2013 (CN) Office Action issued in Chinese Patent Application No. 201010150928.X.
Sep. 3, 2013 (JP) Office Action issued in Japanese Patent Application No. 2011507143.
Sep. 9, 2013 (US) Office Action issued in U.S. Appl. No. 12/732,404.
Sep. 11, 2013 (US) Office Action in U.S. Appl. No. 13/430,080.
Sep. 12, 2013 (US) Office Action in U.S. Appl. No. 12/732,457.
Sep. 12, 2013 (US) Office Action in U.S. Appl. No. 12/732,828.
Sep. 17, 2013 (US) Office Action in U.S. Appl. No. 12/732,647.
Sep. 22, 2013 (CN) Office Action issued in Chinese Patent Application No. 201010150109.5.
Sep. 25, 2013 (NZ) Office Action issued in New Zealand Patent Application No. 596044.
Sep. 26, 2013 (CN) Office Action issued in Chinese Patent Application No. 201010150090.4.
Sep. 30, 2013 (CN) Office Action issued in Chinese Patent Application No. 201010150088.7.
Oct. 1, 2013 (JP) Office Action issued in Japanese Patent Application No. 2011547222.
Oct. 16, 2013 (US) Non-Final Office Action issued in corresponding U.S. Appl. No. 13/240,266.
Oct. 28, 2013 (CN) Office Action issued in Chinese Patent Application No. 200980158165.9.
Nov. 1, 2013 (CN) Office Action Issued in Chinese Patent Application No. 200980161405.0.
Nov. 6, 2013 (EP) European Search Report issued in European Patent Application No. 09842716.4.
Nov. 8, 2013 (NZ) Office Action issued in New Zealand Patent Application No. 596044.
Nov. 23, 2013 (EP) European Search Report issued in European Patent Application No. 10758310.6.
Nov. 13, 2013 (US) Office Action issued in corresponding U.S. Appl. No. 13/240,216.
Nov. 19, 2013 (US) Office Action issued in corresponding U.S. Appl. No. 13/934,512.
Dec. 3, 2013 (JP) Office Action issued in Japanese Patent Application No. 2011-507049.

(56) References Cited

OTHER PUBLICATIONS

Dec. 16, 2013 (EP) Extended European Search Report in European Patent Application No. 12160324.5.
Dec. 18, 2013 (EP) Extended European Search Report in European Patent Application No. 12160192.6.
Dec. 19, 2013 (CN) Office Action issued in Chinese Patent Application No. 200910262674.8.
Dec. 20, 2013 (EP) Extended European Search Report issued in European Patent Application No. 12161271.7.
Dec. 13, 2013 (US) Final Office Action issued in U.S. Appl. No. 13/431,350.
Dec. 30, 2013 (CN) Office Action issued in Chinese Application No. 201010209208.6.
Dec. 13, 2013 (CN) Office Action issued in Chinese Patent Application No. 201210070147.9.
Aug. 12, 2014—(CN) Notice of Second Office Action—App 201210071810.7—Eng Tran.
Aug. 26, 2014—(CN) Notice of Second Office Action—App 201010274378.2—Eng Tran.
Aug. 28, 2014—(US) Non-Final Office Action—U.S. Appl. No. 13/240,216.
Dec. 5, 2014—(US) Non-Final Office Action—U.S. Appl. No. 14/226,325.
Dec. 1, 2014—(US) Non-Final Office Action—U.S. Appl. No. 14/226,289.
Feb. 4, 2014 (US) Notice of Allowance issued in U.S. Appl. No. 12/732,404.
Feb. 19, 2014 (US) Notice of Allowance issued in U.S. Appl. No. 12/732,747.
Feb. 24, 2014 (US) Notice of Allowance issued in U.S. Appl. No. 12/644,451.
Jan. 27, 2014 (US) Notice of Allowance issued in U.S. Appl. No. 12/732,828.
Jul. 22, 2014 (US) Office Action in U.S. Appl. No. 12/732,257.
Jul. 25, 2014—(CN) Notice of Second Office Action—App 201010150090.4—Eng Tran.
Jul. 28, 2014—(CN) Notice of Second Office Action—App 20101050088.7—Eng Tran.
Jun. 26, 2014—(CN) Office Action—App 200980161405.
Nov. 4, 2014—(US) Non-Final Office Action—U.S. Appl. No. 14/226,367.
Nov. 4, 2014—(US) Non-Final Office Action—U.S. Appl. No. 14/226,428.
Nov. 5, 2014—(US) Non-Final Office Action—U.S. Appl. No. 14/226,373.
Nov. 25, 2014—(US) Notice of Allowance—U.S. Appl. No. 13/934,512.
Oct. 2, 2014—(US) Non-Final Office Action—U.S. Appl. No. 13/430,033.
Oct. 10, 2014—(US) Notice of Allowance—U.S. Appl. No. 12/732,457.
Oct. 27, 2014—(US) Non-Final Office Action—U.S. Appl. No. 14/141,576.
Oct. 30, 2014 (US) Final Office Action U.S. Appl. No. 14/226,256.
Sep. 2, 2014—(US) Non-Final Office Action—U.S. Appl. No. 14/226,165.
Sep. 8, 2014—(US) Non-Final Office Action—U.S. Appl. No. 14/226,380.
Sep. 9, 2014—(US) Non-Final Office Action—U.S. Appl. No. 14/226,417.
Sep. 10, 2014—(US) Notice of Allowance—U.S. Appl. No. 13/934,512.
Sep. 11, 2014—(US) Non-Final Office Action—U.S. Appl. No. 13/848,750.
Sep. 12, 2014—(US) Final Office Action—U.S. Appl. No. 13/431,371.
Sep. 12, 2014—(US) Non-Final Office Action—U.S. Appl. No. 14/226,386.
Sep. 22, 2014—(US) Non-Final Office Action—U.S. Appl. No. 14/141,673.
May 19, 2010—(US) Notice of Allowance—U.S. Appl. No. 14/226,201.
May 19, 2015—(US) Final Office Action—U.S. Appl. No. 14/226,289.
May 20, 2015—(US) Notice of Allowance—U.S. Appl. No. 13/848,750.
May 22, 2015—(US) Non-Final Office Action—U.S. Appl. No. 12/732,257.
May 29, 2015—(US) Notice of Allowance—U.S. Appl. No. 14/226,165.
Jun. 2, 2015—(US) Final Office Action—U.S. Appl. No. 14/226,262.
Jun. 5, 2015—(US) Notice of Allowance—U.S. Appl. No. 14/226,380.
Jun. 2, 2015—(US) Non-Final Office Action—U.S. Appl. No. 14/226,256.
Jun. 17, 2015—(US) Final Office Action—U.S. Appl. No. 14/226,325.
Jun. 18, 2015—(US) Notice of Allowance—U.S. Appl. No. 12/732,457.
May 7, 2014 (US) Final Office Action issued in U.S. Appl. No. 13/240,216.
Jul. 16, 2013 (US) Office Action in U.S. Appl. No. 12/817,556.
Jan. 22, 2015—(US) Notice of Allowance—U.S. Appl. No. 12/732,457.
Jan. 16, 2015—(US) Non-Final Office Action—U.S. Appl. No. 14/226,402.
Jan. 20, 2015—(US) Non-Final Office Action—U.S. Appl. No. 13/431,371.
Jan. 28, 2015—(US) Notice of Allowance—U.S. Appl. No. 13/431,277.
Nov. 12, 2014 (MX) Office Action in Application No. MX/a/2011/013553.
Dec. 26, 2014—(CN) Office Action in Application No. 201080013339.5.
Jan. 22, 2015—(US) Non-Final Office Action—U.S. Appl. No. 14/226,411.
Feb. 10, 2015—(US) Notice of Allowance—U.S. Appl. No. 14/226,380.
Feb. 12, 2015—(US) Final Office Action—U.S. Appl. No. 12/732,257.
Feb. 12, 2015—(US) Final Office Action—U.S. Appl. No. 13/431,350.
Feb. 12, 2015—(US) Final Office Action—U.S. Appl. No. 14/226,417.
Feb. 13, 2015—(US) Non-Final Office Action—U.S. Appl. No. 13/240,322.
Feb. 17, 2015—(US) Final Office Action—U.S. Appl. No. 14/141,673.
Mar. 4, 2015—(US) Final Office Action—U.S. Appl. No. 14/141,576.
Mar. 4, 2015—(US) Non-Final Office Action—U.S. Appl. No. 14/226,386.
Mar. 6, 2015—(US) Final Office Action—U.S. Appl. No. 14/226,424.
Mar. 17, 2015—(US) Notice of Allowance—U.S. Appl. No. 13/848,750.
Apr. 1, 2015—(US) Notice of Allowance—U.S. Appl. No. 12/732,457.
Apr. 1, 2015—(US) Notice of Allowance—U.S. Appl. No. 13/430,033.
Jan. 29, 2015—(TW) Office Action—App 099132599.
Mar. 30, 2012 (US) Office Action issued in U.S. Appl. No. 12644451.
Apr. 11, 2012 (PCT) International Preliminary Report on Patentability issued in PCT/JP2010/055310.
Apr. 11, 2012 (US) Office Action in U.S. Appl. No. 12/644,572.
May 8, 2012 (JP) Office Action issued in Japanese Patent Application No. 2009-086239.
May 10, 2012 (US) Office Action in U.S. Appl. No. 13/431,371.
May 22, 2015 (JP) Japanese Office Action issued in Japanese Patent Application No. 2010-041323.
Jun. 4, 2012 (US) Office Action in U.S. Appl. No. 13/431,350.
Jun. 6, 2012 (US) Office Action in U.S. Appl. No. 12/732,747.
Jun. 8, 2012 (US) Office Action in U.S. Appl. No. 13/431,277.

(56) References Cited

OTHER PUBLICATIONS

Jun. 12, 2012 (JP) Office Action issued in Japanese Patent Application No. 2009-086222.
Jun. 12, 2012 (JP) Office Action issued in Japanese Patent Application No. 2010-084499.
Jun. 12, 2012 (US) Office Action in U.S. Appl. No. 12/732,828.
Jun. 15, 2012 (US) Office Action in U.S. Appl. No. 12/732,404.
Jul. 3, 2012 (JP) Office Action issued in Japanese Patent Application No. 2010-084500.
Jul. 3, 2012 (JP) Office Action issued in Japanese Patent Application No. 2010-084501.
Jul. 3, 2012 (JP) Office Action issued in Japanese Patent Application No. 2010-084502.
Jul. 10, 2012 (PCT) International Preliminary Report on Patentability issued in PCT/JP2009/070971.
Jul. 13, 2012 (US) Office Action in U.S. Appl. No. 12/644,413.
Jul. 20, 2012 (US) Office Action in U.S. Appl. No. 12/817,556.
Jul. 30, 2012 (US) Office Action in U.S. Appl. No. 12/732,247.
Aug. 3, 2012 (US) Office Action in U.S. Appl. No. 12/644,373.
Aug. 14, 2012 (PCT) International Preliminary Report on Patentability issued in PCT/JP2009/071812.
Aug. 27, 2012 (US) Office Action in U.S. Appl. No. 12/644,572.
Aug. 28, 2012 (US) Office Action in U.S. Appl. No. 12/644,451.
Aug. 28, 2012 (US) Office Action in U.S. Appl. No. 12/732,257.
Aug. 28, 2012 (US) Office Action in U.S. Appl. No. 12/732,457.
Aug. 30, 2012 (US) Office Action in U.S. Appl. No. 12/732,647.
Sep. 6, 2012 (EP) European Communication issued in European Patent Application No. 10711477.9.
Sep. 11, 2012 (JP) Office Action issued in Japanese Patent Application No. 2009-086172.
Sep. 11, 2012 (JP) Office Action issued in Japanese Patent Application No. 2009-088449.
Sep. 28, 2012 (NZ) Examination Report issued in New Zealand Patent Application No. 596044.
Oct. 16, 2012 (US) Office Action in U.S. Appl. No. 12/873,633.
Oct. 23, 2012 (US) Office Action in U.S. Appl. No. 12/732,404.
Nov. 13, 2012 (JP) Office Action issued in Japanese Patent Application No. 2009-270056.
Nov. 13, 2012 (JP) Office Action issued in Japanese Patent Application No. 2009-297502.
Dec. 18, 2012 (JP) Office Action issued in Japanese Patent Application No. 2009-156369.
Nov. 22, 2013 (EP) Office Action issued in European Patent Application No. 10711776.4.
Nov. 26, 2013 (JP) Office Action issued in Japanese Patent Application No. 2011-507142.
Jan. 17, 2013 (US) Office Action in U.S. Appl. No. 12/732,747.
Jan. 22, 2013 (US) Office Action in U.S. Appl. No. 12/732,247.
Jan. 29, 2013 (JP) Office Action issued in Japanese Patent Application No. 2011-506968.
Jan. 30, 2013 (US) Office Action in U.S. App. No. 13/431,277.
Feb. 28, 2013 (US) Office Action in U.S. Appl. No. 12/817,556.
Mar. 1, 2013 (US) Office Action in U.S. Appl. No. 12/732,647.
Mar. 8, 2013 (CN) Office Action issued in Chinese Patent Application No. 200980158165.9.
Apr. 2, 2013 (JP) Office Action issued in Japanese Patent Application No. 2009-156399.
Apr. 2, 2013 (JP) Office Action issued in Japanese Patent Application No. 2009-156404.
Apr. 2, 2013 (JP) Office Action issued in Japanese Patent Application No. 2009-156281.
Apr. 2, 2013 (JP) Office Action issued in Japanese Patent Application No. 2009-156350.
Apr. 2, 2013 (JP) Office Action issued in Japanese Patent Application No. 2009-156355.
Nov. 9, 2015'(US) Notice of Allowance—U.S. Appl. No. 13/848,750.
Nov. 13, 2015—(US) Non-Final Office Action—U.S. Appl. No. 14/226,289.
Nov. 25, 2015—(US) Final Office Action—U.S. Appl. No. 14/226,256.
Nov. 27, 2015—(US) Notice of Allowance—U.S. Appl. No. 14/226,367.
Dec. 4, 2015—(US) Notice of Allowance—U.S. Appl. No. 14/226,325.
Dec. 10, 2015—(US) Non-Final Office Action—U.S. Appl. No. 14/755,141.
Nov. 20, 2015—(KR) Office Action—App 10-2015-7006347.
Nov. 20, 2015—(KR) Office Action—App 10-2011-7017238.
Dec. 11, 2015—(US) Notice of Allowance—U.S. Appl. No. 14/226,165.
Dec. 17, 2015—(US) Non-Final Office Action—U.S. Appl. No. 14/920,398.
Dec. 21, 2015—(US) Notice of Allowance—U.S. Appl. No. 13/934,512.
Dec. 23, 2015—(US) Final Office Action—U.S. Appl. No. 14/226,417.
Oct. 27, 2015—(CN) Office Action—App 201410195767.4.
Dec. 24, 2015—(US) Non-Final Office Action—U.S. Appl. No. 14/226,380.
Nov. 27, 2015—(CN) Office Action—App 201410311930.9.
Dec. 3, 2015—(CN) Office Action—App 201510088644.5.
Jan. 12, 2016—(US) Notice of Allowance—U.S. Appl. No. 13/431,371.
Jan. 15, 2016—(US) Notice of Allowance—U.S. Appl. No. 12/732,257.
Jan. 29, 2016—(US) Notice of Allowance—U.S. Appl. No. 14/226,411.
Dec. 24, 2015—(TW) Decision of Rejection—App 101110368—Eng Tran.
Feb. 5, 2016—(US) Non-Final Office Action—U.S. Appl. No. 13/240,322.
Sep. 17, 2015—(US) Non-Final Office Action—U.S. Appl. No. 14/226,424.
Sep. 18, 2015—(US) Non-Final Office Action—U.S. Appl. No. 14/226,428.
Oct. 1, 2015—(US) Notice of Allowance—U.S. Appl. No. 12/732,457.
Oct. 5, 2015—(US) Notice of Allowance—U.S. Appl. No. 12/644,572.
Oct. 5, 2015—(US) Notice of Allowance—U.S. Appl. No. 14/141,673.
Oct. 7, 2015—(US)—Final Office Action—U.S. Appl. No. 13/240,322.
Oct. 13, 2015—(US) Notice of Allowance—U.S. Appl. No. 13/430,033.
Oct. 20, 2015—(US) Notice of Allowance—U.S. Appl. No. 14/226,201.
Oct. 22, 2015—(US) Final Office Action—U.S. Appl. No. 14/641,681.
Sep. 2, 2015—(CN) Notification of First Office Action—App 201410200475.5.
Oct. 23, 2015—(US) Final Office Action—U.S. Appl. No. 13/431,350.
Oct. 30, 2015—(US)—Non-Final Office Action—U.S. Appl. No. 14/226,373.
Nov. 3, 2015—(US) Notice of Allowance—U.S. Appl. No. 14/226,259.

* cited by examiner

TAPE CASSETTE

CROSS-REFERENCE TO RELATED APPLICATION

This application is a Continuing Application of U.S. Ser. No. 13/240,216, filed on Sep. 22, 2011, which is a bypass continuation of International Application No. PCT/JP2009/071568, filed Dec. 25, 2009, which claims priority from Japanese Patent Application Nos. 2009-086172, 2009-086184, 2009-086201, and 2009-086222, all of which having been filed on Mar. 31, 2009. The disclosure of the foregoing applications is hereby incorporated by reference in their entirety.

BACKGROUND

The present invention relates to a tape cassette that can be mounted in and removed from a tape printer.

A tape cassette is known that is configured such that it can be mounted in and removed from a tape printer and that has a recessed portion for accepting a platen of the tape printer. An image-receiving tape on which printing is performed is guided such that it passes by the recessed portion. The image-receiving tape that passes by the recessed portion is exposed to the outside on the front face of the tape cassette.

SUMMARY

However, in a case where a person manipulates the position of the tape cassette that is described above, if another object touches the tape that is exposed to the outside, a problem may occur in that the tape goes slack.

Various embodiments of the general principles herein provide a tape cassette that, in a case where a person manipulates the position of the tape cassette, prevents the tape from going slack if another object touches the tape that is exposed to the outside.

Embodiments herein provide a tape cassette that includes a cassette case, a tape roll, a tape feed roller, and a head insertion portion. The cassette case has a top face, a bottom face, a front face, a rear face, a pair of side faces and a connecting face. Each of the pair of side faces has a length in a front-rear direction that is shorter than a length of the cassette case in a left-right direction. The pair of side faces includes a left side face and a right side face that are opposed to each other. The first line is a virtual straight line on a same plane with the bottom face and is an extension of a right edge of the bottom face. The second line is a virtual straight line on the same plane with the bottom face and is an extension of a rear edge of the bottom face. The first portion is a rearmost end of a right edge of the cassette case and is located on a front side of an intersection between the first line and the second line. The second portion is a rightmost end of a rear edge of the cassette case and is located on a left side of the intersection. The connecting face is a plane that extends from the top face to the bottom face and connects the first portion and the second portion. The tape roll includes a tape provided inside the cassette case. The tape feed roller is provided on a right side of the left side face and is provided in a front left corner portion. The head insertion portion is configured such that a head of a printer is inserted thereinto. The head insertion portion is an opening that is formed on a right side of the tape feed roller and extends from the bottom face toward the top face. At least one third line passes through the head insertion portion. The at least one third line is a virtual straight line that is orthogonal to the connecting face.

Embodiments herein also provide a tape cassette that includes a cassette case, a tape roll, and a tape feed roller. The cassette case has a top face, a bottom face, a front face, a rear face, a pair of side faces and a connecting face. Each of the pair of side faces has a length in a front-rear direction that is shorter than a length of the cassette case in a left-right direction. The pair of side faces includes a left side face and a right side face that are opposed to each other. The first line is a virtual straight line on a same plane with the bottom face and is an extension of a right edge of the bottom face. The second line is a virtual straight line on the same plane with the bottom face and is an extension of a rear edge of the bottom face. The first portion is a rearmost end of a right edge of the cassette case and is located on a front side of an intersection between the first line and the second line. The second portion is a rightmost end of a rear edge of the cassette case and is located on a left side of the intersection. The connecting face is a plane that extends from the top face to the bottom face and connects the first portion and the second portion. The tape roll includes a tape provided inside the cassette case. The tape feed roller is provided on a right side of the left side face and is provided in a front left corner portion. At least one third line passes through the tape feed roller. The at least one third line is a virtual straight line that is orthogonal to at least one fourth line. The at least one fourth line is a virtual straight line that extends generally parallel to the bottom face outside the cassette case and contacts a connecting portion at a point. The connecting portion is an edge of the connecting face that connects to the right side face.

Embodiments herein also provide a tape cassette that includes a cassette case, a tape roll, a tape feed roller, a first recessed portion, and a second recessed portion. The cassette case has a top face, a bottom face, a front face, a rear face, and a pair of side faces. Each of the pair of side faces has a length in a front-rear direction that is shorter than a length of the cassette case in a left-right direction. The pair of side faces includes a left side face and a right side face that are opposed to each other. The first line is a virtual straight line on a same plane with the bottom face and is an extension of a right edge of the bottom face. The second line is another virtual straight line on the same plane with the bottom face and is an extension of a rear edge of the bottom face. The first portion is a rearmost end of a right edge of the cassette case and is located on a front side of an intersection between the first line and the second line. The second portion is a rightmost end of a rear edge of the cassette case and is located on a left side of the intersection. The tape roll includes a tape provided inside the cassette case. The tape feed roller is provided on a right side of the left side face and is provided in a first corner portion. The first recessed portion is formed in the left side face. The first recessed portion is provided in the first corner portion. The first recessed portion is recessed toward the right side face and extends from the top face to the bottom face. The second recessed portion is disposed in a diagonally opposite position in the cassette case from the first corner portion and is formed by a connecting face that connects the first portion and the second portion. The connecting face extends from the top face to the bottom face and is at least partly protruded in the opposite direction to the tape roll further than a virtual plane. The virtual plane connects the first portion and the second portion and is orthogonal to the same plane with the bottom face.

BRIEF DESCRIPTION OF THE DRAWINGS

Embodiments will be described below in detail with reference to the accompanying drawings in which.

DETAILED DESCRIPTION

Embodiments of the present disclosure will be explained with reference to the drawings. Note that the referenced drawings are merely explanatory examples that are used for explaining the technical features that the present disclosure can employ.

A tape printer 1 and a tape cassette 30 according to an embodiment will hereinafter be described with reference to FIGS. 1 to 25. In the explanation that follows, the lower right side, the upper left side, the upper right side, and the lower left side in FIG. 1 respectively correspond to the front side, the rear side, the right side, and the left side of the tape printer 1.

Figure 3:
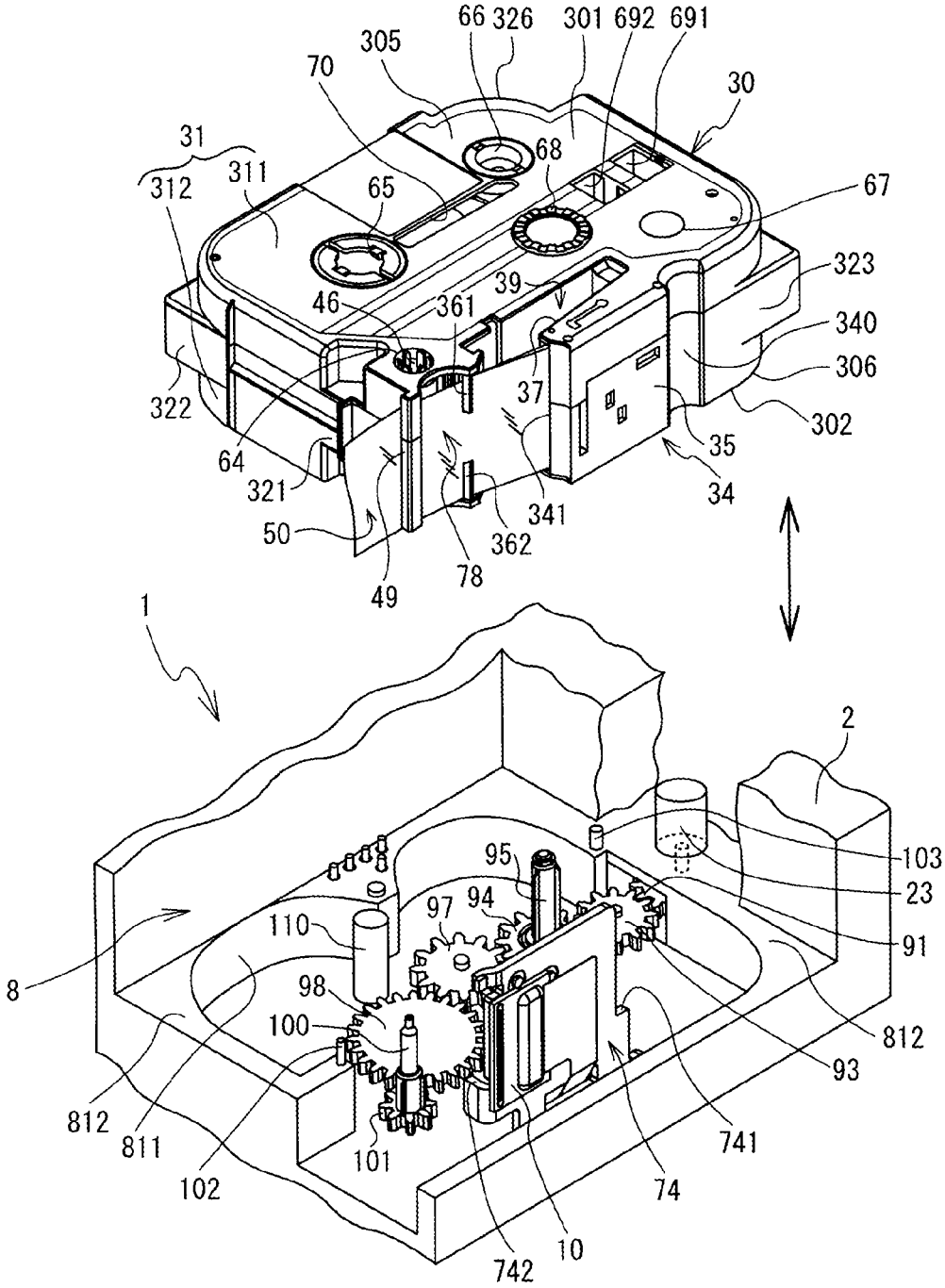
FIG. 3 is an oblique view for explaining a tape cassette 30 and a cassette mounting portion 8.
Figure 4:
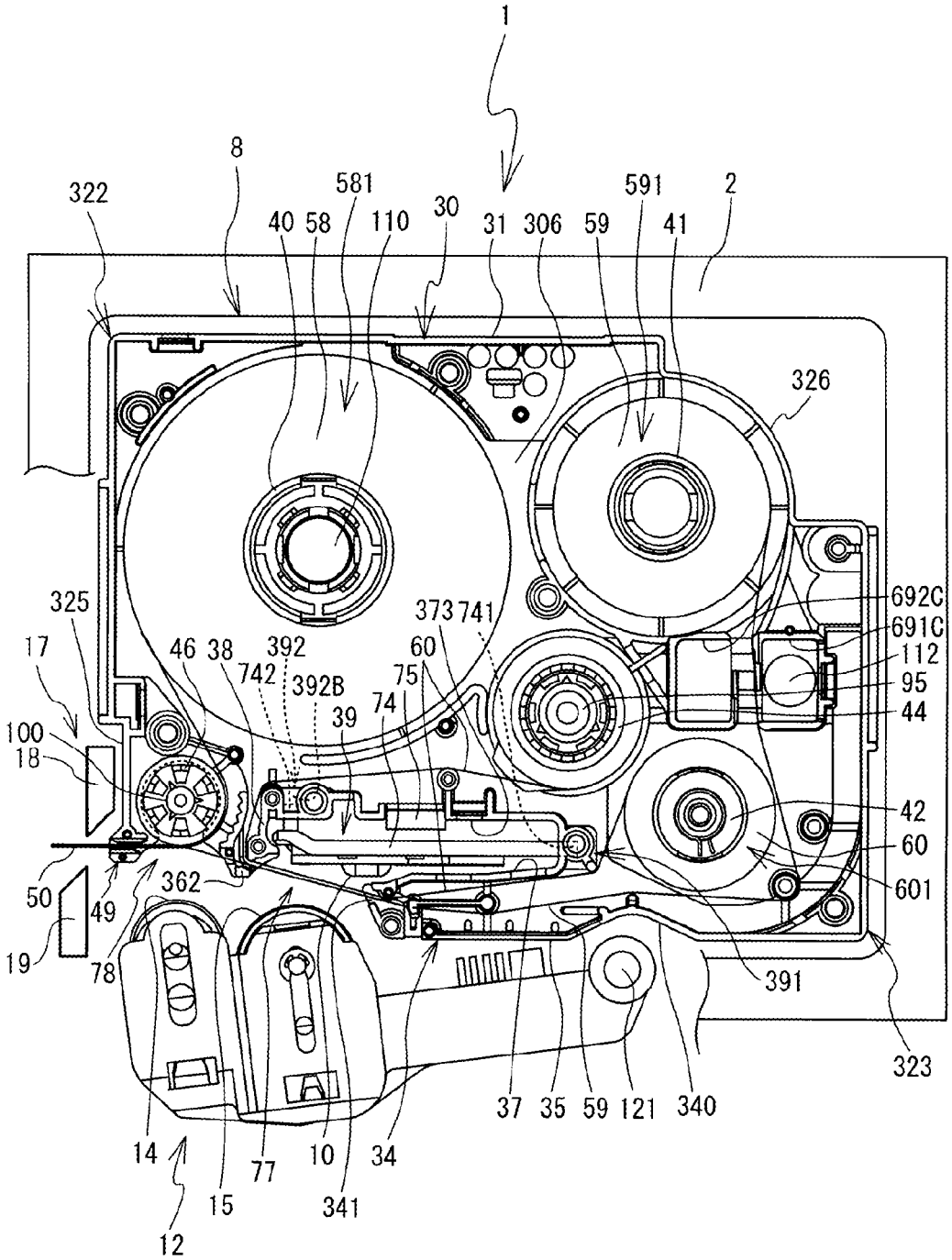
FIG. 4 is a plan view of the cassette mounting portion 8, in which a laminated type of the tape cassette 30 has been mounted, in a case where a platen holder 12 is in a stand-by position.

Note that in FIG. 3, FIG. 4, and the like that are used in the explanation that follows, in a case where walls are shown that form a perimeter of a cassette mounting portion 8, the walls are shown in the drawings as being thicker than they actually are, because the drawings are simply schematic drawings. Furthermore, a gear train that includes gears 91, 93, 94, 97, 98, and 101 and that is shown in FIG. 3, which is an oblique view that shows the tape cassette 30 and the cassette mounting portion 8, is actually covered up by a bottom face of a cavity 811. However, the bottom face of the cavity 811 is not shown in the drawings because the gear train can be explained. Furthermore, in FIGS. 4 to 7 and the like, the tape cassette 30 that is shown in a state in which it has been mounted in the cassette mounting portion 8 is shown in a state in which a top case 311 has been removed.

First, an overview of the configuration of the tape printer 1 will be explained. The tape printer 1 is a general-purpose tape printer in which various types of tape cassettes can be used, such as a thermal type, a receptor type, a laminated type, a laminated thermal type, and the like. Note that the thermal type is a type of tape cassette that contains only a thermal paper tape. The receptor type is a type of tape cassette that contains a printing tape and an ink ribbon. The laminated type is a type of tape cassette that contains a double-sided adhesive tape, a film tape, and an ink ribbon. The laminated thermal type is a type of tape cassette that contains a double-sided adhesive tape and a thermal paper tape.

Figure 1:
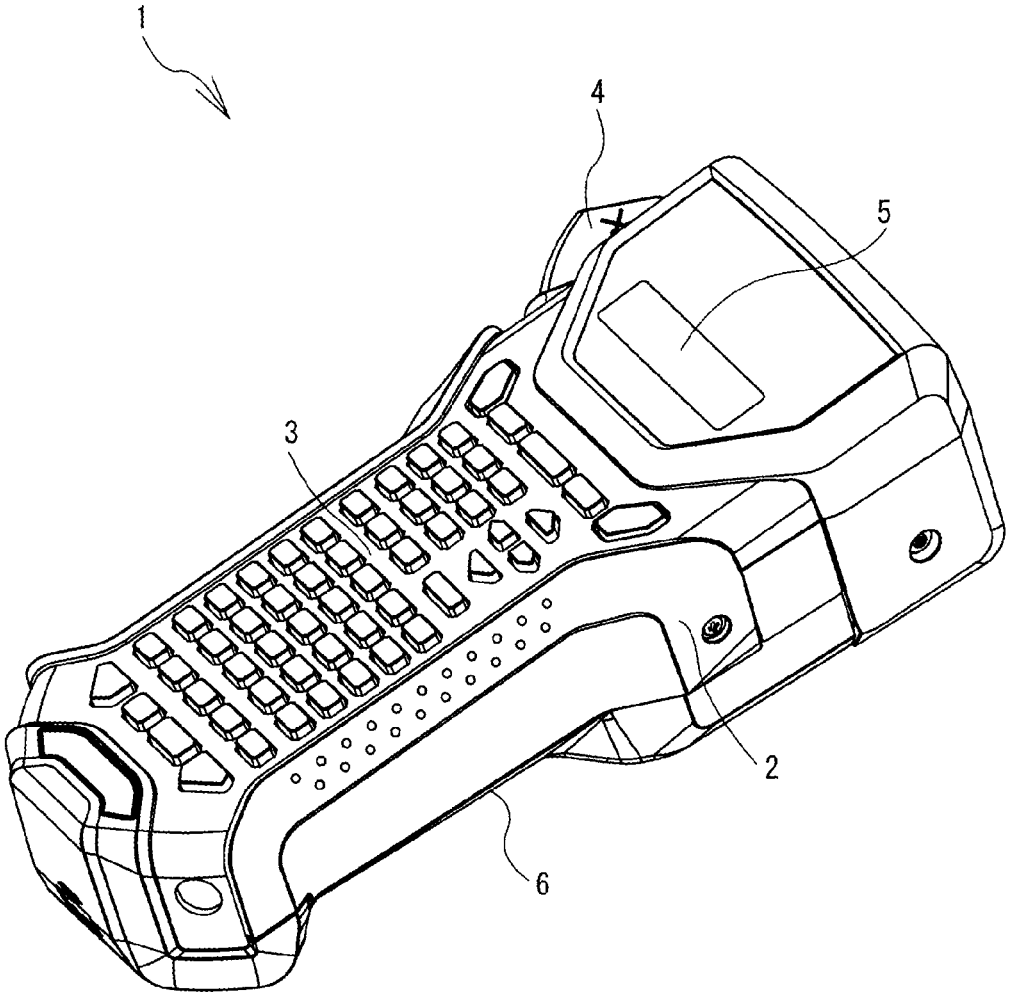
FIG. 1 is an oblique view from above of a tape printer 1 that is in a state in which a cassette cover 6 has been closed.

As shown in FIG. 1, the tape printer 1 is provided with a main body cover 2 that has a roughly rectangular shape. A display 5 for displaying printing data, a setting screen, and the like is provided in a right portion of the main body cover 2. A keyboard 3 that includes character keys for characters, symbols, numerals, and the like, as well as various types of function keys, is provided to the left of the display 5. A discharge slit 111 for discharging the printed tape to the outside is provided in a side face on the right end side of the tape printer 1 (refer to FIG. 2). A cut button 4 for cutting the printed tape across its width direction is provided in a right portion of the rear face of the tape printer 1. Note that in a case where a person operates the tape printer 1, the tape printer 1 is operated with its left side toward the operator.

For its part, the cassette mounting portion 8, which has a rectangular shape in a plan view, is provided in a right portion of the bottom face of the tape printer 1 and is formed as a recess into which and from which the tape cassette 30 of the present embodiment can be mounted and removed. A plurality of types of the tape cassette 30 for which the tape widths vary can be mounted in the cassette mounting portion 8. A battery container portion 13 for containing dry-cell batteries is provided adjacent to the left side of the cassette mounting portion 8. A cassette cover 6 (refer to FIG. 1) is removably attached to the bottom face side of the tape printer 1 that is provided with these portions.

Next, the cassette mounting portion 8 will be explained with reference to FIGS. 3 to 10. Note that in the explanation that follows, the lower right side, the upper left side, the upper right side, the lower left side, the top side, and the bottom side in FIG. 3 respectively correspond to the front side, the rear side, the right side, the left side, the top side, and the bottom side of the cassette mounting portion 8 and the tape cassette 30.

As shown in FIG. 3, the cassette mounting portion 8 includes the cavity 811 and a corner support portion 812. The cavity 811 is recessed and has a flat bottom face that is shaped such that, in a case where the tape cassette 30 has been mounted, it roughly corresponds to the shape of a bottom face 302 of a cassette case 31, which will be described later. The corner support portion 812 is a flat surface portion that extends horizontally from the outer edge of the cavity 811. In a case where the tape cassette 30 has been mounted in the cassette mounting portion 8, the corner support portion 812 is opposed to the bottom faces of first to third corner portions 321 to 323 of the tape cassette 30, and supports them.

Two positioning pins 102, 103 are provided in two locations on the corner support portion 812. Specifically, the positioning pin 102 is provided on the left side of the cavity 811, and the positioning pin 103 is provided on the right side of the cavity 811. The positioning pins 102, 103 are provided in positions that, when the tape cassette 30 has been mounted in the cassette mounting portion 8, respectively correspond to pin holes 62, 63 that are recessed portions that are formed in a bottom case 312 (refer to FIG. 14). When the tape cassette 30 has been mounted in the cassette mounting portion 8, the positioning pins 102, 103 are inserted into the pin holes 62, 63, respectively, and position the tape cassette 30 in the front-rear and left-right directions in the left and right positions of the perimeter portion of the tape cassette 30.

A head holder 74, on which a heating element (not shown in the drawings) is mounted on the head holder 74, is fixed in the front portion of the cassette mounting portion 8. A tape feed motor 23 that is a stepping motor is provided on the outside of the cassette mounting portion 8 (on the upper right side in FIG. 3). The gear 91 is affixed to the lower end of a drive shaft of the tape feed motor 23. The gear 91 meshes with the gear 93 through an opening. The gear 93 meshes with the gear 94. A ribbon winding shaft 95 that is adapted to perform rotational driving of a ribbon winding spool 44 that will be described later (refer to FIG. 4) is provided in a vertical orientation on a top face of the gear 94. A plurality of cam members 95A are provided on the ribbon winding shaft 95, extending from a base end side of the shaft toward a tip end side in a radiating pattern in a plan view (refer to FIG. 19). Further, the gear 94 meshes with the gear 97. The gear 97 meshes with the gear 98. The gear 98 meshes with the gear 101. A tape drive shaft 100 that is adapted to perform rotational driving of a tape drive roller 46 that will be described later (refer to FIG. 4) is provided in a vertical orientation on a top face of the gear 101. A plurality of cam members 100A are provided on the tape drive shaft 100, extending from a base end side of the shaft toward a tip end side in a radiating pattern in a plan view (refer to FIG. 19).

When the tape feed motor 23 rotationally drives the gear 91 in the counterclockwise direction with the tape cassette 30 in the state of having been mounted in the cassette mounting portion 8, the ribbon winding shaft 95 is rotationally driven in the counterclockwise direction through the gear 93 and the gear 94. The ribbon winding shaft 95 rotationally drives the ribbon winding spool 44, which is mounted on the ribbon winding shaft 95. Furthermore, the rotation of the gear 94 is transmitted to the tape drive shaft 100 through the gear 97, the gear 98, and the gear 101, and the tape drive shaft 100 is rotationally driven in the clockwise direction. The tape drive shaft 100 rotationally drives the tape drive roller 46, which is mounted on the tape drive shaft 100. A roughly cylindrical first auxiliary shaft 110 that may be inserted into and removed from a first tape support hole 65, which will be described later, is provided in a vertical orientation to the rear of the gear 98. In addition, a roughly cylindrical second auxiliary shaft 112 that may be inserted into and removed from a first rectangular hole 691, which will be described later, is provided in a vertical orientation on the bottom face of the cavity 811 to the right of the ribbon winding shaft 95 (refer to FIGS. 4 to 7). Therefore, the second auxiliary shaft 112 is not shown in FIG. 3.

As shown in FIGS. 4 to 7, in front of the head holder 74, an arm-shaped platen holder 12 is supported such that it can swing around a shaft support portion 121. On a tip end side of the platen holder 12, a platen roller 15, which is able to come into contact with and separate from the thermal head 10, and a movable feed roller 14, which is able to come into contact with and separate from the tape drive roller 46 that is mounted on the tape drive shaft 100, are rotatably supported.

The platen holder 12 may move in the front-rear direction in conjunction with the opening and closing of the cassette cover 6. When the cassette cover 6 has been opened, the platen holder 12 is constantly elastically urged toward a stand-by position that is shown in FIG. 4 by a coil spring that is not shown in the drawings. In the stand-by position that is shown in FIG. 4, the platen holder 12 has moved in a direction that has separated it from the cassette mounting portion 8, so the tape cassette 30 can be mounted in and removed from the cassette mounting portion 8.

Figure 5:
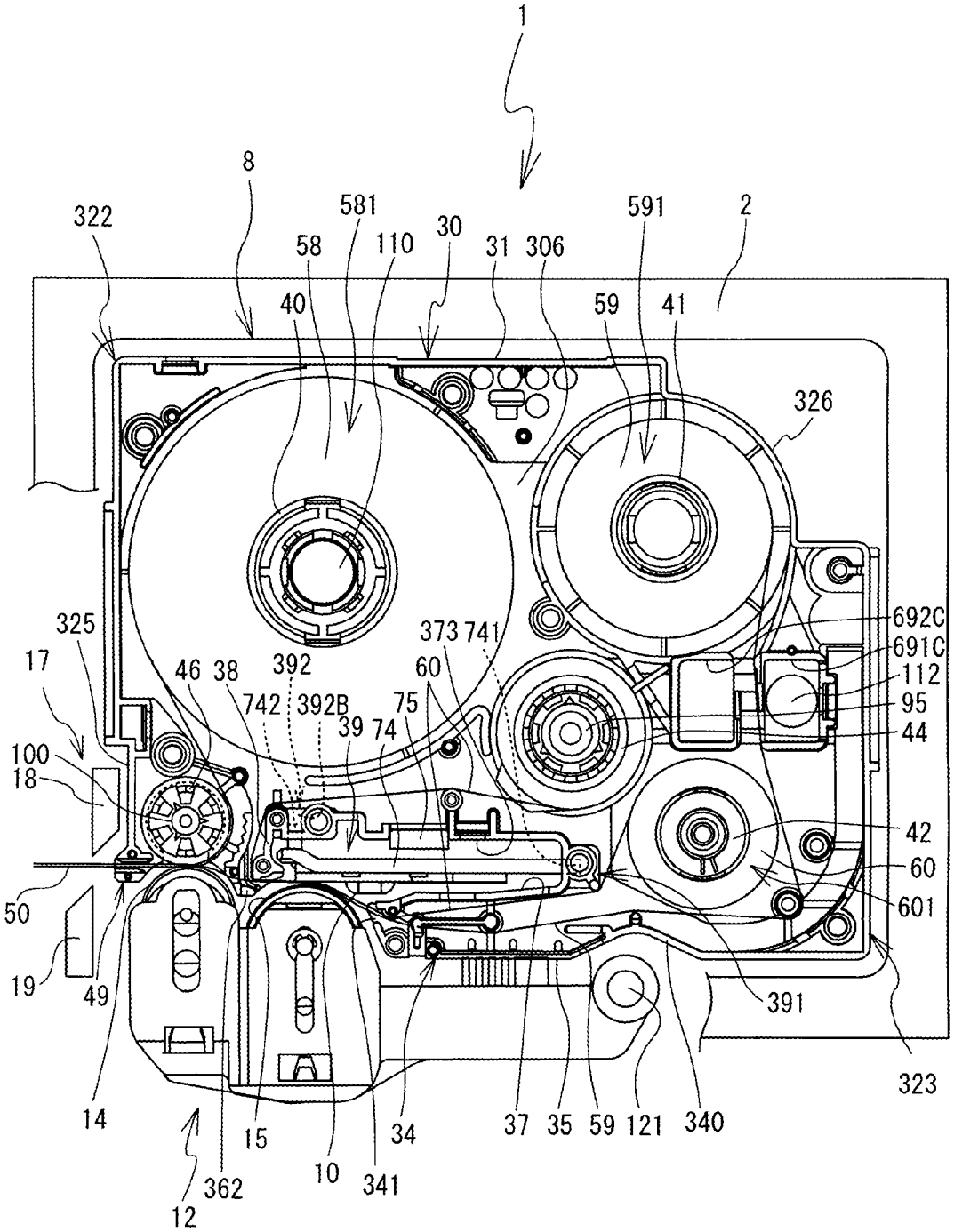
FIG. 5 is a plan view of the cassette mounting portion 8, in which the laminated type of the tape cassette 30 has been mounted, in a case where the platen holder 12 is in a printing position.
Figure 6:
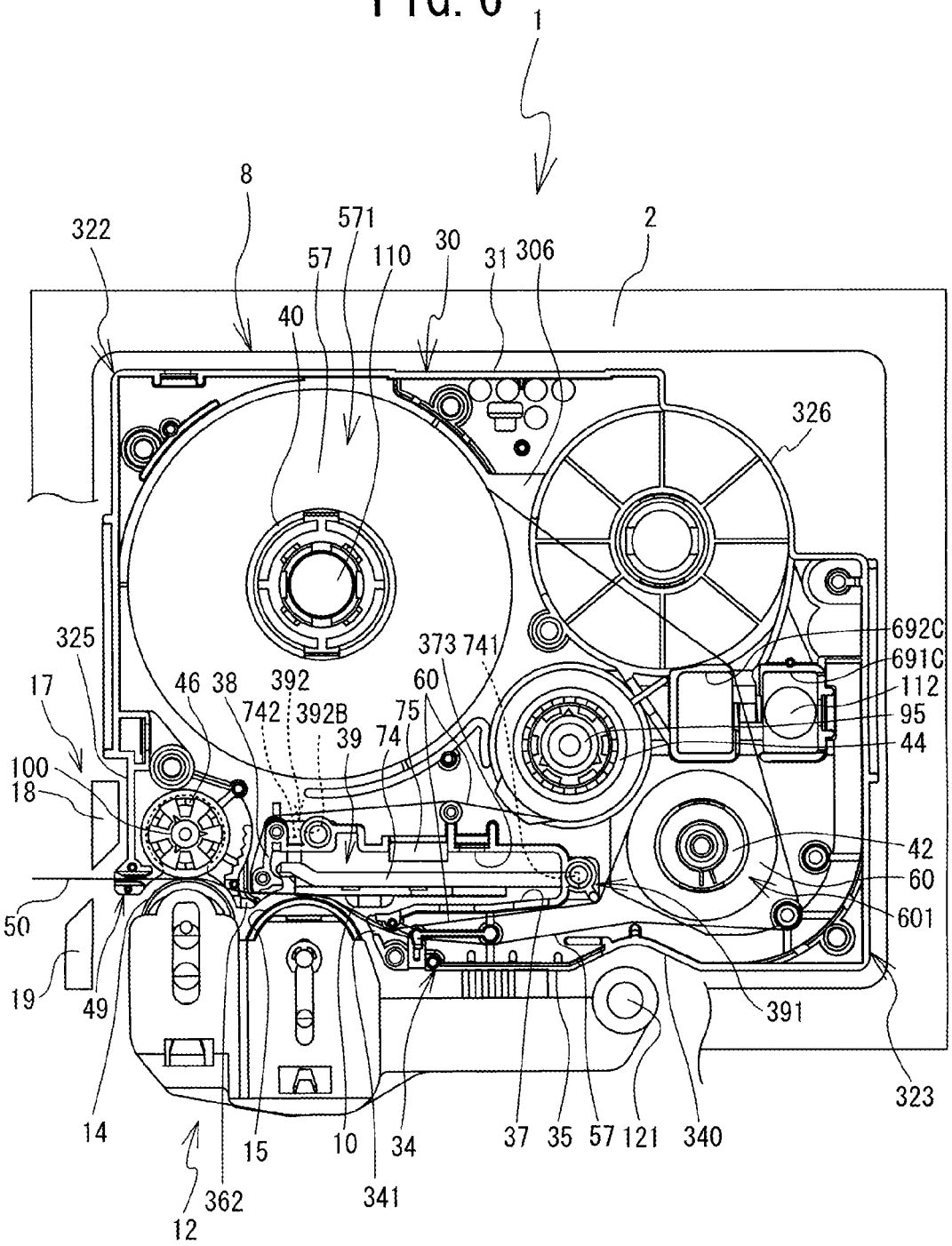
FIG. 6 is a plan view of the cassette mounting portion 8, in which a receptor type of the tape cassette 30 has been mounted, in a case where the platen holder 12 is in the printing position.
Figure 7:
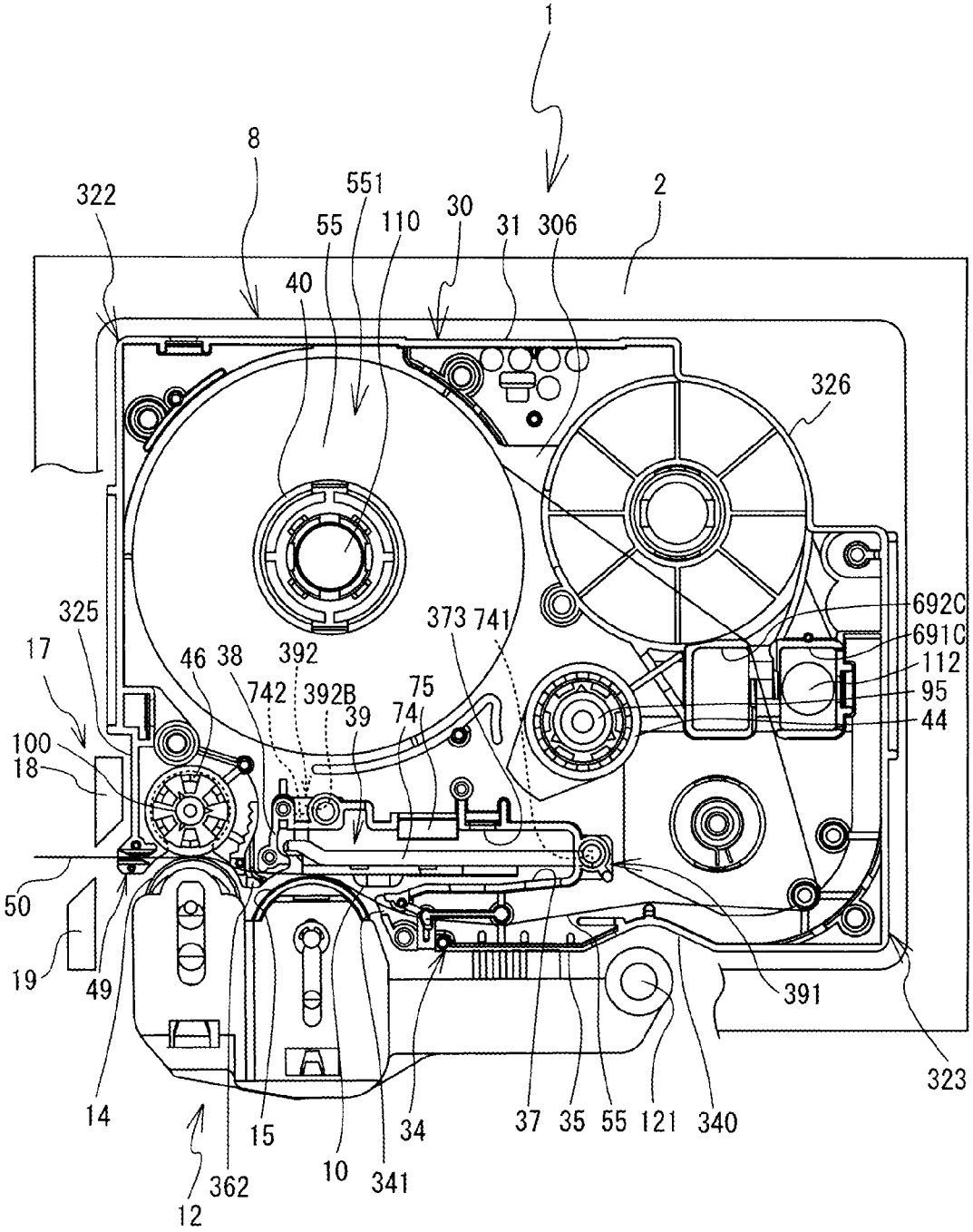
FIG. 7 is a plan view of the cassette mounting portion 8, in which a thermal type of the tape cassette 30 has been mounted, in a case where the platen holder 12 is in the printing position.

A projection that is not shown in the drawings is provided in a vertical orientation in the cassette cover 6. When the cassette cover 6 is closed, the projection in the cassette cover 6 presses the front face of the platen holder 12 toward the rear. This causes the platen holder 12 to move toward a printing position that is shown in FIGS. 5 to 7. In the printing position that is shown in FIGS. 5 to 7, the platen holder 12 has moved in a direction that brings it close to the cassette mounting portion 8. In a case where the laminated type of the tape cassette 30 has been mounted in the cassette mounting portion 8, as shown in FIG. 5, the platen roller 15 presses a film tape 59 and an ink ribbon 60 against the thermal head 10. At the same time, the movable feed roller 14 presses a double-sided adhesive tape 58 and the film tape 59 against the tape drive roller 46.

In a case where the receptor type of the tape cassette 30 has been mounted, as shown in FIG. 6, the platen roller 15 presses a printing tape 57 and the ink ribbon 60 against the thermal head 10. At the same time, the movable feed roller 14 presses the printing tape 57 against the tape drive roller 46. In a case where the thermal type of the tape cassette 30 has been mounted, as shown in FIG. 7, the platen roller 15 presses a thermal paper tape 55 against the thermal head 10. At the same time, the movable feed roller 14 presses the thermal paper tape 55 against the tape drive roller 46.

Thus, in the printing position that is shown in FIGS. 5 to 7, it is possible for the printing to be performed using the particular type of the tape cassette 30 that has been mounted in the cassette mounting portion 8. Note that the thermal paper tape 55, the printing tape 57, the double-sided adhesive tape 58, the film tape 59, and the ink ribbon 60 will be described in detail later.

Figure 2:
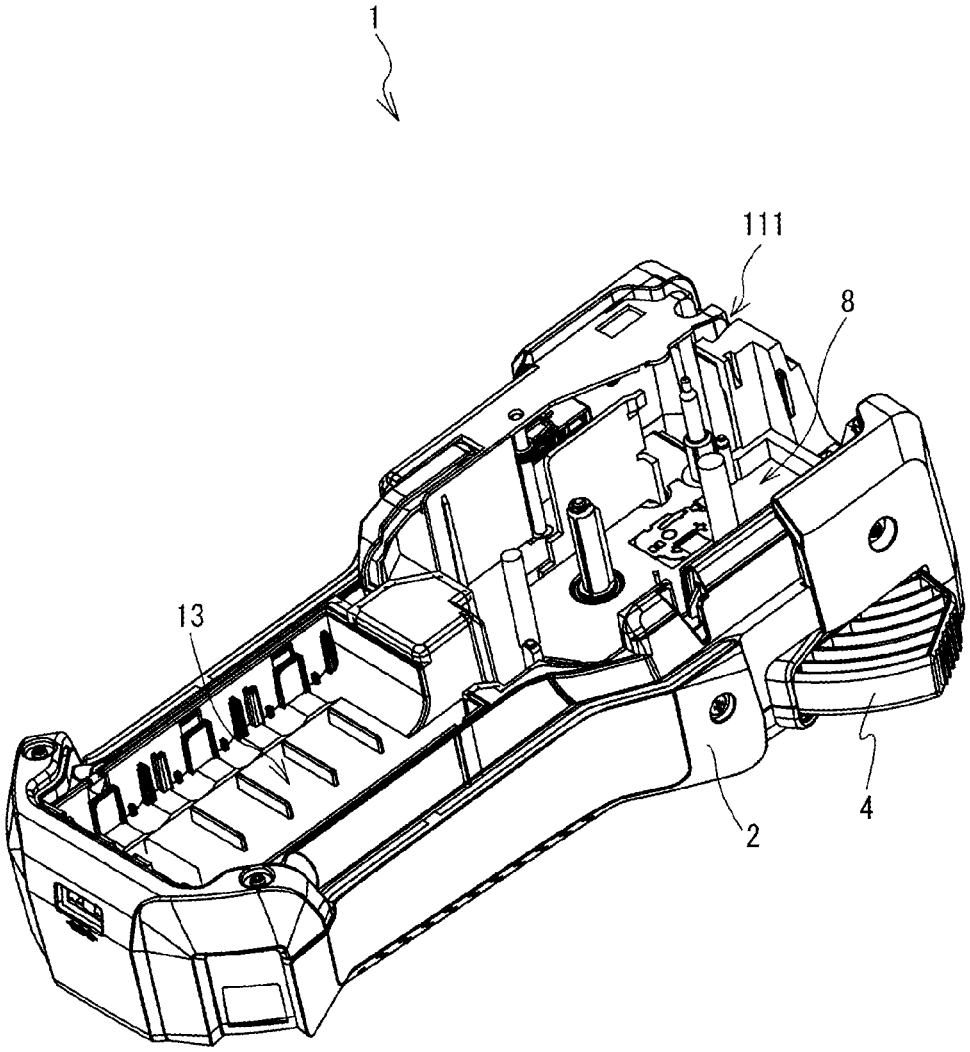
FIG. 2 is an oblique view from a bottom face side of the tape printer 1, which is in a state in which the cassette cover 6 has been opened.

As shown in FIG. 4, a path along which a printed tape 50 passes is provided between a tape discharge portion 49 of the tape cassette 30 and the discharge slit 111 of the tape printer 1 (refer to FIG. 2). A cutting mechanism 17 that cuts the printed tape 50 at a specified position is provided along the path. The cutting mechanism 17 is configured from a fixed blade 18 and a movable blade 19 that is supported such that it is able to move in the front-rear direction (the up-down direction in FIGS. 4 to 7) in relation to the fixed blade 18. Note that the movable blade 19 is moved in the front-rear direction by a cutter motor 24 (refer to FIG. 11).

Figure 8:
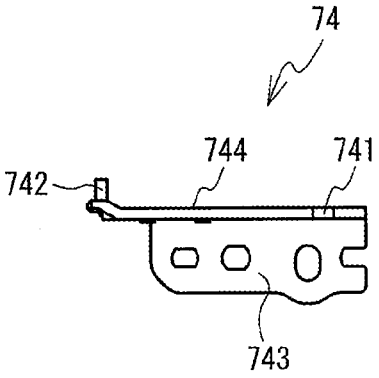
FIG. 8 is a plan view of a head holder 74.
Figure 9:
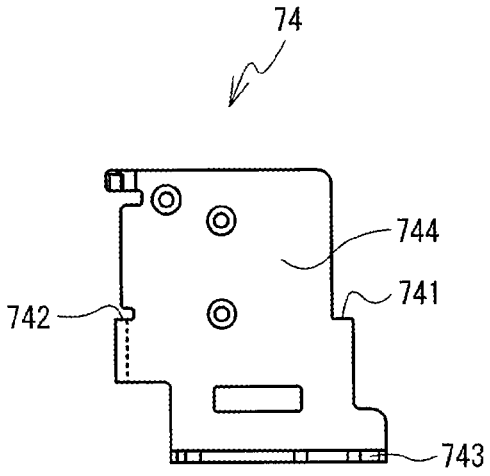
FIG. 9 is a front view of the head holder 74.
Figure 10:
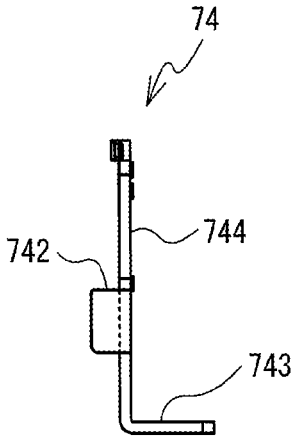
FIG. 10 is a left side view of the head holder 74.

The configuration of the head holder 74 will be explained in detail with reference to FIGS. 4 and 8 to 10. As shown in FIGS. 8 to 10, the head holder 74 is formed from a single plate-shaped member and includes a base portion 743 and a head fixing portion 744. The base portion 743 is fixed in place below the bottom face of the cavity 811 (not shown in the drawings). The head fixing portion 744 is bent such that it is approximately orthogonal to and extends upward from the base portion 743, and it is oriented in the left-right direction of the tape printer 1. The position in which the head holder 74 is disposed in the cassette mounting portion 8 is a position that, in a case where the tape cassette 30 has been mounted, corresponds to a head insertion portion 39 that will be described later. However, the right end portion of the head holder 74 extends farther to the right than does the right end of the head insertion portion 39. The thermal head 10 is affixed to the front face of the head fixing portion 744 (refer to FIG. 4).

The head fixing portion 744 includes a first support portion 741 and a second support portion 742 (hereinafter collectively called the cassette support portions 741, 742) that are adapted to support the tape cassette 30 from below when the tape cassette 30 has been mounted in the tape printer 1. The first support portion 741 is a stepped portion that is formed at a specified height position by cutting out a portion of the right edge of the head fixing portion 744 to form an L-shape in a front view. The second support portion 742 is an extending piece that is provided at the same position as the first support portion 741 in the up-down direction (at the same height position) and that is bent from the left edge portion of the head fixing portion 744 such that it is approximately orthogonal to the head fixing portion 744 and rectangularly shaped in a side view.

In other words, the first support portion 741 and the second support portion 742 extend in directions that are approximately orthogonal to one another in a plan view. The first support portion 741 and the second support portion 742 may support the tape cassette 30 at the same height position on an upstream side and a downstream side, respectively, of the thermal head 10 in the tape feed direction. The first support portion 741 and the second support portion 742 are provided at positions that are separated from the center position of the thermal head 10 in the up-down direction by a specified distance in the up-down direction. Accordingly, the first support portion 741 and the second support portion 742 serve as references for positioning the tape cassette 30 in the up-down direction in relation to the center position of the thermal head 10 in the up-down direction. Note that the supporting of the tape cassette 30 by the cassette support portions 741, 742 will be described in detail later.

Figure 11:
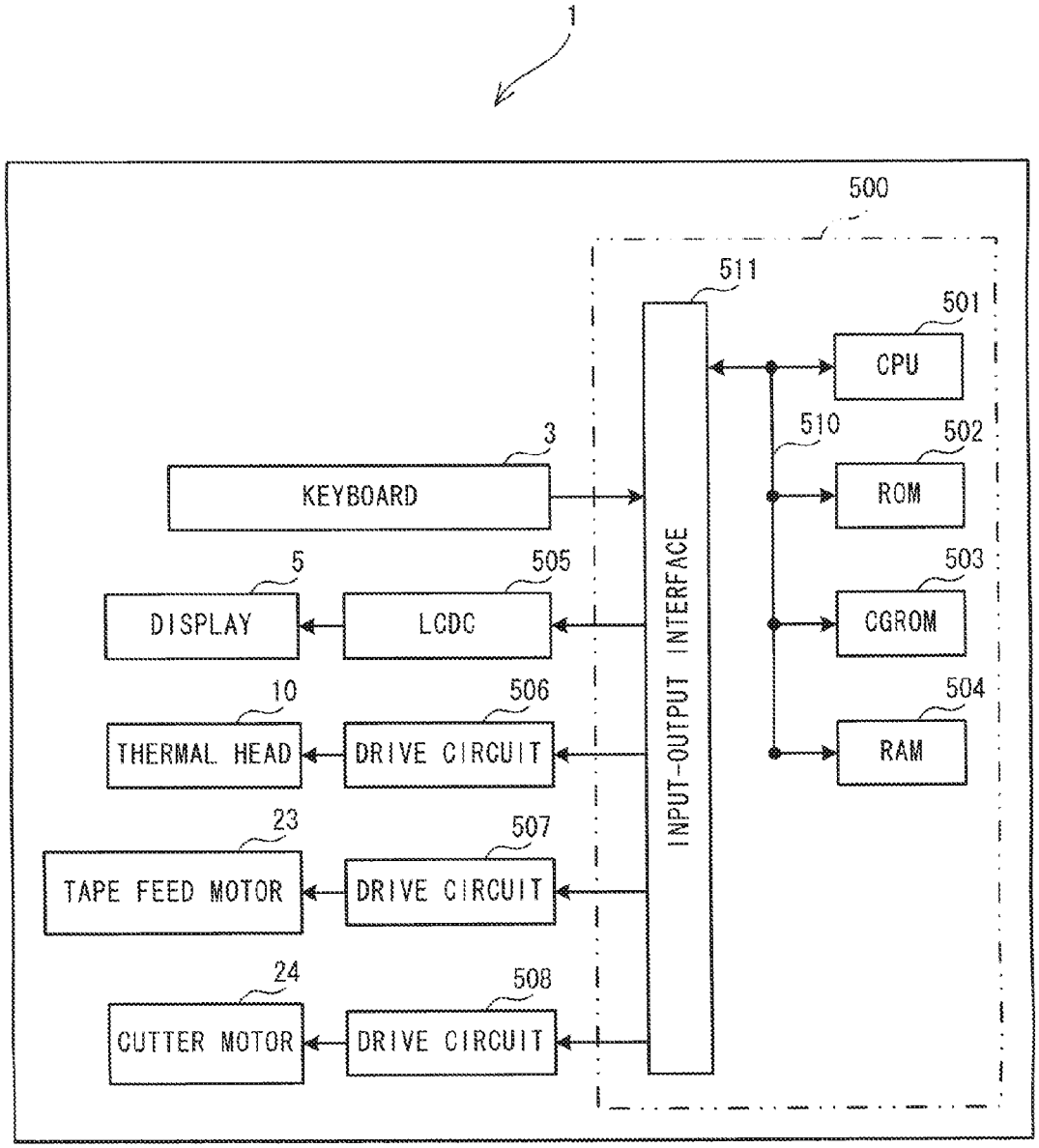
FIG. 11 is a block diagram that shows an electrical configuration of the tape printer 1.

Next, an electrical configuration of the tape printer 1 will be explained with reference to FIG. 11. As shown in FIG. 11, the tape printer 1 is provided with a control circuit 500 that is formed on a control board. In the control circuit 500, a ROM 502, a CGROM 503, a RAM 504, and an input-output interface 511 are connected through a data bus 510 to a CPU 501 that controls each of the devices.

Various types of programs that the CPU 501 executes in order to control the tape printer 1 are stored in the ROM 502. Printing dot pattern data for printing characters are stored in the CGROM 503. A plurality of storage areas are provided in the RAM 504 for a text memory, a printing buffer, and the like.

The keyboard 3, a liquid crystal display (LCD) 5, drive circuits 506, 507, 508, and the like are connected to the input-output interface 511. The drive circuit 506 is an electronic circuit for operating the thermal head 10. The drive circuit 507 is an electronic circuit for operating the tape feed motor 23. The drive circuit 508 is an electronic circuit for operating the cutter motor 24 that operates the movable blade 19. A liquid crystal drive circuit (LCDC) 505 includes a video RAM (not shown in the drawings) for outputting display data to the display 5.

Next, the configuration of the tape cassette 30 according to the present embodiment will be explained with reference to FIGS. 3 to 7 and 12 to 18. Hereinafter, the tape cassette 30 will be described that is configured as a general-purpose cassette in which various tapes can be mounted to make the previously described thermal type tape, receptor type tape, laminated type tape, and the like by modifying, as desired, the type of the tape that is contained in the interior of the tape cassette 30, the presence or absence of an ink ribbon, and the like.

First, the overall configuration of the tape cassette 30 will be explained. As shown in FIG. 3, the tape cassette 30 includes the cassette case 31, which, as a whole, is a box-shaped housing that has corner portions that are rounded in a plan view. The cassette case 31 is configured from the bottom case 312, which includes a bottom plate 306 that forms the bottom face 302 of the cassette case 31 and the top case 311, which includes a top plate 305 that forms a top face 301 of the cassette case 31 and which is affixed to the top part of the bottom case 312. A distance from the bottom face 302 to the top face 301 is called a height of the tape cassette 30 and the cassette case 31.

The cassette case 31 according to the present embodiment is enclosed by a perimeter wall that forms a side face around the entire perimeter of the top plate 305 and the bottom plate 306, but it is not absolutely necessary for the entire perimeter to be enclosed. An opening may be provided in a portion of the perimeter wall (in a rear face, for example), such that the interior of the cassette case 31 is exposed to the outside, and bosses for connecting the top plate 305 and the bottom plate 306 may be provided in positions that face the opening.

The cassette case 31 has three corner portions that are formed to have the same width (the same length in the up-down direction), regardless of the type of the tape in the tape cassette 30. Hereinafter, the left front corner portion will be called the first corner portion 321, the left rear corner portion will be called the second corner portion 322, and the right front corner portion will be called the third corner portion 323. The first corner portion 321, the second corner portion 322, and the third corner portion 323 project toward the outside from the side faces of the cassette case 31, such that they form right angles in a plan view. However, the first corner portion 321 in the left front does not form a right angle, because the tape discharge portion 49 is provided in that corner. The bottom faces of the first corner portion 321, the second corner portion 322, and the third corner portion 323 are portions that are positioned opposite the previously described corner support portion 812 when the tape cassette 30 has been mounted in the cassette mounting portion 8.

Figure 12:
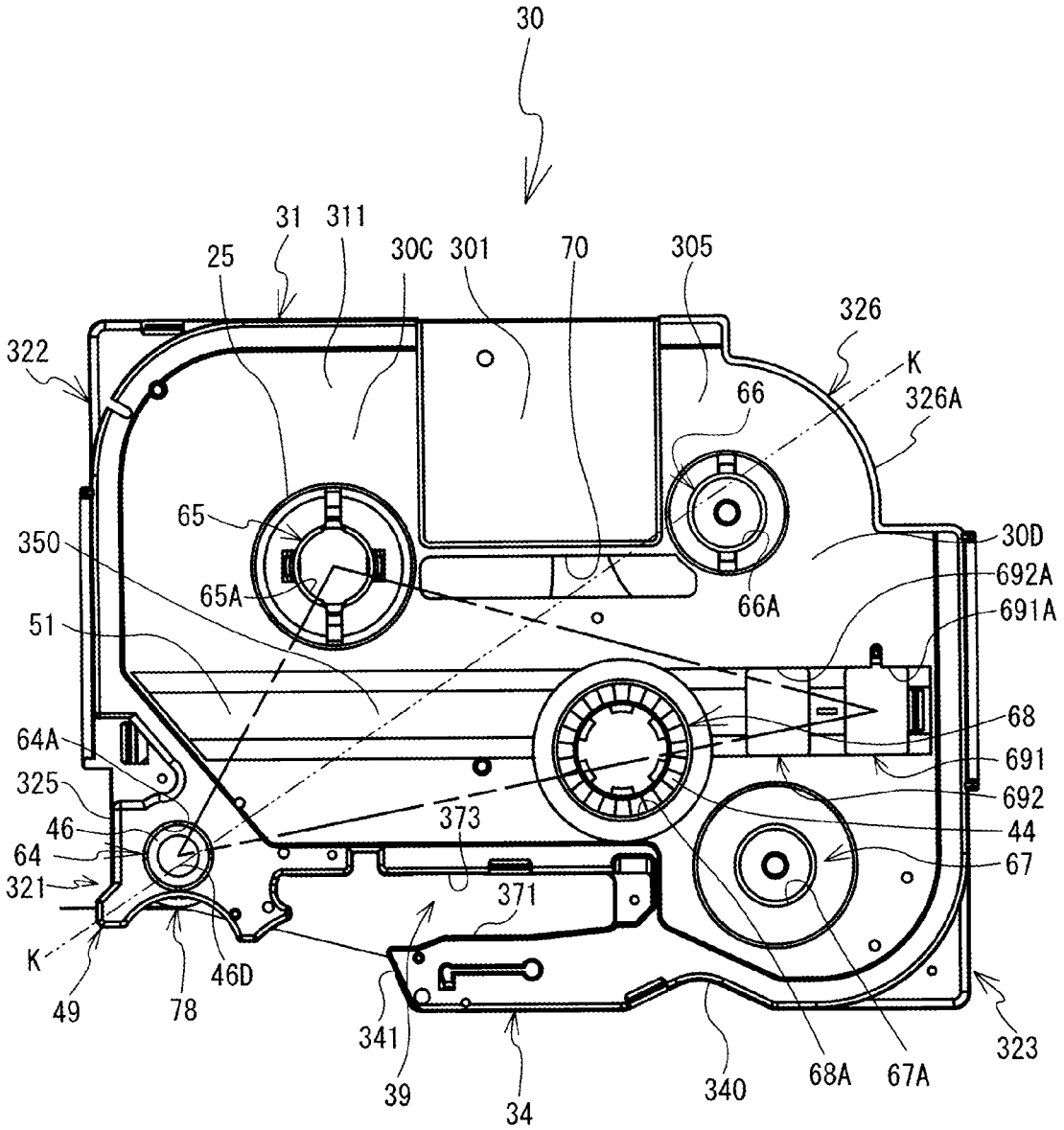
FIG. 12 is a plan view of the tape cassette 30.
Figure 13:
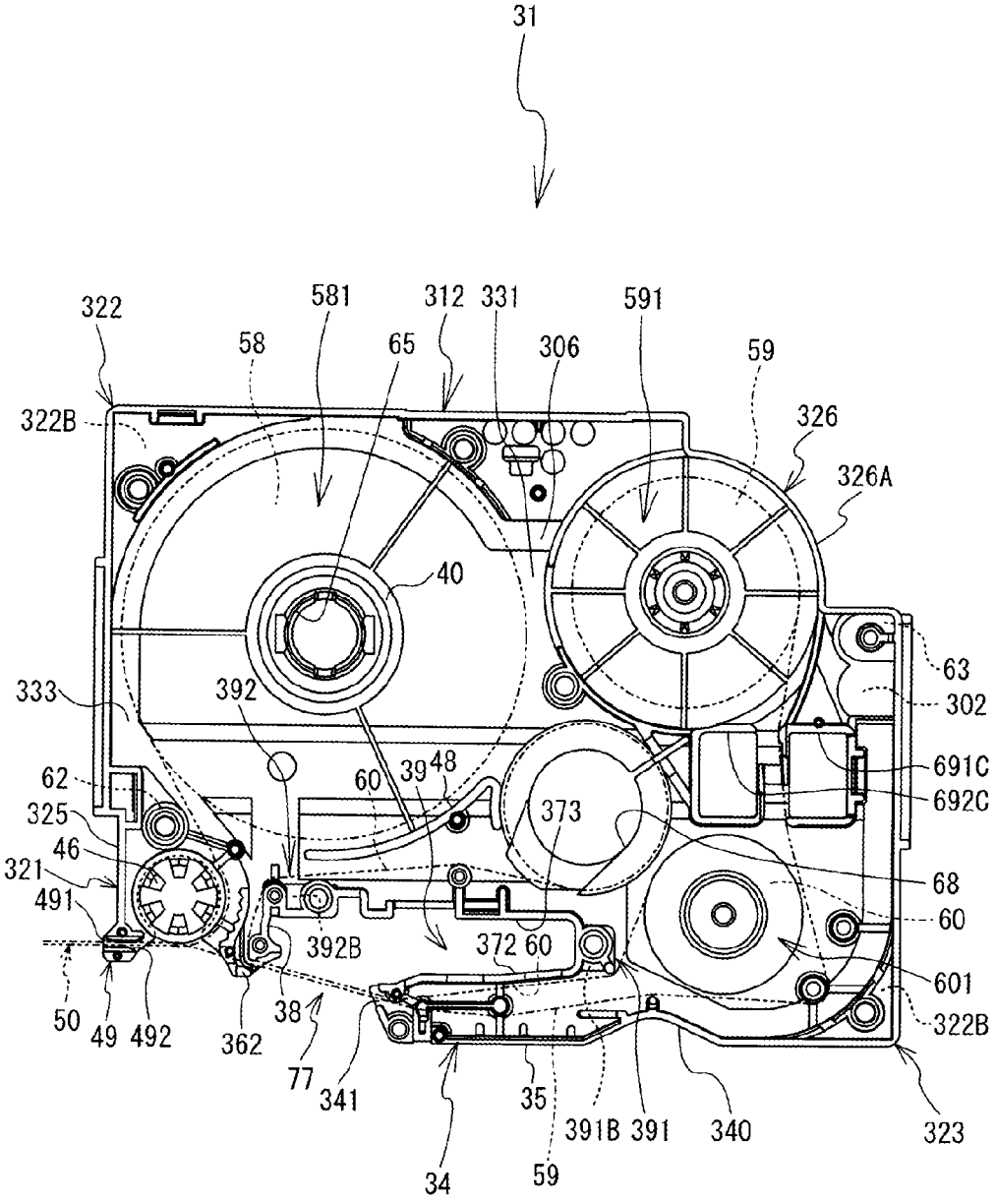
FIG. 13 is a plan view of a bottom case 312.
Figure 14:
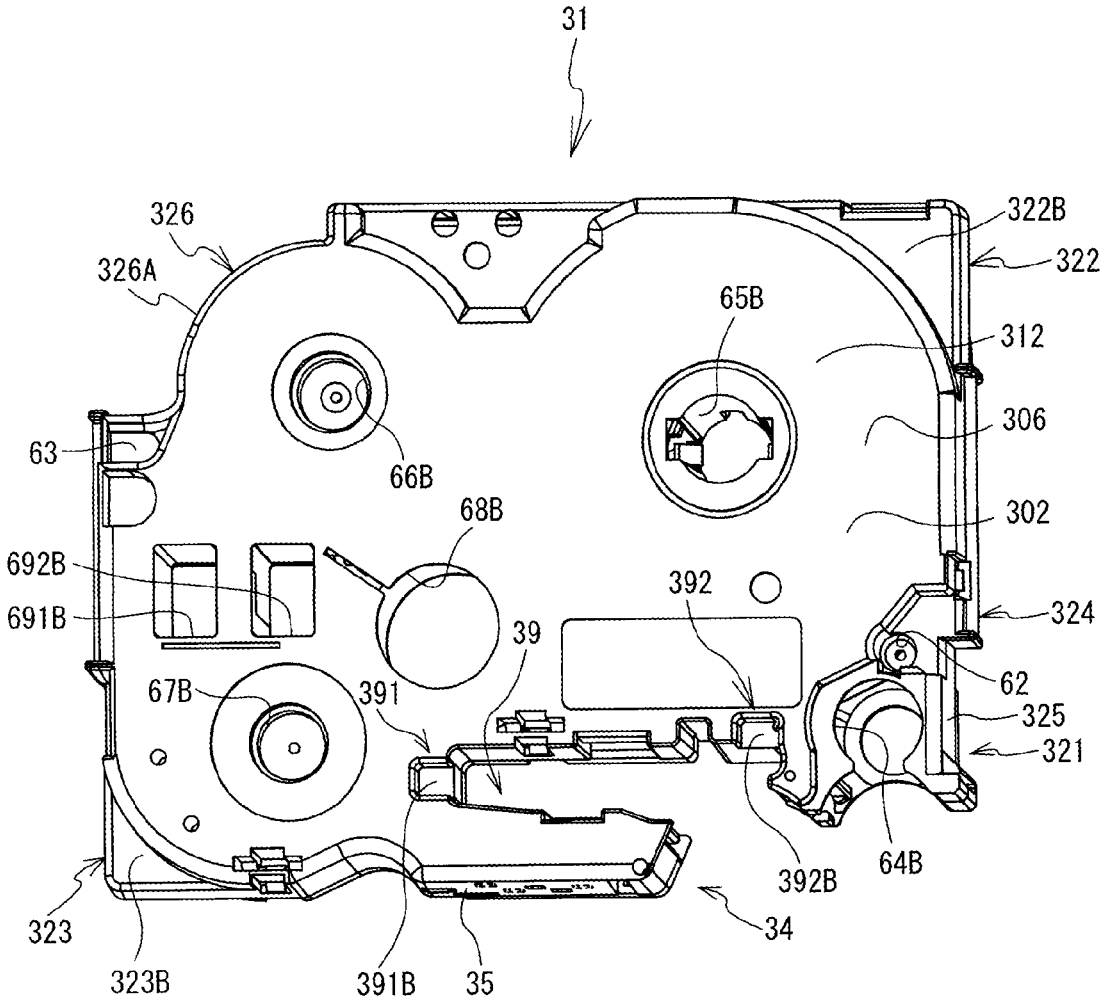
FIG. 14 is an oblique view from a front side of a bottom face 302 of a cassette case 31.

As shown in FIGS. 12 to 14, a first recessed portion 325 that is a recessed portion that is recessed toward the inside of the cassette case 31, extending from the top plate 305 to the bottom plate 306, is provided in the left side face of the cassette case 31 at the first corner portion 321, in the vicinity of the tape discharge portion 49. In addition, a second recessed portion 326 that is also a recessed portion that is recessed toward the inside of the cassette case 31 from the top plate 305 to the bottom plate 306 is provided in a rear portion of the right side face of the cassette case 31 at the right rear of the cassette case 31. In other words, the first recessed portion 325 and the second recessed portion 326 are disposed in diagonally opposite positions in the tape cassette 30.

As shown in FIGS. 4 to 7, a portion of the wall that forms the second recessed portion 326 is an arc-shaped wall 326A (refer to FIG. 12) that is formed along a portion of an area in which a tape roll that is provided around a second tape spool 41 that will be described later is disposed. The arc-shaped wall 326A may restrain the tape roll from widening radially outward. The amount of material that is used and the cost of the tape cassette 30 can thus be made less than in a case where the wall that forms the second recessed portion 326 and a wall that defines the area where the tape roll is disposed are formed separately.

As shown in FIG. 14, the pin holes 62, 63 that respectively correspond to the previously described positioning pins 102, 103 of the tape printer 1 are provided in two locations, on the bottom face of the first corner portion 321 and the bottom face of the area in front of the second recessed portion 326. More specifically, a recessed portion that is provided in the bottom face of the first corner portion 321 is the pin hole 62 into which the positioning pin 102 may be inserted. A recessed portion that is provided in the bottom face of the area in front of the second recessed portion 326 is the pin hole 63 into which the positioning pin 103 may be inserted.

As shown in FIGS. 3, 4, and 12, the first tape support hole 65 that rotatably supports a first tape spool 40 is formed to the left rear from the center of the tape cassette 30 in a plan view. A second tape support hole 66 that rotatably supports the second tape spool 41 is formed to the right rear from the center of the tape cassette 30 in a plan view. A ribbon support hole 67 that rotatably supports a ribbon spool 42 is formed to the right front from the center of the tape cassette 30 in a plan view. A winding support hole 68 that rotatably supports the ribbon winding spool 44, which pulls the ink ribbon 60 off of the ribbon spool 42 and winds up the ink ribbon 60 that has been used for printing characters and the like, is formed between the first tape support hole 65 and the ribbon support hole 67. The first rectangular hole 691 and the second rectangular hole 692, each of which is rectangular in a plan view, are formed to the right of the winding support hole 68 and in front of the second recessed portion 326 and are lined up in the left-right direction. The first rectangular hole 691 is provided to the right of the second rectangular hole 692. The second auxiliary shaft 112 may be inserted into the first rectangular hole 691, although this will be described in detail later.

In the laminated type of the tape cassette 30 that is shown in FIGS. 4 and 5, three types of tape rolls, specifically, the double-sided adhesive tape 58, which has a release paper affixed to one side, the transparent film tape 59, which is the printing medium, and the ink ribbon 60, are contained within the cassette case 31. A double-sided adhesive tape roll 581, which is the wound double-sided adhesive tape 58 with the release paper facing outward, is provided around the first tape spool 40. A film tape roll 591, which is the wound film tape 59, is provided around the second tape spool 41. An ink ribbon roll 601, which is the wound unused ink ribbon 60, is provided around the ribbon spool 42. The used ink ribbon 60 is wound up by the ribbon winding spool 44. A clutch spring (not shown in the drawings) is attached to a lower portion of the ribbon winding spool 44 for preventing the wound ink ribbon 60 from being loosened by the ribbon winding spool 44 rotating in reverse.

In the receptor type of the tape cassette 30 that is shown in FIG. 6, two types of tape rolls, specifically, the printing tape 57, which is the printing medium, and the ink ribbon 60, are contained within the cassette case 31. A printing tape roll 571, which is the wound printing tape 57, is provided around the first tape spool 40. The ink ribbon roll 601, which is the wound unused ink ribbon 60, is provided around the ribbon spool 42. The receptor type of the tape cassette 30 is not provided with the second tape spool 41.

In the thermal type of the tape cassette 30 that is shown in FIG. 7, one type of tape roll, the thermal paper tape 55, is contained within the cassette case 31. A thermal paper tape roll 551, which is the wound thermal paper tape 55, is provided around the first tape spool 40. The thermal type of the tape cassette 30 is not provided with the second tape spool 41 and the ribbon spool 42. Hereinafter, in a case where any one of the thermal paper tape 55, the printing tape 57, and the film tape 59 that are the printing media is referenced, it will simply be called the tape.

As shown in FIGS. 3 and 12, a remaining amount check hole 70, which is a rectangular hole whose long dimension extends in the left-right direction, is provided in the top case 311 between the first tape support hole 65 and the second tape support hole 66. That is, the remaining amount check hole 70 is provided such that it faces the tape rolls that are respectively provided around the first tape spool 40 and the second tape spool 41. This makes it possible for a person to check the amounts that are remaining on the tape rolls that are provided around the first tape spool 40 and the second tape spool 41.

As shown in FIG. 3, a semi-circular groove 340 that is a groove that is roughly semi-circular in a plan view is provided on the front face of the cassette case 31, spanning the height direction of the cassette case 31 (that is, from the top face 301 to the bottom face 302). The semi-circular groove 340 is a cut-out that is provided such that the shaft support portion 121 around which the platen holder 12 rotates will not interfere with the cassette case 31 when the tape cassette 30 has been mounted in the cassette mounting portion 8.

A portion of the front face wall of the cassette case 31 that extends to the left from the semi-circular groove 340 is an arm front face wall 35. A portion that extends to the left from the right side of the tape cassette 30 and that is bounded by the arm front face wall 35 and by an arm rear face wall 37 that is provided such that it spans the height direction of the cassette case 31 in a position that is separated from and to the rear of the arm front face wall 35 is called an arm portion 34. The left end of the arm front face wall 35 is bent toward the rear, and a gap that extends in the up-down direction and is formed between the left ends of the arm front face wall 35 and the arm rear face wall 37 is a discharge outlet 341 from which the tape (as well as the ink ribbon 60) is discharged from the arm portion 34.

As shown in FIGS. 4 to 7, in the arm portion 34, the tape that has been pulled off from one of the first tape spool 40 and the second tape spool 41 is guided along a feed path that extends approximately parallel to the arm front face wall 35 and is discharged from the discharge outlet 341. In addition, the ink ribbon 60 that has been pulled off from ribbon spool 42 is guided along a feed path within the arm portion 34 that is different from that of the tape and is discharged from the discharge outlet 341 in a state of being superposed on the tape.

A space that is bounded by the arm rear face wall 37 and by a head perimeter wall 373 that is provided such that it is continuous with the arm rear face wall 37, that is roughly rectangular in a plan view, and that passes through the up-down direction of the tape cassette 30 is a head insertion portion 39. The head insertion portion 39 is also connected to the outside on the front face side of the tape cassette 30 through an open portion 77 that is provided in the front surface of the tape cassette 30. The head holder 74 that supports the thermal head 10 of the tape printer 1 may be inserted into the head insertion portion 39. At the open portion 77 (refer to FIGS. 4 to 7), the printing on the tape that is discharged from the discharge outlet 341 of the arm portion 34 is performed by the thermal head 10 using the ink ribbon 60.

As shown in FIGS. 4 to 7, 13, and 14, support receiving portions that are used for positioning the tape cassette 30 in the up-down direction when the tape cassette 30 is mounted in the tape printer 1 are provided on the outer perimeter of the head insertion portion 39 of the bottom case 312, in positions that faces the head insertion portion 39. Specifically, a first receiving portion 391 and a second receiving portion 392 (hereinafter collectively called the support receiving portions 391, 392) are provided in two locations that are respectively on the upstream side and the downstream side in the tape feed direction with respect to an insertion position (more specifically, the printing position) of the thermal head 10 (refer to FIGS. 4 to 7).

The first receiving portion 391 is connected to the end of the arm portion 34 on the upstream side in the tape feed direction and to the upstream end of the head insertion portion 39. The second receiving portion 392 is connected to the downstream end of the head insertion portion 39. The first and second receiving portions 391, 392 are recessed portions that are each formed by recessing the bottom face 302 of the bottom plate 306 upward. Furthermore, the first receiving portion 391 is recessed from the head insertion portion 39 in a direction that is parallel to the arm front face wall 35. The second receiving portion 392 is recessed from the head insertion portion 39 in a direction that is orthogonal to the arm front face wall 35. In other words, the first receiving portion 391 and the second receiving portion 392 face the head insertion portion 39 in directions that are mutually orthogonal.

The first and second receiving portions 391, 392 respectively include a first bottom flat surface portion 391B and a fourth bottom flat surface portion 392B that are surfaces on the bottom sides of flat portions (the bottom portions of the recessed portions), that are roughly rectangular in a bottom view, and that are positioned higher than the bottom face 302. The positions of the first and the fourth bottom flat surface portions 391B, 392B in the up-down direction (the height direction) of the bottom case 312 and the center position in the width direction of the tape and the ink ribbon 60 that are contained in the cassette case 31 remain constant, regardless of the type of the tape in the tape cassette 30, that is, even if the height of the tape cassette 30 in the up-down direction varies. Accordingly, the greater the widths of the tape and the ink ribbon 60 that are contained in the cassette case 31 become, the greater the depths of the support receiving portions 391, 392, which are the recessed portions that are provided in the bottom face 302, become.

The first and fourth bottom flat surface portions 391B, 392B are in positions that are separated by the same distance in the up-down direction from the center position in the width direction of the tape and the ink ribbon 60. In other words, the first and fourth bottom flat surface portions 391B, 392B are in the same height position in the bottom case 312. In the present embodiment, the center position in the width direction of the tape and the ink ribbon 60 coincides with the center position in the up-down direction of the cassette case 31.

In a case where the tape cassette 30 has been mounted in the cassette mounting portion 8, the first and fourth bottom flat surface portions 391B, 392B may function as portions that are respectively supported from below by the first and second cassette support portions 741, 742 that are provided in the head holder 74.

As shown in FIG. 3, an upper-lower pair of restraining members 361, 362 are provided on the downstream side of the head insertion portion 39 in the tape feed direction. The restraining members 361, 362 guide the tape that has been discharged from the discharge outlet 341 and on which the printing has been performed toward the tape discharge portion 49 on the downstream side of the thermal head 10. Details will be described later, but the ink ribbon 60 that has been used for the printing is separated from the tape on the upstream side of the restraining members 361, 362, is fed along a separate feed path, and is wound around the ribbon winding spool 44.

As shown in FIG. 13, a wall at the left end of the head perimeter wall 373 that defines the downstream end of the head insertion portion 39 in the tape feed direction is called a ribbon guide wall 38. The ribbon guide wall 38 is adjacent to the upstream side of the restraining member 362. The feed path for the ink ribbon 60 starts from the ink ribbon roll 601, passes through the arm portion 34 and the open portion 77, and ends at the ribbon winding spool 44. The ribbon guide wall 38 takes the used ink ribbon 60 that has been used for the printing in the open portion 77, bends it along the feed path, and guides it toward the ribbon winding spool 44. The second receiving portion 392, which is provided such that it is connected to the downstream end of the head insertion portion 39, is positioned in front of the ink ribbon 60 feed path from the ribbon guide wall 38 to the ribbon winding spool 44.

A separating wall 48 is provided in a vertical orientation between the ribbon guide wall 38 and the ribbon winding spool 44. The separating wall 48 prevents the used ink ribbon 60 that is being guided along the ribbon guide wall 38 and the double-sided adhesive tape roll 581 that is provided around the first tape spool 40 from coming into contact one another.

As shown in FIG. 12, within the tape feed path, a tape exposing portion 78 that is a portion where the tape is exposed to the outside of the tape cassette 30 is provided in the vicinity of the tape discharge portion 49 and on the upstream side of the tape feed path from the tape discharge portion 49. A roller support hole 64 is provided to the rear of the tape exposing portion 78, and the tape drive roller 46 is rotatably supported on the inner side of the roller support hole 64. In other words, the tape drive roller 46 that feeds the tape toward a tape discharge outlet is provided to the rear of and adjacent to the tape exposing portion 78. The tape drive roller 46 is a cylindrical member that is disposed such that its axial direction is in the up-down direction, and it has a shaft hole 46D that is a hole that passes through the tape drive roller 46 in the up-down direction (refer to FIG. 17). That is, the shaft hole 46D is provided in the left front portion of the tape cassette 30.

In a case where the laminated type of the tape cassette 30 has been mounted in the cassette mounting portion 8, as shown in FIGS. 4 and 5, the film tape 59 is pulled off from the film tape roll 591 and the double-sided adhesive tape 58 is pulled off from the double-sided adhesive tape roll 581 by the coordinated operations of the tape drive roller 46 and the opposing movable feed roller. Then the double-sided adhesive tape 58 is guided and affixed to the print surface of the film tape 59, and is fed toward the tape discharge portion 49 as the printed tape 50.

In a case where the receptor type of the tape cassette 30 has been mounted in the cassette mounting portion 8, as shown in FIG. 6, the printing tape 57 is pulled off from the printing tape roll 571 by the coordinated operations of the tape drive roller 46 and the movable feed roller 14. On the downstream side of the thermal head 10, the printed printing tape 57, that is, the printed tape 50, is guided by the restraining members 361, 362 toward the tape discharge portion 49. Furthermore, the used ink ribbon 60 that has been fed through the head insertion portion 39 is separated from the printing tape 57 on the upstream side of the restraining members 361, 362 and is fed toward the ribbon winding spool 44.

In a case where the thermal type of the tape cassette 30 has been mounted in the cassette mounting portion 8, as shown in FIG. 7, the thermal paper tape 55 is pulled off from the thermal paper tape roll 551 by the coordinated operations of the tape drive roller 46 and the movable feed roller 14. On the downstream side of the thermal head 10, the printed thermal paper tape 55, that is, the printed tape 50, is guided by the restraining members 361, 362 toward the tape discharge portion 49.

As shown in FIGS. 3 and 13, the tape discharge portion 49 is a plate-shaped member that extends between the top face 301 and the bottom face 302 and that is provided such that it is in front of and slightly separated from the front edge of the left side face of the cassette case 31. The tape discharge portion 49 guides the printed tape 50 that has been fed past the restraining members 361, 362 and the tape drive roller 46 into a passage that is formed between the tape discharge portion 49 and the front edge of the left side face of the cassette case 31, then discharges the printed tape 50 from the tape discharge outlet, which is the end of the passage.

A pair of inner faces 491, 492 are provided in the tape discharge portion 49 such that they are positioned opposite one another with the printed tape 50 between them. The inner faces 491, 492 restrain the movement of the printed tape 50 in a direction that is orthogonal to the plane of the printed tape 50 (that is, in the front-rear direction). In a case where a person is holding the tape cassette 30 with his fingers on the first recessed portion 325 and the second recessed portion 326, this may reduce the chance that the printed tape 50 will be touched by the fingers placed on the first recessed portion 325. Accordingly, the chance can be reduced that dirt will adhere to the printed tape 50 due to the printed tape 50 being touched by the fingers, for example.

Next, the second and the third corner portions 322, 323 in the bottom case 312 will be explained. As shown in FIG. 13, the bottom case 312 includes a second bottom flat surface portion 322B that is the bottom face of the second corner portion 322 and a third bottom flat surface portion 323B that is the bottom face of the third corner portion 323. The second bottom flat surface portion 322B and the third bottom flat surface portion 323B are flat portions that are both positioned higher than the bottom face 302.

The positions of the second and the third bottom flat surface portions 322B, 323B in the up-down direction (the height direction) of the bottom case 312 and the center position in the width direction of the tape and the ink ribbon 60 remain constant, regardless of the type of the tape in the tape cassette 30, that is, even if the height of the tape cassette 30 in the up-down direction varies. Accordingly, the greater the widths of the tape and the ink ribbon 60 that are contained in the cassette case 31 become, the greater the distance becomes from the bottom face 302 to the second and the third bottom flat surface portions 322B, 323B.

In the present embodiment, the previously described first and fourth bottom flat surface portions 391B, 392B and the second and the third bottom flat surface portions 322B, 323B are in positions that are separated by the same distance in the up-down direction from the center position in the width direction of the tape and the ink ribbon 60 (in the present embodiment, the center position of the cassette case 31 in the up-down direction). In other words, the first, fourth, second, and third bottom flat surface portions 391B, 392B, 322B, 323B are in the same height position in the bottom case 312.

Next, the holes that are formed in the tape cassette 30 (the first tape support hole 65, the winding support hole 68, the roller support hole 64, the first and second rectangular holes 691, 692), as well as the members that are related to the holes, will be explained with reference to FIGS. 15 to 18.

Figure 15:
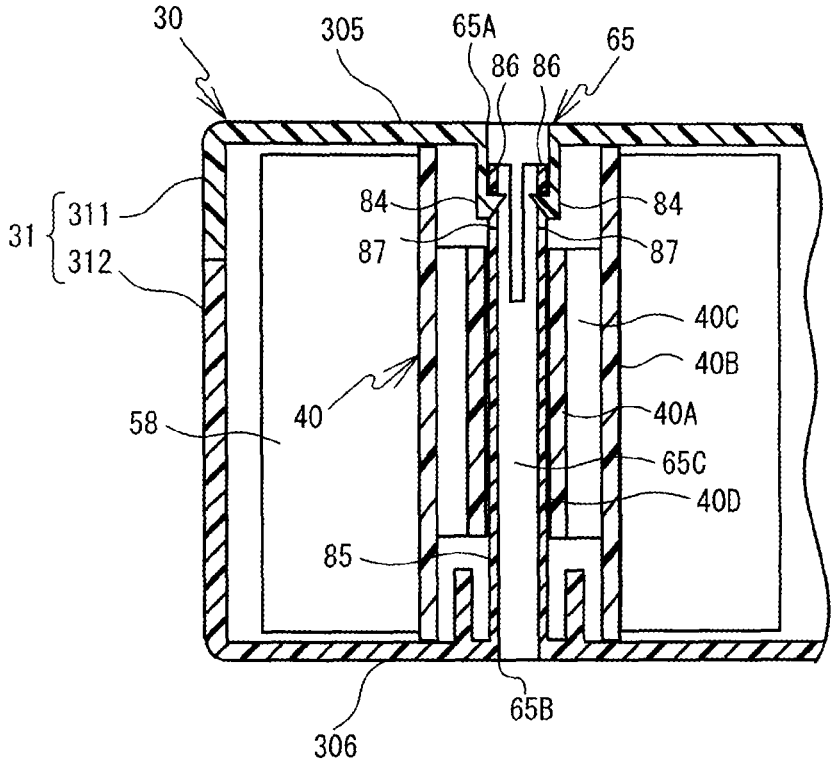
FIG. 15 is a front sectional view of the tape cassette 30 in which a first tape support hole 65 and a first tape spool 40 are mainly shown.

As shown in FIG. 15, the first tape spool 40 is rotatably supported through the first tape support hole 65, which passes through the cassette case 31 in the up-down direction. More specifically, the first tape support hole 65 has an opening 65A and an opening 65B that are recessed holes that extend from the top plate 305 and the bottom plate 306, respectively, such that they are opposed one another, and a shaft hole 65C that connects the openings 65A, 65B. The top case 311 is provided with a plurality of latching ribs 84 that extend from the opening 65A toward the bottom plate 306 in a pattern that radiates from the center of the opening 65A in a plan view. The tips of the individual latching ribs 84 are hook-shaped pieces that project in mutually opposed directions in the interior of the cassette case 31. The bottom case 312 is provided with a cylindrical tube wall 85 that extends from the opening 65B toward the top plate 305. A plurality of slits 87 that are cut out in the up-down direction are formed in the tube wall 85 in a pattern that radiates from the center of the opening 65B in a plan view. Heads 86 for closing openings in each of the slits 87 in the tube wall 85 are provided at the upper end of each of the slits 87. In the interior of the cassette case 31, each of the latching ribs 84 engages through the corresponding one of the slits 87 with the corresponding one of the heads 86 that are provided at the upper end of the tube wall 85. Note that the shaft hole 65C, which is a through-hole in the up-down direction of the cassette case 31, connects the openings 65A, 65B in the interior of the tube wall 85.

The first tape spool 40 has a double wall structure that includes an inner wall 40A and an outer wall 40B. The inner wall 40A is a cylindrical body with an inside diameter that is slightly larger than the outside diameter of the tube wall 85, and it has a height dimension that is less than the width of the tape or the double-sided adhesive tape 58 that is provided around the first tape spool 40. A shaft hole 40D that is a through-hole in the up-down direction is formed on the inner side of the inner wall 40A. The outer wall 40B is a cylindrical body that is provided on the outer side of the inner wall 40A and encloses the entire circumference of the inner wall 40A, and it has a height dimension that is almost the same as the width of the tape or the double-sided adhesive tape 58. In the case of the laminated type of the tape cassette that is shown in FIGS. 4 and 5, the double-sided adhesive tape roll 581 is provided on the outer perimeter surface of the outer wall 40B. A plurality of connecting pieces 40C that are plate-shaped members that are long in the up-down direction are provided between the inner wall 40A and the outer wall 40B in a pattern that radiates from the center of the inner wall 40A and the outer wall 40B in a plan view. In the first tape spool 40, the inner wall 40A and the outer wall 40B are formed by the plurality of the connecting pieces 40C into a coaxial double cylindrical shape. The first tape spool 40 is supported by the tube wall 85, which is inserted into the shaft hole 40D, and can rotate freely about its axis within the cassette case 31.

Figure 16:
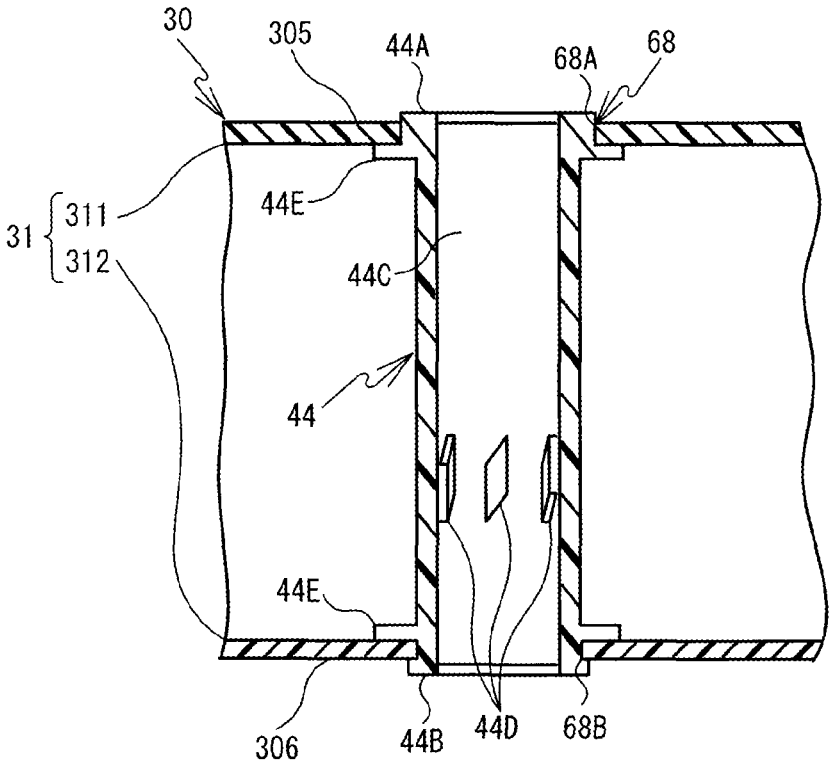
FIG. 16 is a front sectional view of the tape cassette 30 in which a winding support hole 68 and a ribbon winding spool 44 are mainly shown.

As shown in FIG. 16, the ribbon winding spool 44 is rotatably supported through the winding support hole 68, which passes through the cassette case 31 in the up-down direction. More specifically, the winding support hole 68 has an opening 68A and an opening 68B that are through-holes that are formed in mutually opposed positions in the top plate 305 and the bottom plate 306, respectively. The ribbon winding spool 44 is a cylindrical body that has a height dimension that is almost equal to the width (that is, the length in the up-down direction) of the cassette case 31. Flange-shaped support portions 44E are provided on the edge of the upper end and on the edge of the lower end of the outer perimeter surface of the ribbon winding spool 44, each projecting radially outward around the entire circumference of the ribbon winding spool 44.

In the interior of the cassette case 31, an upper end portion 44A is fitted into the opening 68A in the top plate 305, and a lower end portion 44B is fitted into the opening 68B in the bottom plate 306. The support portion 44E that is provided at the edge of the upper end of the ribbon winding spool 44 comes into contact with the top case 311 from below and restrains the movement of the ribbon winding spool 44 in the upward direction. The support portion 44E that is provided at the edge of the lower end of the ribbon winding spool 44 comes into contact with the bottom case 312 from above and restrains the movement of the ribbon winding spool 44 in the downward direction. The ribbon winding spool 44 is thus supported by both of the end portions 44A, 44B and can rotate freely about its axis within the cassette case 31.

A shaft hole 44C that is a through-hole in the up-down direction is formed in the interior of the ribbon winding spool 44. A plurality of ribs 44D are provided on the inner perimeter wall of the ribbon winding spool 44 (that is, on the inner wall that forms the shaft hole 44C) slightly below the center position in the up-down direction. When the tape cassette 30 is mounted in the cassette mounting portion 8, the previously described ribbon winding shaft 95 is inserted into the shaft hole 44C through the opening 68B. The plurality of the cam members 95A that are formed around the ribbon winding shaft 95 engage with the plurality of the ribs 44D that are provided on the ribbon winding spool 44. The rotation of the ribbon winding shaft 95 may be thus transmitted to the ribbon winding spool 44. In other words, the ribbon winding spool 44 rotates in conjunction with the rotation of the ribbon winding shaft 95.

Figure 17:
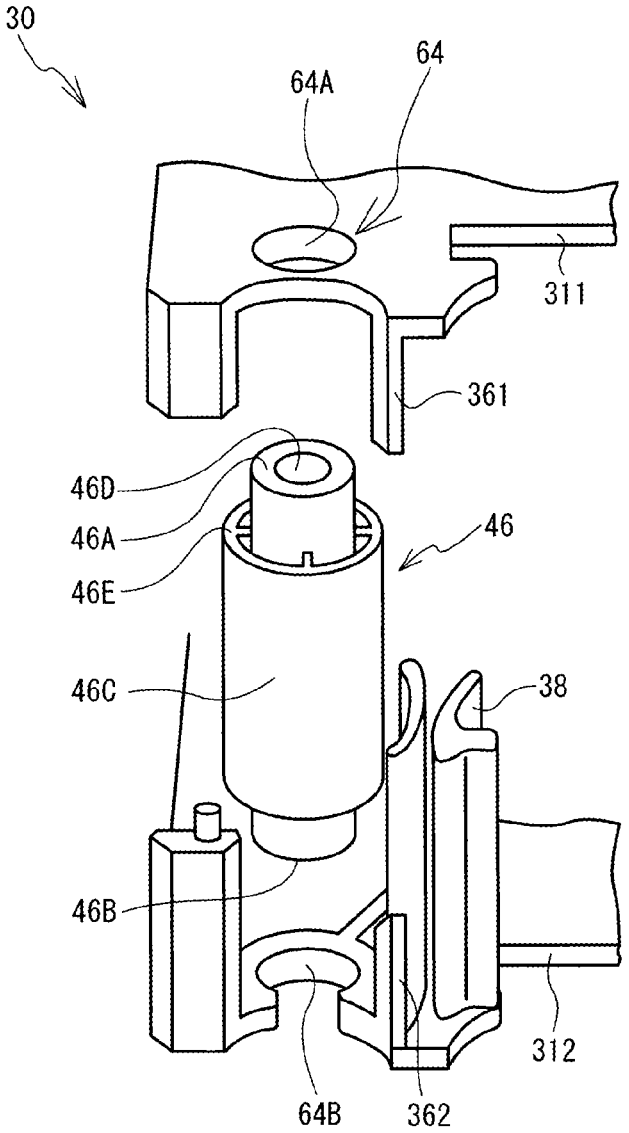
FIG. 17 is an exploded oblique view of a roller support hole 64 and a tape drive roller 46.

As shown in FIG. 17, the tape drive roller 46 is rotatably supported through the roller support hole 64, which passes through the cassette case 31 in the up-down direction. More specifically, the roller support hole 64 has an opening 64A and an opening 64B that are through-holes that are formed in mutually opposed positions in the top plate 305 and the bottom plate 306, respectively. The previously described pair of the restraining members 361, 362 are formed in positions that are in the vicinity of the openings 64A, 64B, respectively. To the rear of the pair of the restraining members 361, 362, the ribbon guide wall 38 is provided in a vertical orientation spanning the top case 311 and the bottom case 312 adjacent to the pair of the restraining members 361, 362. The width of the gap between the base ends of the pair of the restraining members 361, 362 is set to be the same as the width of the tape.

The tape drive roller 46 is a cylindrical body that has a height dimension that is almost equal to the width (that is, the length in the up-down direction) of the cassette case 31. The outside diameter of a main body 46E of the tape drive roller 46 is larger than the diameters of the openings 64A, 64B, and the outer perimeter surface of the main body 46E is a roller surface 46C that comes into contact with the tape and the like. The length of the roller surface 46C in the up-down direction (that is, the tape feed width in the tape drive roller 46) is set to be the same as the width of the tape. An upper end portion 46A and a lower end portion 46B that respectively project upward and downward from the main body 46E of the tape drive roller 46 have diameters that are slightly smaller than the diameters of the openings 64A, 64B, respectively. Note that the shaft hole 46D, which passes through the main body 46E in the up-down direction, connects the upper end portion 46A and the lower end portion 46B in the interior of the tape drive roller 46.

In the interior of the cassette case 31, the upper end portion 46A is fitted into the opening 64A in the top plate 305, and the lower end portion 46B is fitted into the opening 64B in the bottom plate 306. The main body 46E comes into contact with the top case 311 from below and restrains the movement of the tape drive roller 46 in the upward direction, and also comes into contact with the bottom case 312 from above and restrains the movement of the tape drive roller 46 in the downward direction. The tape drive roller 46 is thus supported by both of the end portions 46A, 46B and can rotate freely about its axis within the cassette case 31.

A plurality of ribs 46F (refer to FIG. 24) are provided on the inner perimeter wall of the tape drive roller 46 (that is, on the inner wall that forms the shaft hole 46D) toward the lower end. When the tape cassette 30 is mounted in the cassette mounting portion 8, the previously described tape drive shaft 100 is inserted into the shaft hole 46D through the opening 64B. The plurality of the cam members 100A that are provided around the tape drive shaft 100 (refer to FIGS. 19 and 24) are engaged by the plurality of the ribs 46F that are provided on the tape drive roller 46. The rotation of the tape drive shaft 100 is thus transmitted to the tape drive roller 46. In other words, the tape drive roller 46 rotates in conjunction with the rotation of the tape drive shaft 100.

Figure 18:
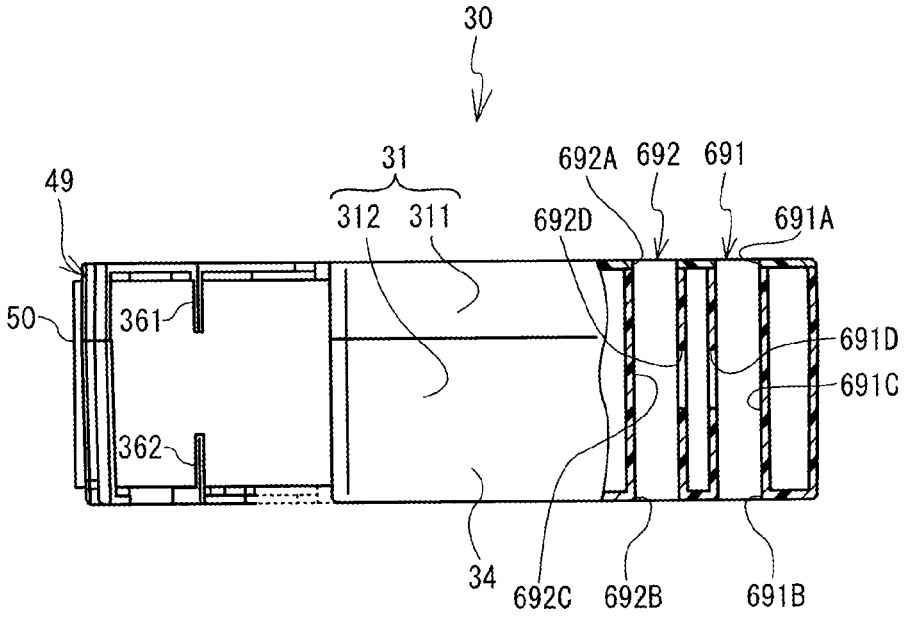
FIG. 18 is a side sectional view of the tape cassette 30 in which a first rectangular hole 691 and a second rectangular hole 692 are mainly shown.

As shown in FIG. 18, the first rectangular hole 691 has an opening 691A and an opening 691B that are recessed holes that extend from the top plate 305 and the bottom plate 306, respectively, such that they are opposed one another, and a shaft hole 691C that connects the openings 691A, 691B. The second rectangular hole 692 has an opening 692A and an opening 692B that are recessed holes that extend from the top plate 305 and the bottom plate 306, respectively, such that they are opposed one another, and a shaft hole 692C that connects the openings 692A, 692B. Openings 691D, 692D are respectively provided on faces of the shaft hole 691C and the shaft hole 692C that are positioned opposite one another. The feed path for the tape, as shown in FIGS. 4 to 7, is provided between the faces where the shaft hole 691C and the shaft hole 692C are positioned opposite one another.

As shown in FIGS. 12 and 14, the second tape support hole 66 is provided with a pair of openings 66A, 66B that are formed in mutually opposed positions in the top plate 305 and the bottom plate 306, respectively. The openings 66A, 66B are both continuous with recessed portions that are recessed in the interior of the cassette case 31 such that they are opposed one another. The second tape spool 41 is a cylindrical body that has a height dimension that is almost the same as the tape width of the printing medium. In the case of the laminated type of the tape cassette 30, the film tape roll 591 is provided on the outside perimeter of the second tape spool 41 (refer to FIGS. 4 and 5). When the film tape roll 591 is placed into the cassette case 31, the recessed portions with which the openings 66A, 66B are continuous are each inserted into openings at both ends of the shaft hole that passes through the second tape spool in the up-down direction. The second tape spool 41 is thus supported by the second tape support hole 66 and can rotate freely about its axis within the cassette case 31. Note that the receptor type and the thermal type of the tape cassette 30 that are shown in FIGS. 6 and 7 are not provided with the second tape spool 41.

In the same manner, the ribbon support hole 67 is also provided with a pair of openings 67A, 67B that are formed in mutually opposed positions in the top plate 305 and the bottom plate 306, respectively. The openings 67A, 67B are both continuous with recessed portions that are recessed in the interior of the cassette case 31 such that they are opposed one another. The ribbon spool 42 is a cylindrical body that has a height dimension that is almost the same as the width of the tape, and the ink ribbon 60 is wound around its outside perimeter surface. When the ink ribbon 60 is placed into the cassette case 31, the recessed portions with which the openings 67A, 67B are continuous are each inserted into openings at both ends of the shaft hole that passes through the ribbon spool 42 in the up-down direction. The ribbon spool 42 is thus supported by the ribbon support hole 67 and can rotate freely about its axis within the cassette case 31. Note that the thermal type of the tape cassette 30 that is shown in FIG. 7 is not provided with the ribbon spool 42.

Now, the positional relationships among the first rectangular hole 691, the first tape support hole 65, the second tape support hole 66, the winding support hole 68, and the ribbon support hole 67 that are provided in the tape cassette 30 in the present embodiment will be explained in detail with reference to FIG. 12. The previously described roller support hole 64, first rectangular hole 691, first tape support hole 65, and winding support hole 68 are provided in positions that are respectively opposed to the tape drive shaft 100, the second auxiliary shaft 112, the first auxiliary shaft 110, and the ribbon winding shaft 95 in the cassette mounting portion 8 in which the tape cassette 30 will be mounted.

As shown in FIG. 12, the first corner portion 321 is provided in the left front portion of the tape cassette 30. The second recessed portion 326 is provided in the right rear portion of the tape cassette 30. In a case where the tape cassette 30 is divided in a plan view along a parting line K that links the first corner portion 321 (more specifically, the tape discharge portion 49 that is provided in the first corner portion 321) and the second recessed portion 326 in a plan view, the area to the rear of the parting line K is a first containment area 30C, and the area to the front of the parting line K is a second containment area 30D. An area that is enclosed by a line that links the centers of the first rectangular hole 691, the shaft hole 46D, and the first tape support hole 65 is called a specific area 350.

The first tape support hole 65 is formed at or near the center of gravity of the first containment area 30C, which forms a triangular shape in a plan view (that is, at the point where the median lines for the three sides that form the first containment area 30C intersect). The winding support hole 68 is formed at or in the vicinity of the center of gravity of the second containment area 30D, which forms a triangular shape in a plan view (that is, at the point where the median lines for the three sides that form the second containment area 30D intersect). Note also that in a plan view, the first tape support hole 65 and the winding support hole 68 are positioned almost symmetrically in relation to the parting line K.

In a plan view, the second tape support hole 66 is formed on the parting line K, or more specifically, is positioned at the approximate midpoint between the center of the tape cassette 30 and the second recessed portion 326 in a plan view. The ribbon support hole 67 is formed in the second containment area 30D, or more specifically, is positioned toward the right front of the tape cassette 30 from the winding support hole 68.

Due to the positional relationships that are described above, the position of the center of gravity in the tape cassette 30 that is shown in FIGS. 4 to 7 is as hereinafter described. In the case of the laminated type of the tape cassette 30 that is shown in FIGS. 4 and 5, among the double-sided adhesive tape roll 581, the film tape roll 591, and the ink ribbon roll 601, the one with the greatest weight is the double-sided adhesive tape roll 581. Furthermore, as described previously, the first tape spool 40, around which the double-sided adhesive tape roll 581 is provided, is rotatably supported by the first tape support hole 65 (refer to FIG. 3) in the interior of the tape cassette 30. This means that in a plan view, the center of winding of the double-sided adhesive tape 58 in the double-sided adhesive tape roll 581 is positioned within the range of the first containment area 30C (refer to FIG. 12) and at one of the vertices that define the specific area 350 (refer to FIG. 12). In other words, in a plan view, the center of gravity of the double-sided adhesive tape roll 581, which has the greatest weight, is positioned within the range of the first containment area 30C and in the specific area 350. Thus the center of gravity of the tape cassette 30 as a whole is positioned in the range of the specific area 350.

Furthermore, the double-sided adhesive tape roll 581, the ink ribbon roll 601, and the ribbon winding spool 44 are disposed on a line that links the second corner portion 322 and the third corner portion 323. In other words, the double-sided adhesive tape roll 581, the ink ribbon roll 601, and the ribbon winding spool 44 are disposed on a diagonal line that intersects another diagonal line that links the first corner portion 321 and the second recessed portion 326. Therefore, the center of gravity of the tape cassette 30 is positioned in the vicinity of the line that links the second corner portion 322 and the third corner portion 323. In this case, if a person holds the tape cassette 30 with his fingers on the first recessed portion and the second recessed portion, the person can hold the tape cassette 30 on opposite sides of the center of gravity position, and the person can manipulate the position of the tape cassette 30 accurately.

In the case of the receptor type of the tape cassette 30 that is shown in FIG. 6, of the printing tape roll 571 and the ink ribbon roll 601, the one with the greater weight is the printing tape roll 571. Furthermore, as described previously, the first tape spool 40, around which the printing tape roll 571 is provided, is rotatably supported by the first tape support hole 65 in the interior of the tape cassette 30. This means that in a plan view, the center of winding of the printing tape 57 in the printing tape roll 571 is positioned within the range of the first containment area 30C (refer to FIG. 12) and at one of the vertices that define the specific area 350 (refer to FIG. 12). In other words, in a plan view, the center of gravity of the printing tape roll 571, which has the greater weight, is positioned within the range of the first containment area 30C and in the specific area 350. Thus the center of gravity of the tape cassette 30 as a whole is positioned in the range of the specific area 350.

Furthermore, the printing tape roll 571, the ink ribbon roll 601, and the ribbon winding spool 44 are disposed on the line that links the second corner portion 322 and the third corner portion 323. In other words, the printing tape roll 571, the ink ribbon roll 601, and the ribbon winding spool 44 are disposed on the other diagonal line that intersects the diagonal line that links the first corner portion 321 and the second recessed portion 326. Therefore, the center of gravity of the tape cassette 30 is positioned in the vicinity of the line that links the second corner portion 322 and the third corner portion 323. In this case, if a person holds the tape cassette 30 with his fingers on the first recessed portion and the second recessed portion, the person can hold the tape cassette 30 on opposite sides of the center of gravity position, and the person can manipulate the position of the tape cassette 30 accurately.

In the case of the thermal type of the tape cassette 30 that is shown in FIG. 7, as described previously, the first tape spool 40, around which the thermal paper tape roll 551 is provided, is rotatably supported by the first tape support hole 65 in the interior of the tape cassette 30. This means that in a plan view, the center winding of the thermal paper tape 55 in the thermal paper tape roll 551 is positioned within the range of the first containment area 30C (refer to FIG. 12) and at one of the vertices that define the specific area 350 (refer to FIG. 12). In other words, in a plan view, the center of gravity of the thermal paper tape roll 551 is positioned within the range of the first containment area 30C and in the specific area 350. Thus the center of gravity of the tape cassette 30 as a whole is positioned in the range of the specific area 350.

With the tape printer 1 and the tape cassette 30 that have been explained above, when the tape cassette 30 is mounted in the cassette mounting portion 8, the three vertically oriented guide shafts in the cassette mounting portion 8 (the tape drive shaft 100, the first auxiliary shaft 110, the second auxiliary shaft 112) and the head holder 74 are respectively guided into the three guide holes that are provided in the tape cassette 30 (the roller support hole 64, the first tape support hole 65, the first rectangular hole 691) and into the head insertion portion 39, such that the tape cassette 30 can be mounted in its proper position in the cassette mounting portion 8.

Figure 19:
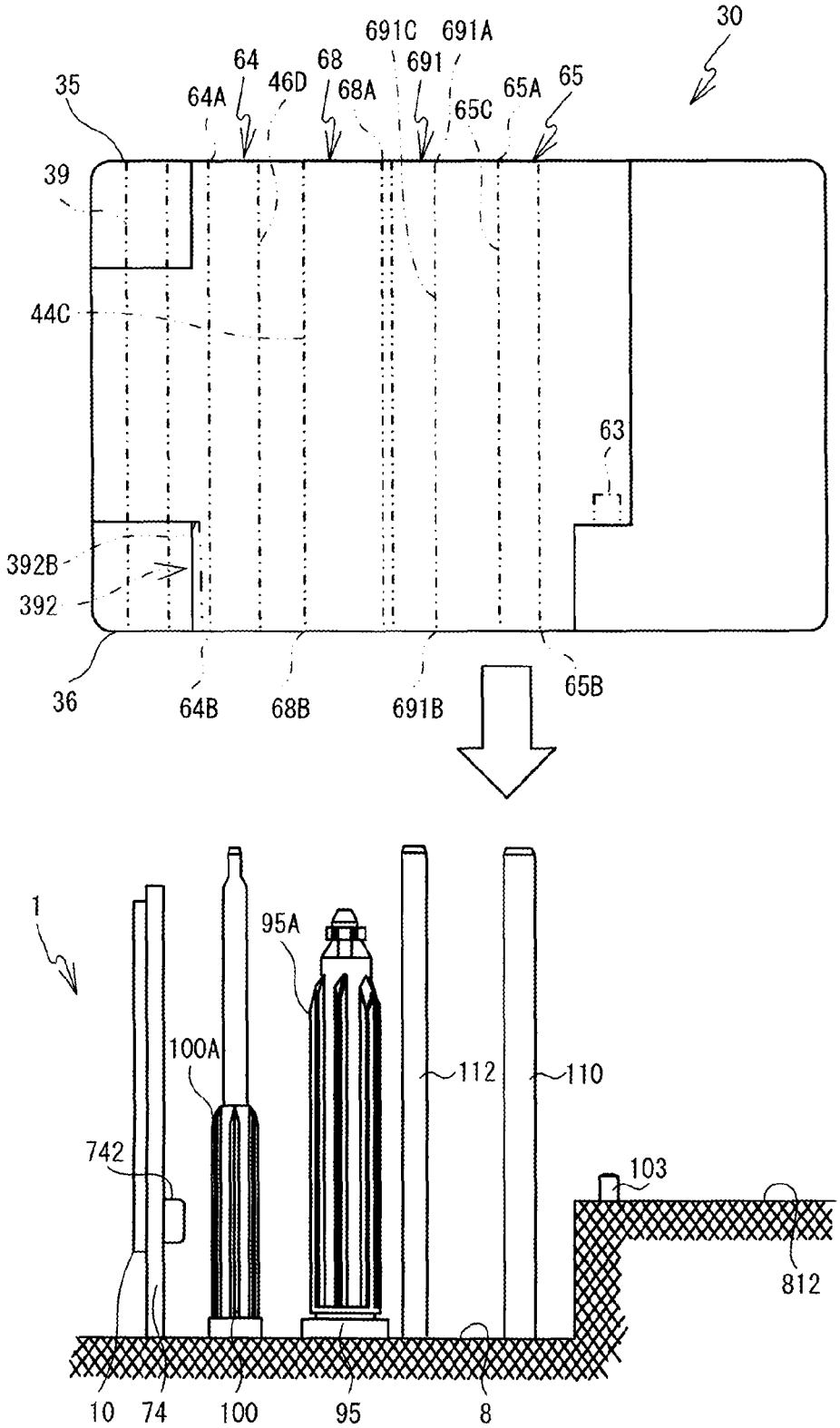
FIG. 19 is a right side view that shows a process of mounting the tape cassette 30 in the cassette mounting portion 8.
Figure 20:
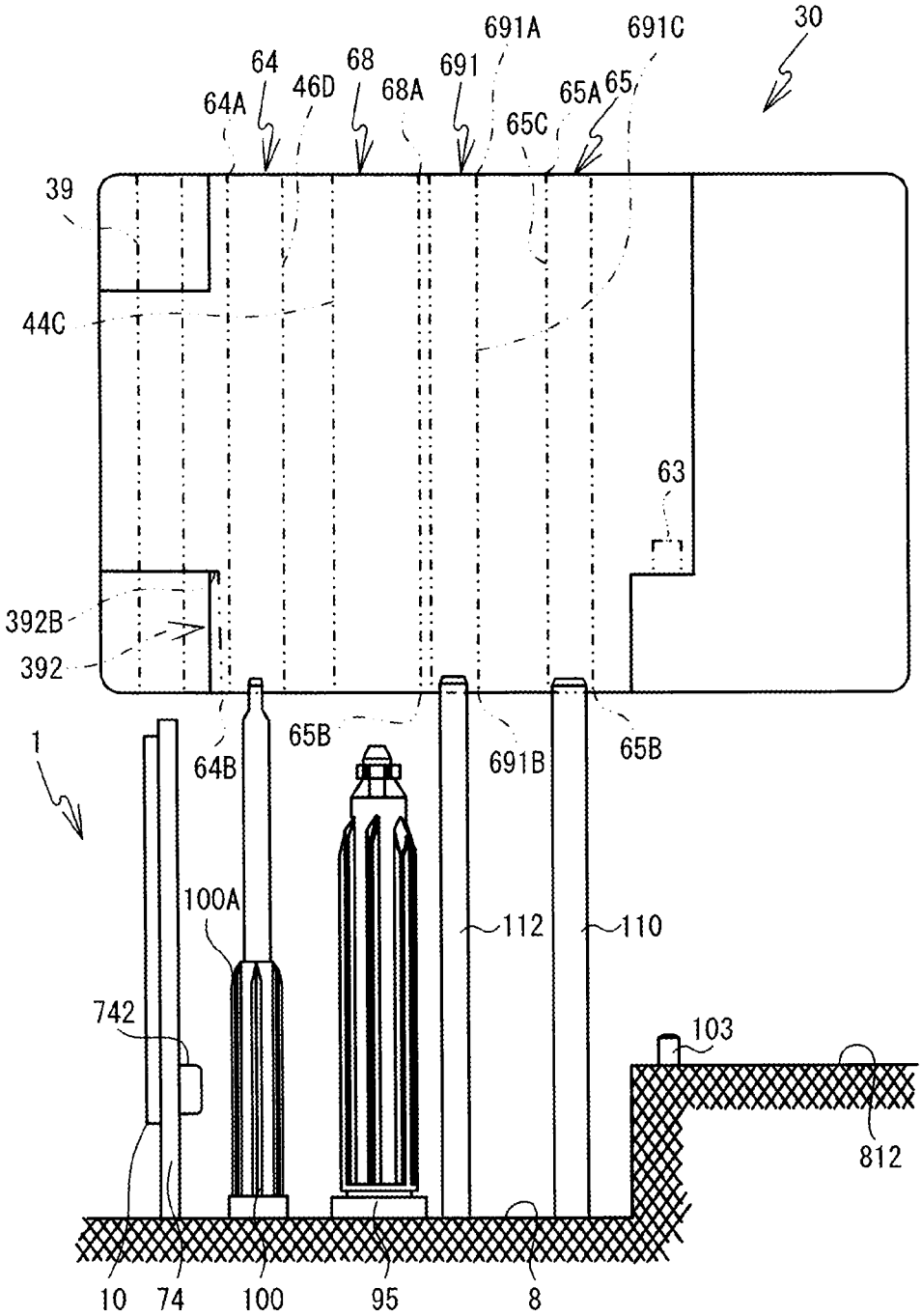
FIG. 20 is a right side view that shows the process of mounting the tape cassette 30 in the cassette mounting portion 8.
Figure 21:
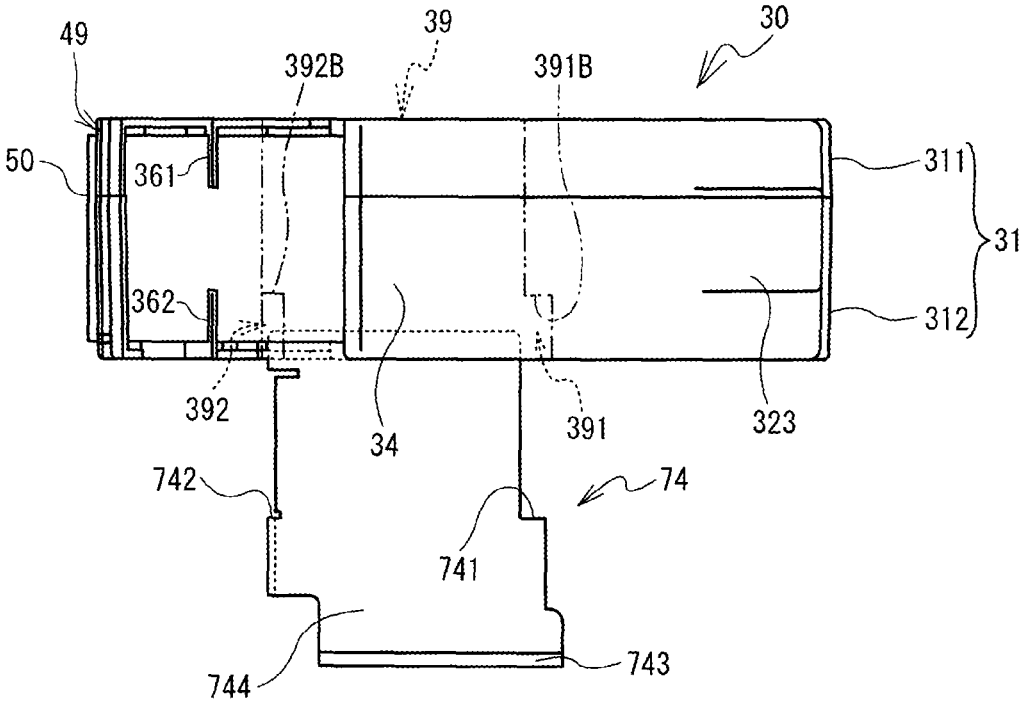
FIG. 21 is a front view that shows a positional relationship between a head insertion portion 39 and the head holder 74 in the process of mounting the tape cassette 30 in the cassette mounting portion 8.
Figure 22:
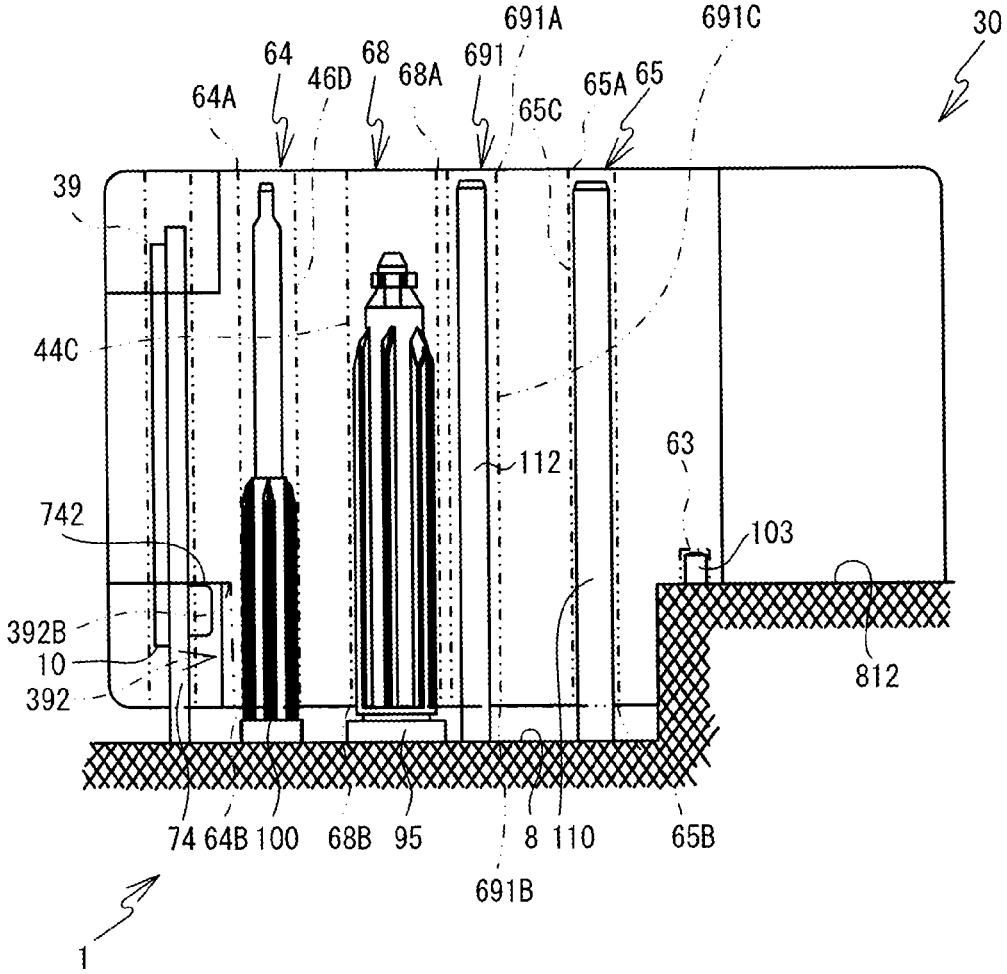
FIG. 22 is a right side view that shows a state in which the tape cassette 30 has been mounted in the cassette mounting portion 8.
Figure 23:
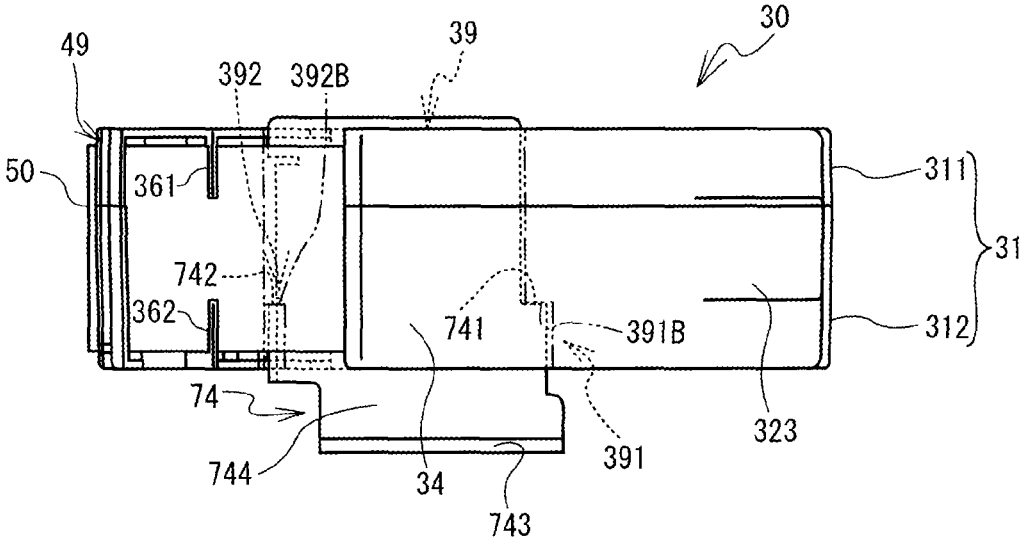
FIG. 23 is a front view that shows the positional relationship between the head insertion portion 39 and the head holder 74 in the state in which the tape cassette 30 has been mounted in the cassette mounting portion 8.

The manner in which the tape cassette 30 is mounted in and removed from the cassette mounting portion 8 in the present embodiment will be explained with reference to FIGS. 19 to 25. FIGS. 19, 20, and 22 show right side views of the tape cassette 30, but to facilitate understanding, the holes that are related to the mounting and removal of the tape cassette 30 are shown as virtual lines (two-dot chain lines). Furthermore, the cassette mounting portion 8 is shown in simplified sectional views as seen from the right side, but to facilitate understanding, only the shafts that are related to the mounting and removal of the tape cassette 30 are shown. The positions of the three guide holes (the roller support hole 64, the first tape support hole 65, the first rectangular hole 691), the head insertion portion 39, and the winding support hole 68 have also been shifted such that they do not overlap, in order to facilitate understanding. In the same manner, the positions of the three guide shafts (the tape drive shaft 100, the first auxiliary shaft 110, the second auxiliary shaft 112), the head holder 74, and the ribbon winding shaft 95 have also been shifted such that they do not overlap. FIGS. 21 and 23 show the front face of the tape cassette 30, but to facilitate understanding, the left and right edges of the head insertion portion 39 of the tape cassette 30 are also shown as virtual lines (broken lines). The thermal head 10 has also been omitted from FIGS. 21 and 23.

First, the height relationships among the various vertically oriented members that are provided in the cassette mounting portion 8 will be explained. As shown in FIG. 19, among the head holder 74, the tape drive shaft 100, the ribbon winding shaft 95, the first auxiliary shaft 110, and the second auxiliary shaft 112, the three guide shafts (the tape drive shaft 100, the first auxiliary shaft 110, the second auxiliary shaft 112) have shaft lengths that are approximately equal. Furthermore, the shaft lengths of the tape drive shaft 100, the first auxiliary shaft 110, and the second auxiliary shaft 112 are greater than the shaft length of the ribbon winding shaft 95 and the vertical size of the head holder 74. Therefore, among the head holder 74, the tape drive shaft 100, the ribbon winding shaft 95, the first auxiliary shaft 110, and the second auxiliary shaft 112, the height positions of the upper ends of the tape drive shaft 100, the first auxiliary shaft 110, and the second auxiliary shaft 112 are the highest, with the height position of the upper edge of the head holder 74 being the next highest, and the height position of the upper end of the ribbon winding shaft 95 being the lowest. However, the height position of the upper end of the ribbon winding shaft 95 is almost the same as the height position of the upper edge of the thermal head 10 that is affixed to the head holder 74.

As shown in FIG. 19, when a user vertically mounts the tape cassette 30 in the cassette mounting portion 8, the positions of the roller support hole 64, the first tape support hole 65, the first rectangular hole 691, and the head insertion portion 39 in a plan view substantially match the positions of the tape drive shaft 100, the first auxiliary shaft 110, the second auxiliary shaft 112, and the head holder 74, respectively, while the top plate 305 and the bottom plate 306 are kept approximately horizontal, as described previously.

When the tape cassette 30 is moved downward toward the cassette mounting portion 8, the upper ends of the tape drive shaft 100, the first auxiliary shaft 110, and the second auxiliary shaft 112 respectively enter the openings 64B, 65B, 691B that are provided in the bottom plate 306 of the tape cassette 30, as shown in FIG. 20, at almost the same time. On the other hand, the head holder 74 and the ribbon winding shaft 95 have not entered the interior of the tape cassette 30, because they are in a state in which their respective upper ends are positioned lower than the bottom plate 306.

When the tape cassette 30 is moved farther downward from the state that is shown in FIG. 20, the tape drive shaft 100, the first auxiliary shaft 110, and the second auxiliary shaft 112 are respectively inserted into the shaft holes 46D, 65C, 691C from below through the openings 64B, 65B, 691B. Inside the shaft holes 46D, 65C, 691C, the lateral movements of the tape drive shaft 100, the first auxiliary shaft 110, and the second auxiliary shaft 112, which have been respectively inserted into them, are restrained by the inner walls of the shaft holes 46D, 65C, 47C, respectively, such that the tape drive shaft 100, the first auxiliary shaft 110, and the second auxiliary shaft 112 are slidable along their orientation (that is, in the up-down direction). In other words, the tape cassette 30 moves downward, with the additional action of its own weight, while being guided along the orientations of the tape drive shaft 100, the first auxiliary shaft 110, and the second auxiliary shaft 112, which have been inserted into the shaft holes 46D, 65C, 691C, respectively. At this time, the center of gravity of the tape cassette 30 is in the specific area 350, which is the area that is formed by the line that links the centers of the shaft hole 46D, the first tape support hole 65, and the first rectangular hole 691, so the tape cassette 30 can be guided with good balance by the tape drive shaft 100, the first auxiliary shaft 110, and the second auxiliary shaft 112. The chance that the tape cassette 30 will tilt is therefore low.

Note that the upper ends of the tape drive shaft 100, the first auxiliary shaft 110, and the second auxiliary shaft 112 have tapered shapes, such that their shaft diameters diminish toward their tips. It is therefore possible to insert the tape drive shaft 100, the first auxiliary shaft 110, and the second auxiliary shaft 112 appropriately and smoothly into the roller support hole 64, the first tape support hole 65, and the first rectangular hole 691, even if slight discrepancies occur in their relative positions in a plan view.

The ribbon winding shaft 95 is inserted into the shaft hole 44C from below through the opening 68B. The opening 68B and the shaft hole 44C are then guided by the ribbon winding shaft 95.

At the same time, as the tape cassette 30 is guided downward from the position that is shown in FIG. 20, the head holder 74 is inserted into the head insertion portion 39 from below, as shown in FIG. 21. When the tape cassette 30 is moved farther downward along the head holder 74, the tape drive shaft 100, the first auxiliary shaft 110, and the second auxiliary shaft 112, the positioning pin 103 that is provided in a vertical orientation on the corner support portion 812 is inserted into the pin hole 63, as shown in FIG. 22. At the same time, the positioning pin 102 that is provided in a vertical orientation on the corner support portion 812 is inserted into the pin hole 62, although this is not shown in FIG. 22. Furthermore, the cassette support portions 741, 742 come into contact with and the first and the fourth bottom flat surface portions 391B, 392B, which are thus positioned as shown in FIGS. 22 and 23. The second and the third bottom flat surface portions 322B, 323B are positioned opposite and supported by the corner support portion 812. In other words, the height position of the tape cassette 30 that has been mounted in the cassette mounting portion 8 is defined as a height position that is supported by the cassette support portions 741, 742, the corner support portion 812, and the like.

The positioning pins 102, 103 are also engaged with the interiors of the pin holes 62, 63, respectively, so the positioning pins 102, 103 are restrained from being displaced laterally. In other words, the position in a plan view of the tape cassette 30 that has been mounted in the cassette mounting portion 8 is defined as the position in a plan view into which it is locked by the positioning pins 102, 103.

Figure 24:
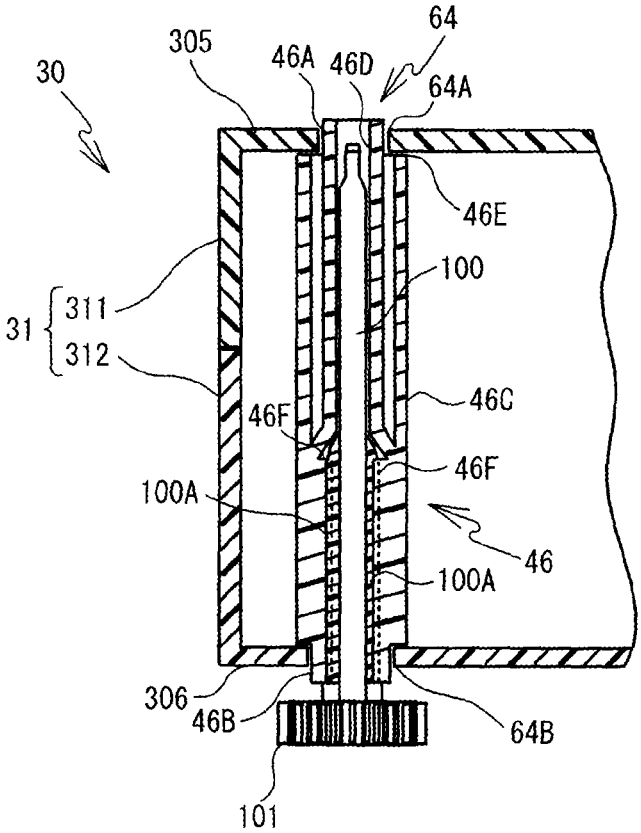
FIG. 24 is a front sectional view that shows a state in which a tape drive shaft 100 has been inserted into the tape drive roller 46.
Figure 25:
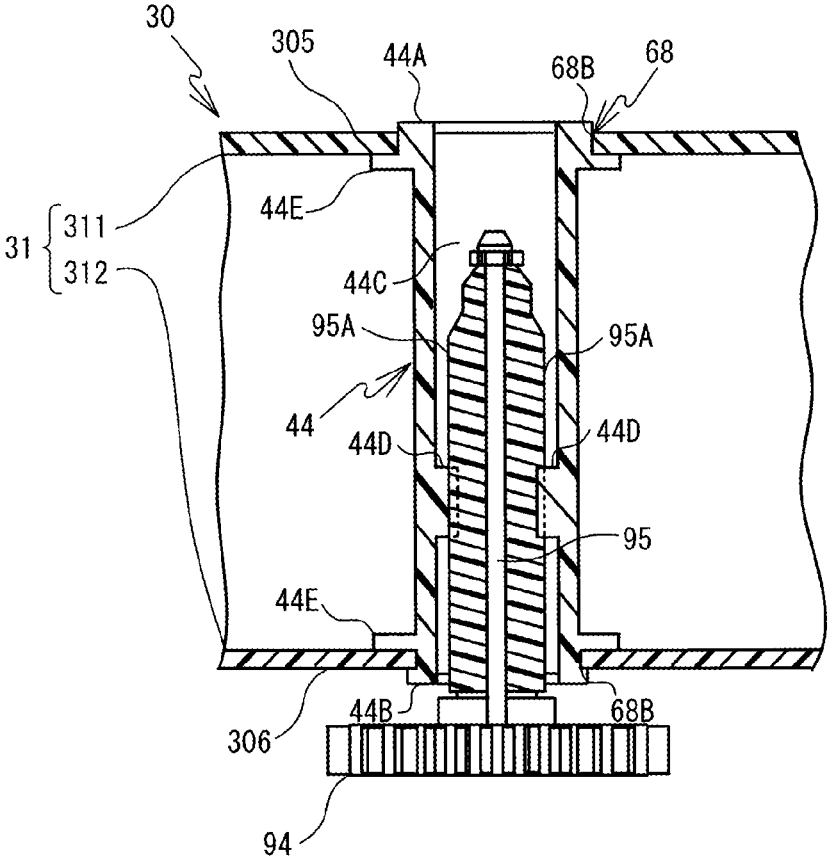
FIG. 25 is a front sectional view that shows a state in which a ribbon winding shaft 95 has been inserted into the ribbon winding spool 44.

Thus, in the present embodiment, the tape cassette 30 can be guided into its proper position in the cassette mounting portion 8 by the three guide shafts (the tape drive shaft 100, the first auxiliary shaft 110, the second auxiliary shaft 112) and the head holder 74. The tape cassette 30 can also be positioned in its proper position in a plan view by the positioning pins 102, 103 and can be positioned in its proper height position by the cassette support portions 741, 742, the corner support portion 812, and the like. In the state in which the tape cassette 30 has been positioned in its proper position, the cam members 100A that are provided at the base end of the tape drive shaft 100 can engage properly with the ribs 46F of the tape drive roller 46, as shown in FIG. 24. The cam members 95A that are provided on the ribbon winding shaft 95 can also engage properly with the ribs 44D of the ribbon winding spool 44, as shown in FIG. 25. The thermal head 10 that is provided in the head holder 74 can also be disposed in the proper printing position in the head insertion portion 39. In other words, the tape printer 1 enters a state in which the printing on the tape can be performed appropriately.

Note that when the tape cassette 30 is removed from the cassette mounting portion 8, the user may pull the tape cassette 30 upward out of the cassette mounting portion 8 while holding the first recessed portion 325 and the second recessed portion 326 of the tape cassette 30, for example. At this time as well, the tape cassette 30 can be guided in the up-down direction by the head holder 74 and the three guide shafts (the tape drive shaft 100, the first auxiliary shaft 110, the second auxiliary shaft 112). This can prevent tilting of the tape cassette 30 from occurring in the process of removing the tape cassette 30 from the cassette mounting portion 8, thus preventing the tape cassette 30 from getting caught on the inner wall or the like of the cassette mounting portion 8. Furthermore, because there is a space between the second recessed portion 326 and the side wall of the cassette mounting portion 8, a finger can be easily inserted into the space, and the tape cassette 30 can be removed easily.

In the present embodiment, the tape printer 1 and the tape cassette 30 are configured as described above. In the present embodiment, it is possible for a person to hold the tape cassette 30 with good balance by placing his fingers on the first recessed portion 325 and the second recessed portion 326, which are disposed in diagonally opposite positions in the tape cassette. Furthermore, because the tape exposing portion 78 is provided in the vicinity of the first recessed portion 325, a person is able to place his fingers in the vicinity of the tape exposing portion 78. It is therefore possible to manipulate the position of the tape exposing portion 78 accurately, so another object is not likely to come into contact with the tape exposing portion 78. Furthermore, the tape drive roller 46 is provided adjacent to the rear side of the tape exposing portion 78, so even if another object does come into contact with the tape exposing portion 78, the movement of the tape toward the rear can be restrained by the tape drive roller 46. It is therefore possible to prevent the tape from going slack. Because the tape can be prevented from going slack, the chance that the tape will get caught on the tape printer 1 can be reduced.

The tape exposing portion 78 is provided, and the tape drive roller 46 is provided adjacent to the tape exposing portion 78. It is therefore possible to discharge the tape from the tape discharge portion 49 with little resistance.

Furthermore, because the first recessed portion 325 and the second recessed portion 326 are recessed portions, it is easy for a person to place his fingers there, making it possible for the person to hold the tape cassette 30 firmly. Because the first recessed portion 325 is provided on a side face of the tape cassette 30, the possibility that a person's fingers will touch the tape exposing portion 78 may be less than in a case where a person holds the tape cassette 30 by placing his fingers on the front and the rear of the tape cassette 30. Therefore, the chance that dirt or the like will adhere to the tape can be reduced.

Furthermore, in a case where a person attempts to hold the tape cassette 30, the person can visually discern from the fact that the first recessed portion 325 and the second recessed portion 326, which are recessed portions, have been provided that he may hold the tape cassette 30 by placing his fingers on the first recessed portion 325 and the second recessed portion 326. Therefore, the possibility that the user will hold the tape cassette 30 by placing his fingers in the front-rear direction can be reduced, and the possibility that the user's fingers will touch the tape on the front face of the tape cassette 30 can be reduced. Therefore, the chance that dirt or the like will adhere to the tape can be reduced.

Furthermore, the distance between the first recessed portion 325 and the second recessed portion 326 is shorter than the length of the tape cassette 30 in the left-right direction, and because that is so, it is easier for a person to hold the tape cassette 30 by the first recessed portion 325 and the second recessed portion 326 than to hold it by the left and right side faces, so the person can manipulate the position of the tape cassette 30 more accurately. It is therefore possible for a person to mount the tape cassette 30 in the cassette mounting portion 8 more smoothly.

In the present embodiment, the shaft hole 46D and the first recessed portion 325 are close to one another. In other words, in a case where a person holds the tape cassette 30 by placing his fingers on the first recessed portion 325 and the second recessed portion 326, the position of the person's fingers is close to the position of the shaft hole 46D. It is therefore possible for the person to manipulate the position of the shaft hole 46D accurately. Accordingly, when a person mounts the tape cassette 30 in the cassette mounting portion 8, the person can easily match the positions of the shaft hole 46D and the tape drive shaft 100, making it possible to mount the tape cassette 30 smoothly.

Furthermore, in the present embodiment, when the tape cassette 30 is mounted in the cassette mounting portion 8, the ribbon support hole 67 (the shaft hole 44C) and the opening 68B can be guided along the ribbon winding shaft 95. Therefore, the tape cassette 30 can be mounted appropriately along the ribbon winding shaft 95.

Furthermore, in a case where a person holds the tape cassette 30 by placing his fingers on the first recessed portion 325 and the second recessed portion 326, the head insertion portion 39 is unlikely to be covered by the person's hand. In other words, the position of the head insertion portion 39 is easy to see. Therefore, in a case where a person mounts the tape cassette 30 in the cassette mounting portion 8, the person can easily match the position of the head holder 74 and the position of the head insertion portion 39, making it possible to mount the tape cassette 30 smoothly.

The printing on the tape is performed on the downstream side of the arm portion 34. Therefore, the printing quality improves if the position of the arm portion 34 is set appropriately. In the present embodiment, the first bottom flat surface portion 391B is provided in the vicinity of the arm portion 34. The first bottom flat surface portion 391B can also be supported by the head holder 74 that is provided in the tape printer 1, and the height position of the arm portion 34 can be kept stable. Therefore, the height position of the arm portion 34, which tends to affect the printing quality, can be set appropriately. The printing precision can be thus improved.

In the same manner, the fourth bottom flat surface portion 392B is also provided in the vicinity of the arm portion 34 and can be supported by the head holder 74. Therefore, the height position of the arm portion 34 can be set more appropriately. The printing precision can be thus improved even more.

In the present embodiment, the first and fourth bottom flat surface portions 391B, 392B are provided in the vicinity of the specific area 350. And the center of gravity of the tape cassette 30 is positioned in the specific area 350. Therefore, the first and fourth bottom flat surface portions 391B, 392B can be supported by the head holder 74 in the vicinity of the position of the center of gravity of the tape cassette 30, so there may be little concern that the tape cassette 30 will tilt. The printing precision can therefore be improved.

Thus, in the present embodiment, the first and fourth bottom flat surface portions 391B, 392B are provided in the vicinity of the position of the center of gravity of the tape cassette 30 and in the vicinity of the arm portion 34. Therefore, the height position of the tape cassette 30 and the height position of the arm portion 34 can be set by the first and fourth bottom flat surface portions 391B, 392B at the same time. Therefore, the height position of the tape cassette 30 can be set efficiently. In other words, it is possible to improve the printing precision efficiently.

In the present embodiment, the second and the third bottom flat surface portions 322B, 323B are respectively provided in the second corner portion 322 and the third corner portion 323 that are disposed in diagonal positions. The second and third bottom flat surface portions 322B, 323B can also be supported by the corner support portion 812. The tape cassette 30 can therefore be supported with good balance at the diagonally opposite positions in the tape cassette 30. The height position of the tape cassette 30 can thus become more appropriate, and the printing precision can be improved even more.

Further, when a person holds the tape cassette 30 by placing his fingers at the first recessed portion 325 and the second recessed portion 326, the chance that the remaining amount check hole 70 (refer to FIG. 12) will be covered by the person's hand can be reduced. It is therefore possible to check the remaining amounts of the tape rolls easily.

Note that the tape cassette 30 and the tape printer 1 according to the present disclosure are not limited to the embodiment that is described above, and various modifications can obviously be made within the gist of the present disclosure.

In the embodiment that has been described above, the first, fourth, second, and third bottom flat surface portions 391B, 392B, 322B, 323B are provided, but the number, the shapes, and the like of the bottom flat surface portions are not limited. For example, it is acceptable to provide none of the bottom flat surface portions. At least one of the first, fourth, second, and third bottom flat surface portions 391B, 392B, 322B, 323B may also be provided.

The first rectangular hole 691 and the second rectangular hole 692 are formed in rectangular shapes in a plan view, but they are not limited to those shapes. For example, they may be formed in circular shapes in a plan view.

In the embodiment that has been described above, a portion of the wall that forms the second recessed portion 326 is formed along the area in which the tape roll that is provided around the second tape spool 41 is disposed, but it is not limited to this configuration. For example, it is acceptable for the second recessed portion 326 not to be formed along the area in which the tape roll that is provided around the second tape spool 41 is disposed.

Figure 26:
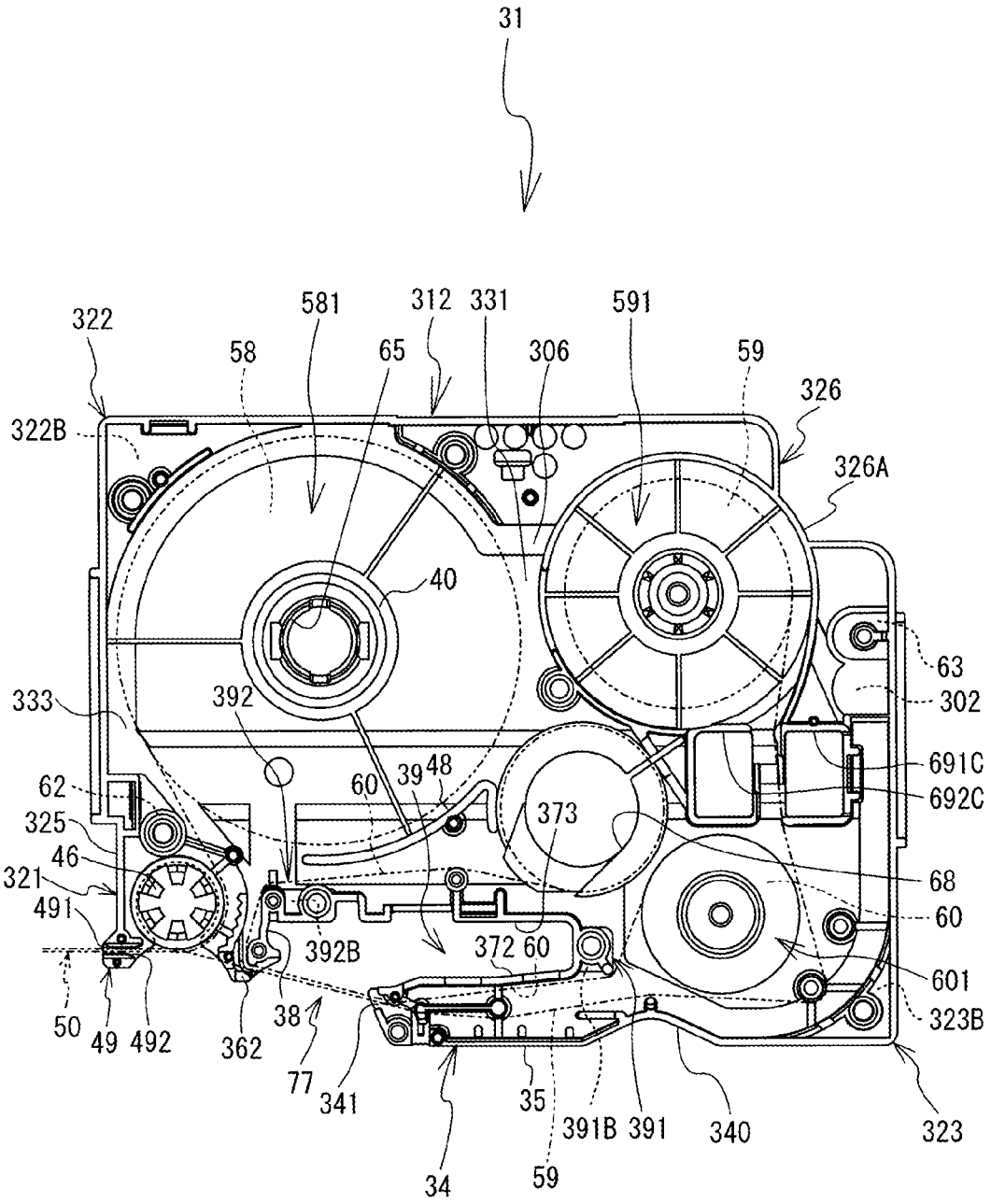
FIG. 26 is a plan view of the bottom case 312 of the cassette case 31 according to a modified embodiment.
Figure 27:
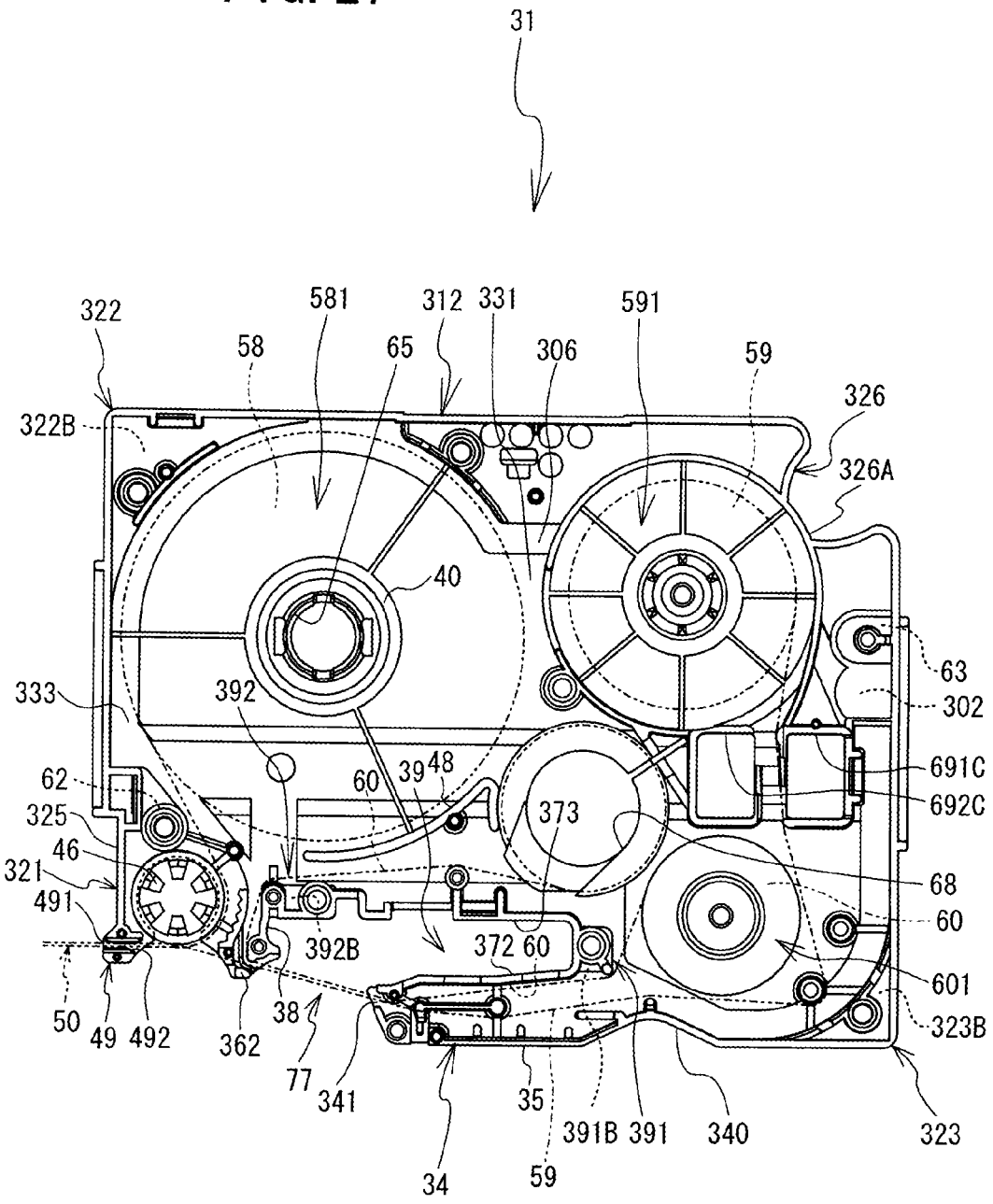
FIG. 27 is a plan view of the bottom case 312 of the cassette case 31 according to another modified embodiment.
Figure 28:
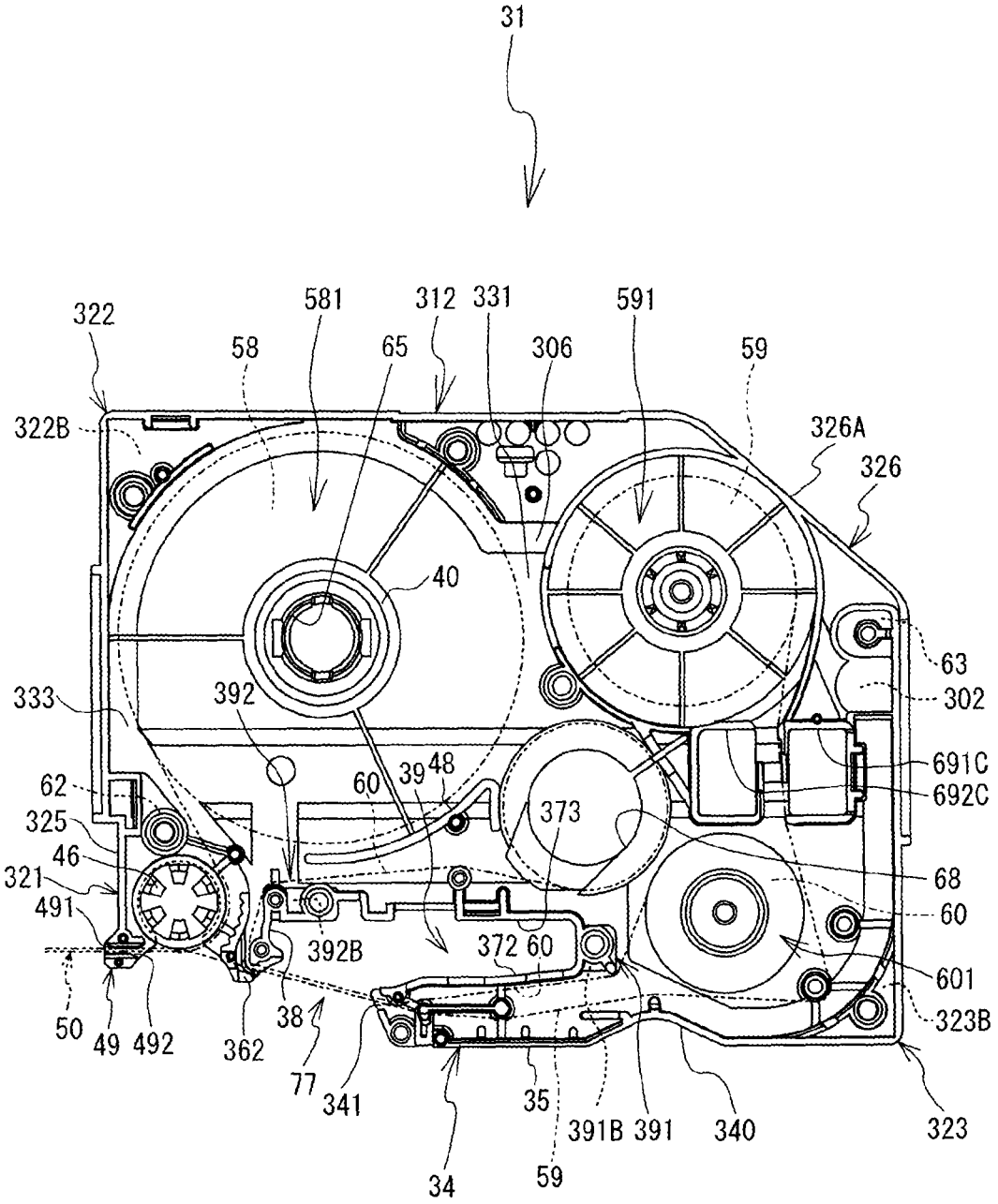
FIG. 28 is a plan view of the bottom case 312 of the cassette case 31 according to another modified embodiment.

The shape of the second recessed portion 326 is also not limited. For example, as shown in FIG. 26, the length of the right side face of the cassette case 31 may be made greater than in the cassette case 31 that is shown in FIG. 13, the length of the rear face may also be made greater, and the size of the second recessed portion 326 may be made smaller. Furthermore, as shown in FIG. 27, the second recessed portion 326 may also be formed by bending the rear portion of the side face on the right side of the cassette case 31, and the right portion of the rear face, toward the center of the inner side of the tape cassette 30. The second recessed portion 326 may also be formed such that the rear portion of the side face on the right side of the cassette case 31, and the right portion of the rear face, are connected by a straight line, as shown in FIG. 28.

Figure 29:
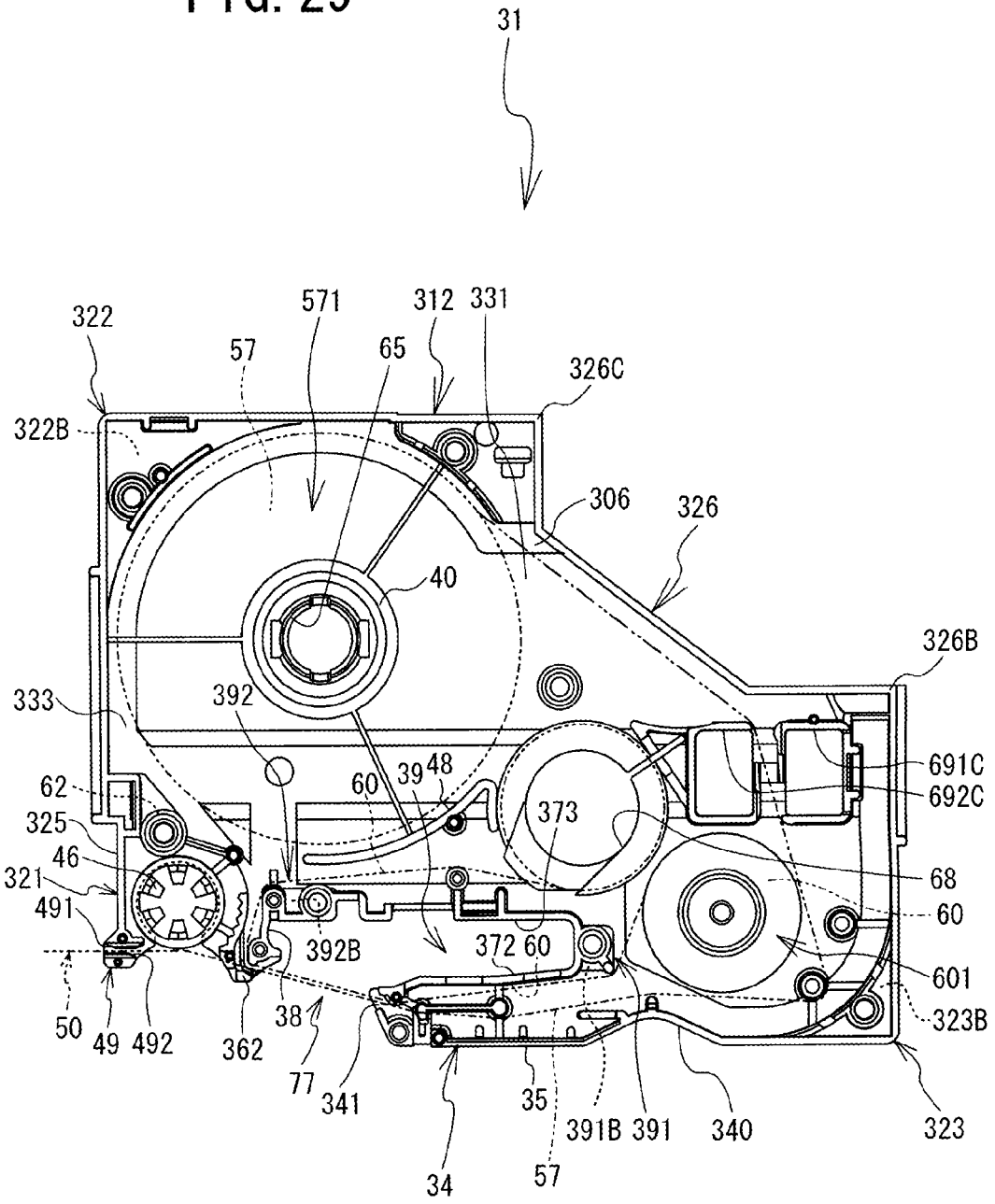
FIG. 29 is a plan view of the bottom case 312 of the cassette case 31 according to another modified embodiment.
Figure 30:
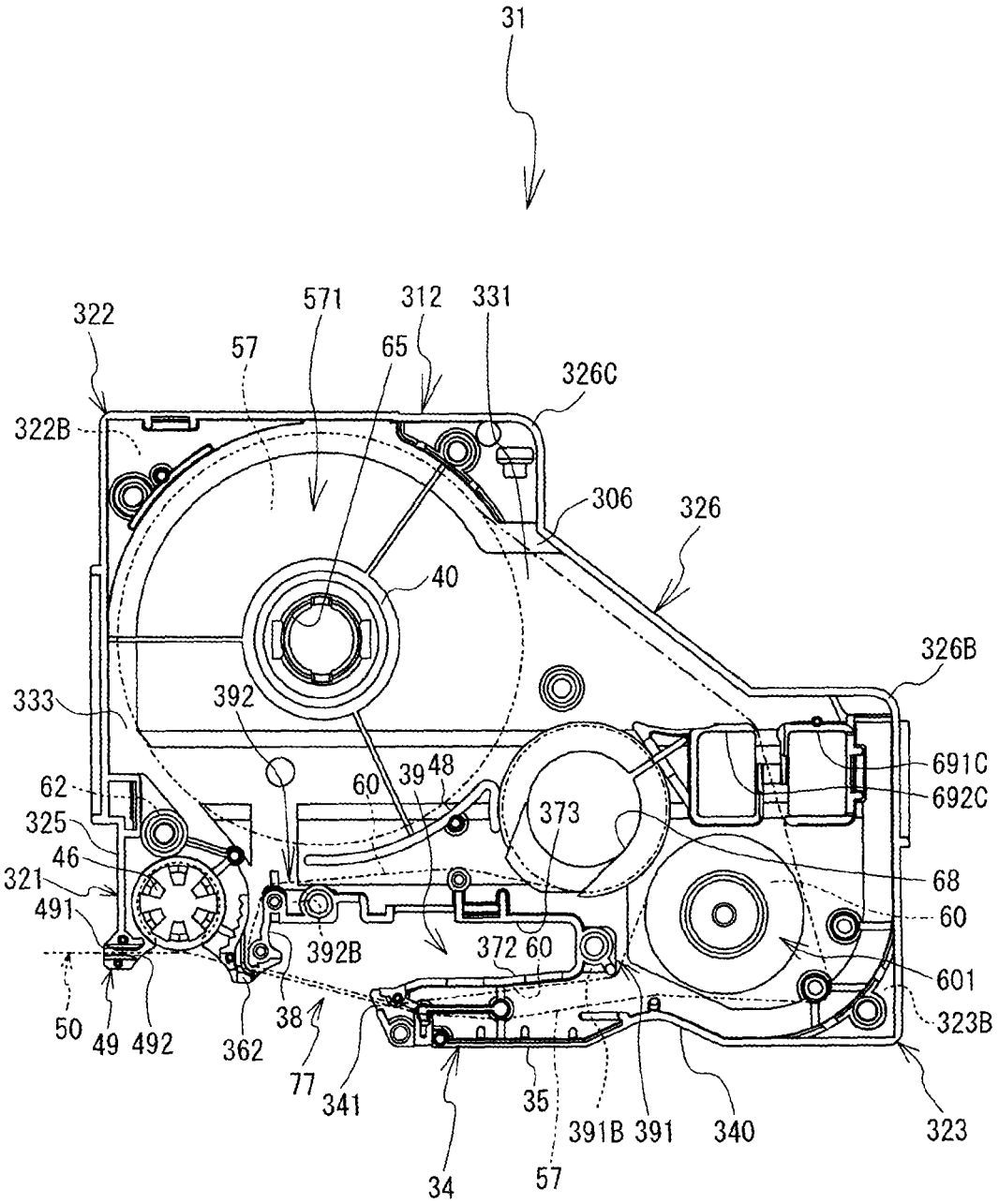
FIG. 30 is a plan view of the bottom case 312 of the cassette case 31 according to another modified embodiment.

Furthermore, in the case of the receptor type of the tape cassette 30, a portion of the second recessed portion 326 may be formed such that it is disposed along a portion of the feed path for the printing tape 57 from the printing tape roll 571 to the right side of the second rectangular hole 692, as shown in FIGS. 29 and 30. Note that the cassette case 31 that is shown in FIGS. 29 and 30 can also be used in the thermal type of the tape cassette 30. In the cassette case 31 that is shown in FIGS. 29 and 30, the second recessed portion 326 may restrain the movement of the tape toward the upper right of the feed path for the tape. This makes it possible to use less material than in a case where a wall that restrains the feed path for the tape is formed separately from the second recessed portion 326. Accordingly, the weight of the tape cassette 30 can be reduced, and the cost can also be reduced.

The shape of the bend in the wall from the right side face of the cassette case 31 to the second recessed portion 326 and the shape of the bend in the wall from the rear face of the cassette case 31 to the second recessed portion 326 are also not limited. For example, a first bent portion 326B that is a portion of the wall that is bent from the right side face of the cassette case 31 toward the second recessed portion 326 may be formed at approximately a right angle, as shown in FIG. 29. In the same manner, a second bent portion 326C that is a portion of the wall that is bent from the rear face of the cassette case 31 toward the second recessed portion 326 may also be formed at a right angle. The first bent portion 326B and the second bent portion 326C may also be formed in arc shapes, for example, as shown in FIG. 30.

Note that in the cassette cases 31 that are shown in FIGS. 26 to 30, only the bottom cases 312 are shown, but the top cases 311 are also formed such that they correspond to the shapes of the second recessed portions 326.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette, comprising:

a cassette case that has a top face, a bottom face, a front face, a rear face, a pair of side faces and a connecting face, each of the pair of side faces having a length in a front-rear direction that is shorter than a length of the cassette case in a left-right direction, the pair of side faces including a left side face and a right side face that are opposed to each other, a first line being a virtual straight line on a same plane with the bottom face and being an extension of a right edge of the bottom face, a second line being a virtual straight line on the same plane with the bottom face and being an extension of a rear edge of the bottom face, a first portion being a rearmost end of a right edge of the cassette case and being located on a front side of an intersection between the first line and the second line, a second portion being a rightmost end of a rear edge of the cassette case and being located on a left side of the intersection, and the connecting face being a plane that extends from the top face to the bottom face and connects the first portion and the second portion;

a tape roll including a tape provided inside the cassette case;

a tape feed roller which is provided on a right side of the left side face and which is provided in a front left corner portion of the cassette case; and a head insertion portion configured such that a head of a printer is inserted thereinto, the head insertion portion being an opening that is formed on a right side of the tape feed roller and extending from the bottom face toward the top face, at least one third line passing through the head insertion portion, and the at least one third line being a virtual straight line that is orthogonal to the connecting face.

2. The tape cassette according to claim 1, further comprising:

an ink ribbon roll including an ink ribbon provided inside the cassette case;

a ribbon winding spool configured to wind the ink ribbon, and wherein a length of the connecting face from the first portion to the second portion is longer than an inside diameter of the ribbon winding spool and is shorter than a length of the cassette case in the left-right direction.

3. The tape cassette according to claim 1, further comprising a tape containment portion positioned around the tape roll, the tape containment portion extending from the bottom face toward the top face, a part of the tape containment portion being a part of a wall defining the connecting face.

4. The tape cassette according to claim 1, wherein a length of the connecting face from the first portion to the second portion is longer than a half of a length of the right side face from a frontmost end of the right edge to the first portion.

5. A tape cassette, comprising:

a cassette case that has a top face, a bottom face, a front face, a rear face, a pair of side faces and a connecting face, each of the pair of side faces having a length in a front-rear direction that is shorter than a length of the cassette case in a left-right direction, the pair of side faces including a left side face and a right side face that are opposed to each other, a first line being a virtual straight line on a same plane with the bottom face and being an extension of a right edge of the bottom face, a second line being a virtual straight line on the same plane with the bottom face and being an extension of a rear edge of the bottom face, a first portion being a rearmost end of a right edge of the cassette case and being located on a front side of an intersection between the first line and the second line, a second portion being a rightmost end of a rear edge of the cassette case and being located on a left side of the intersection, and the connecting face being a plane that extends from the top face to the bottom face and connects the first portion and the second portion;

a tape roll including a tape provided inside the cassette case; and a tape feed roller which is provided on a right side of the left side face and which is provided in a front left corner portion of the cassette case, at least one third line passing through the tape feed roller, the at least one third line being a virtual straight line that is orthogonal to at least one fourth line, the at least one fourth line being a virtual straight line that extends generally parallel to the bottom face outside the cassette case and contacts a connecting portion at a point, and the connecting portion being an edge of the connecting face that connects to the right side face.

6. The tape cassette according to claim 5, further comprising:

an ink ribbon roll including an ink ribbon provided inside the cassette case;

a ribbon winding spool configured to wind the ink ribbon, and wherein a length of the connecting face from the first portion to the second portion is longer than an inside diameter of the ribbon winding spool and is shorter than a length of the cassette case in the left-right direction.

7. The tape cassette according to claim 5, further comprising a tape containment portion positioned around the tape roll, the tape containment portion extending from the bottom face toward the top face, a part of the tape containment portion being a part of a wall defining the connecting face.

8. The tape cassette according to claim 5, wherein a length of the connecting face from the first portion to the second portion is longer than a half of a length of the right side face from a frontmost end of the right edge to the first portion.

9. A tape cassette, comprising:

a cassette case that has a top face, a bottom face, a front face, a rear face, and a pair of side faces, each of the pair of side faces having a length in a front-rear direction that is shorter than a length of the cassette case in a left-right direction, the pair of side faces including a left side face and a right side face that are opposed to each other, a first line being a virtual straight line on a same plane with the bottom face and being an extension of a right edge of the bottom face, a second line being another virtual straight line on the same plane with the bottom face and being an extension of a rear edge of the bottom face, a first portion being a rearmost end of a right edge of the cassette case and being located on a front side of an intersection between the first line and the second line, and a second portion being a rightmost end of a rear edge of the cassette case and being located on a left side of the intersection;

a tape roll including a tape provided inside the cassette case;

a tape feed roller which is provided on a right side of the left side face and which is provided in a corner portion of the cassette case;

a first recessed portion that is formed in the left side face, the first recessed portion being provided in the corner portion, and the first recessed portion being recessed toward the right side face and extending from the top face to the bottom face; and a second recessed portion that is disposed in a diagonally opposite position in the cassette case from the corner portion and that is formed by a connecting face that connects the first portion and the second portion, the connecting face extending from the top face to the bottom face and being at least partly protruded in the opposite direction to the tape roll further than a virtual plane, and the virtual plane connecting the first portion and the second portion and being orthogonal to the same plane with the bottom face.

10. The tape cassette according to claim 9, further comprising:

an ink ribbon roll including an ink ribbon provided inside the cassette case;

a ribbon winding spool configured to wind the ink ribbon, and wherein a length from the first portion to the second portion along the surface of the connecting face is longer than an inside diameter of the ribbon winding spool and is shorter than a length of the cassette case in the left-right direction.

11. The tape cassette according to claim 9, further comprising a tape containment portion positioned around the tape roll, the tape containment portion extending from the bottom face toward the top face, a part of the tape containment portion being a part of a wall defining the connecting face.

12. The tape cassette according to claim 9, wherein a length from the first portion to the second portion along the surface of the connecting face is longer than a half of a length of the right side face from a frontmost end of the right edge to the first portion.

* * * * *